US007003241B1

(12) United States Patent
Kobayashi et al.

(10) Patent No.: US 7,003,241 B1
(45) Date of Patent: Feb. 21, 2006

(54) IMAGE RECORDING DEVICE AND AN IMAGE RECORDING SYSTEM

(75) Inventors: Shinya Kobayashi, Mito (JP); Kunio Satoh, Hitachi (JP); Susumu Edo, Hitachi (JP); Seiji Maruo, Chitose (JP); Takao Kumasaka, Takahagi (JP); Atsushi Onose, Hitachi (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 09/362,126

(22) Filed: Jul. 28, 1999

(30) Foreign Application Priority Data

| | | |
|---|---|---|
| Jul. 31, 1998 | (JP) | 10-217554 |
| Sep. 17, 1998 | (JP) | 10-262697 |
| Mar. 11, 1999 | (JP) | 11-064350 |
| Mar. 30, 1999 | (JP) | 11-088686 |

(51) Int. Cl.
*G03G 15/00* (2006.01)

(52) U.S. Cl. ..... 399/72; 399/151; 358/3.01; 358/475; 358/401; 358/504; 347/243; 250/205

(58) Field of Classification Search ..... 347/243; 358/1.5, 3.01, 401, 504, 474, 475, 481; 399/49, 399/51, 72, 151; 250/205; 359/204, 216
See application file for complete search history.

(56) References Cited

U.S. PATENT DOCUMENTS

| | | | | |
|---|---|---|---|---|
| 4,864,326 A | | 9/1989 | Kawamura et al. | |
| 4,978,976 A | * | 12/1990 | Okino | 347/235 |
| 5,270,827 A | * | 12/1993 | Kobayashi et al. | 358/3.02 |
| 5,371,608 A | * | 12/1994 | Muto et al. | 358/412 |
| 5,481,340 A | * | 1/1996 | Nagao et al. | 399/72 |
| 5,576,852 A | | 11/1996 | Sawada et al. | |
| 5,694,637 A | | 12/1997 | Yoshino et al. | |
| 5,703,860 A | * | 12/1997 | Fukunaga et al. | 369/102 |
| 5,880,766 A | * | 3/1999 | Murakami et al. | 347/236 |
| 5,963,242 A | * | 10/1999 | Nakayama et al. | 347/238 |
| 6,002,506 A | * | 12/1999 | Suzuki et al. | 359/198 |
| 6,038,243 A | | 3/2000 | Mogi | |

FOREIGN PATENT DOCUMENTS

| | | |
|---|---|---|
| DE | 195 44 372 A1 | 9/1996 |
| DE | 197 03 693 A1 | 8/1997 |
| JP | 61-212818 | 9/1986 |
| JP | 10-058746 | 3/1998 |
| JP | 10-073777 | 3/1998 |
| JP | 10-153742 | 6/1998 |

* cited by examiner

*Primary Examiner*—Layla G. Lauchman
(74) *Attorney, Agent, or Firm*—Antonelli, Terry, Stout & Kraus, LLP

(57) ABSTRACT

A multi-beam image recording device is capable of recording high-quality high-resolution images without positional errors by exposing test patterns for measuring positional errors of beam spots of each laser beam in main and subsidiary scanning directions, calculating the positional errors of beam spots using a correcting device, controlling the quantity of exposure according to the result of calculation, and thus correcting the positional errors in main and subsidiary scanning directions.

22 Claims, 64 Drawing Sheets

| MAIN SCANNING PITCH | TEST PATTERN | MEAN SURFACE VOLAGE | RATIO OF EXPOSED AREA | OPTICAL DENSITY |
|---|---|---|---|---|
| A NARROW 32um | 1 32um 4 | -300V | 56% | 0.36 |
| B STANDARD 42um | 1 42um 4 | -250V | 63% | 0.43 |
| C WIDE 53um | 1 53um 4 | -220V | 69% | 0.51 |

$$\begin{pmatrix} VDd1 \\ VDd2 \\ VDd3 \\ VDd4 \end{pmatrix} = A \begin{pmatrix} VD1 \\ VD2 \\ VD3 \\ VD4 \end{pmatrix} \qquad A = \begin{pmatrix} a11 & a21 & 0 & a41 \\ a12 & a22 & a32 & 0 \\ 0 & a23 & a33 & a43 \\ a14 & 0 & a34 & a44 \end{pmatrix}$$

| SPOT POSITION | TEST PATTERN | RATIO OF EXPOSED AREA | MEAN SURFACE VOLTAGE | OPTICAL DENSITY |
|---|---|---|---|---|
| A LEFTWARD 20um | LEFT 20um | 31% | -400V | 0.16 |
| B STANDARD 0um | | 35% | -360V | 0.19 |
| C RIGHTWORD 20um | RIGHT 20um | 39% | -320V | 0.21 |

(WHEN A POLYGON MIRROR OF m-faces IS USED)

(WHEN A LASER ARRAY OF M LIGHT SOURCES IS USED)

IMAGE RECORDING DEVICE AND AN IMAGE RECORDING SYSTEM

BACKGROUND OF THE INVENTION

The present invention relates to an image recording device and an image recording system having a plurality of laser beams (multi-laser beam).

An image-recording device using a laser beam has been widely used because it runs faster with a higher resolution than image-recording devices based on other technologies.

A conventional printer using one laser beam (laser printer) is disclosed in Japanese patent application laid-open publication No. Hei 8-310057 (1996). The printer utilizes features of continuously modulating laser intensities in the main scanning direction and controlling the quantity of attached toner by controlling laser intensities for high-resolution printing. These features eliminate and reduce the irregularities in slanted outlines of characters and images, which makes the printout images and characters smooth.

To run the laser beam printer faster, it is required to make the laser beam (the light beam of a laser) scan at a high speed in both the main scanning direction (horizontally) and in a subsidiary scanning direction (vertically).

These requirements may be accomplished by rotating a photosensitive drum (for vertical scanning) and a rotary polygon mirror (for horizontal scanning) at high speeds. However, the rotational speed of the polygon mirror of the fastest conventional laser beam printer using one laser beam has almost reached its limit. Therefore, a multi-beam method of causing two or more laser beams to scan simultaneously is used instead of increasing the rotational speed of the polygon mirror.

Most laser beam printers (particularly printing systems that may be easily affected by the environmental conditions such as in electrophotography) frequently employ a method of varying the pulse duration (width) of a laser drive signal by modulation (PWM), thus controlling the quantity of light (that is, controlling the print dot sizes by light control) for assurance of picture qualities and stability when they print out multi-level images having pixels whose dot sizes (image data) are multi-leveled (gradated).

There are two methods of generating this pulse-width-modulated laser drive signal (pulses): an Analog method of generating a device signal by comparing a triangular wave created in synchronism with image data by a D/A converter output of the image data, for example, as disclosed in Japanese patent application laid-open publication No. Sho 62-39972 (1987); and a Digital method of generating a drive signal logically (by frequency-division) from a fast clock whose frequency is 4 to 8 times as high as the image clock, as disclosed in Japanese application patent laid-open publication No. Hei 5-6438 (1993).

As described above, a fast printer system for printing multi-level images typically employs a multi-beam method using a pulse-width modulation technique.

Although a laser printer using a multi-beam method is disclosed in Japanese application patent laid-open publication No. Hei 8-15623 (1996), this method may reduce the image accuracy according to uneven dot sizes if the light quantities of the laser sources are not equal. To solve such a problem, a technique is proposed for correcting the light quantities of the laser sources.

For example, Japanese application patent laid-open publication No. Hei 5-212904 (1993) discloses a method of applying a driving signal of an identical pulse width to the driving circuit of each laser source which emits illuminating dots, measuring the intensity of each illuminating dot, and calculating light correction values from the measured intensities of light (light dispersion). This example calculates the ratio of the maximum value Xmax of the light quantity data to the minimum value Xmin, multiplies the image data L by the ratio, multiplies the product by a correction factor Xmin/X for each illuminating dot calculated from the light quantity data X and the minimum value Xmin, and thus obtains the corrected image data L.

There is disclosed another embodiment in Japanese application patent laid-open publication No. Hei 7-199096 (1995). The embodiment detects the quantity of laser light emitted from each laser source using a sensor, compares it to a preset target value, and controls the current of each laser source so that the quantities of laser lights from the laser sources become identical.

SUMMARY OF THE INVENTION

An image recording device using two or more laser beams has the following two problems:

One problem is that the positional accuracy of beam spots in the subsidiary scanning direction is low. This may be mainly caused by the following:

(1) Influence due to the positional accuracy of the multi-beam structure;

(2) Influence due to the horizontal magnification error in the optical system;

(3) Influence due to the surface angle error of the polygon mirror.

These factors cause uneven intervals of beam spots. In other words, the scanning lines are dense in some places and thin in other places. This scanning line trouble is called a scanning unevenness. The scanning unevenness causes exposure unevenness. When developed and visualized, the unevenness may be recognized as a visual unevenness.

The period of generation of this unevenness is dependent upon the product of the number of laser beams by the number of faces of the polygon mirror. This unevenness occurs depending upon said product and the subsidiary scanning period of a tone dither pattern to represent an area gradation and exerts an influence on a low-frequency area which is more sensitive to the visual characteristics of the human eye. This problem also occurs due to the uneven light quantities of laser beams.

The other problem is that the positional accuracy of beam spots in the main scanning direction is low. The position of a beam spot in the main scanning direction is usually detected by a beam detector at the beginning of each scanning line. In a laser beam printer system using a single laser beam, the exact position of a beam spot can be detected because the intensity of the beam spot, the intensity distribution and the position relative to the beam detector are fixed. On the other hand, in a laser beam printer system using two or more laser beams, the beam spot positions in the main scanning direction cannot be exact because the intensity of the beam spot, the intensity distribution and the position relative to the beam detector are not fixed. This problem is called scanning jitter.

These problems are specific to laser beam printer devices using two or more laser beams and rarely occur in laser beam printer devices using a single laser beam.

In a laser beam image recording device using a single laser beam, the positional accuracy of spot beams in the subsidiary direction is within the allowable visual characteristic range, and so such a problem will not occur in the main scanning direction.

An object of the present invention is to obtain high-quality, high-resolution recording images without scanning unevenness and scanning jitters in a laser beam image recording device using two or more laser beams.

To attain the above-stated object, the image recording device according to the present invention is equipped with a plurality of light sources and a photosensitive drum which is exposed by said light sources. The device is further equipped with a unit for setting the quantity of interfered lights of a plurality of image signals corresponding to said light sources, a unit for interfering only said set light quantity component of said image signal, a unit for setting delays of a plurality of image clocks corresponding to said light sources, a unit for delaying said image clocks by said set time period, a memory unit for storing interference data output from said interference block in synchronism with said image clocks and for outputting said interference data in the order the data was stored by delay data output from said delay unit, and a unit for varying the pulse duration (width) of interference data output from said memory unit by modulation.

The interference light quantity setting unit detects a positional error of beam spots in the subsidiary scanning. Its light quantity component is interfered by the interference unit and its pulse width is modulated by the pulse-width modulating unit. With this, the positional error in the subsidiary scanning is corrected. The delay time setting unit detects a positional error of beam spots in the main scanning direction and sets a time period required to correct the error. The delay unit delays the image clocks by a preset time period and the pulse width is modulated by the pulse width modulating unit. With this, the positional error in the main scanning is corrected. The resulting recorded images are high-quality and high-resolution images without scanning unevenness and scanning jitters even when two or more light sources are used.

Further, an image recording device equipped with a plurality of pulse-width modulators for modulating the pulse widths of a plurality of laser driving signals according to the image data and a plurality of laser light sources for outputting a plurality of laser beams whose light quantities are controlled by these laser driving signals to record images by scanning these plurality of laser beams has a unit for detecting unevenness in pulse-width modulation of said plurality of laser driving signals and for correcting said plurality of laser driving signals according to the degrees of unevenness.

When the pulse widths (modulated values) of laser the driving signals for the laser driving circuits are not identical due to unevenness of the circuit characteristics, such as may occur in the pulse width modulators in said image recording device employing a multi-beam method and pulse-width modulation, the aforesaid configuration corrects the laser driving signals according to the unevenness of the pulse widths (pulse-width modulation values) so as not to exert any influence due to the unevenness of the pulse width modulation on the images (print dot sizes) formed by the laser beams.

This configuration is also designed to correct the widths of pulses output from the pulse generating units by causing the pulse generating units to generate pulses in synchronism, comparing the width of pulses output from each pulse generating unit with a reference pulse width, and controlling the pulse generating units to eliminate any difference between them.

Correction of the pulse widths of each pulse generating unit according to the present invention is accomplished by selecting a preset number of serially-connected delay elements in a pulse width controlling unit.

It is preferable to use pulses of one of the pulse generating units as reference pulses and to supply an identical image clock in common to the pulse generating units when causing the pulse generating units to generate pulses in synchronism.

Since the configuration operates to equalize the widths of pulses output from the pulse width modulators which operate to set the light quantities of laser beams, their print dot sizes can be equalized, and consequentially the image data can be recorded at a high resolution.

The image recording device according to the present invention is equipped with a plurality of light sources and a plurality of beam detecting blocks, and further is equipped with a unit for recording an image, a unit for outputting a beam position control signal to control the position of each laser beam between scanning lines according to a plurality of beam detection signals output from said image recording unit and a controller for controlling said image recording unit according to said beam position control signals.

The beam signal controlling unit provided as described above can correct positional deviations of said laser beams, and thus enables the image recording device to record high-quality images.

DESCRIPTION OF THE INVENTION

Referring to FIG. 1 to FIG. 18 and FIG. 22 to FIG. 28, preferred embodiments of the present invention will be explained.

Figure 2:
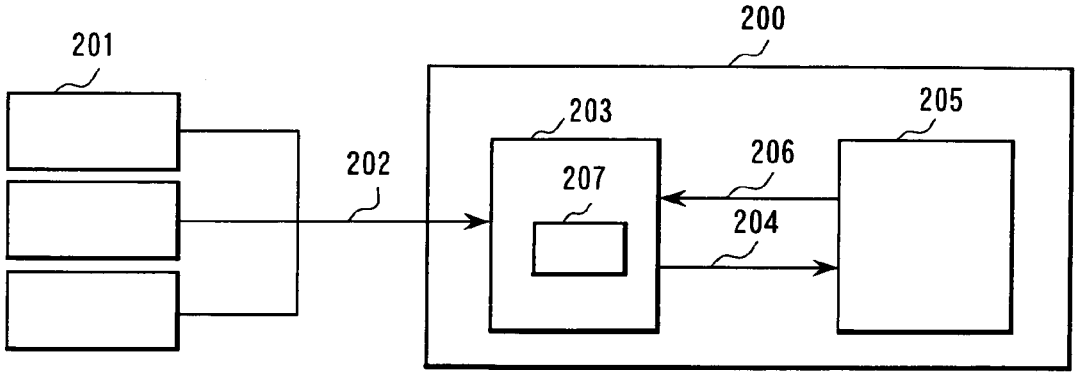
FIG. 2 is a block diagram showing an embodiment of an image recording device according to the present invention.

In FIG. 2, there is shown an operating environment of a general image recording device. The user creates page description data 202 which represents pages to be recorded using a computer 201 and the like. When recording starts, the page description data 202 is sent to a printer controller 203 of an image recording device 200 through a network and the like. The image recording device 200 mainly consists of a printer controller 203 and an engine 205. The printer controller 203 expands page description data 202 page by page as image data 207 on a built-in bit-map memory.

This embodiment assumes that image data 207 is printed on a monochromatic binary laser printer and one piece of binary data is related to one bit of one pixel. After expansion of image data 207 is completed, the printer controller 203 starts the engine 205 of the image recording device 200 and sends image data 207 as a video signal 204 to the engine 205 according to synchronization signals 206 received from the engine 205. The engine 205 records actual images on a recording medium according to the video signals 204.

Figure 3:
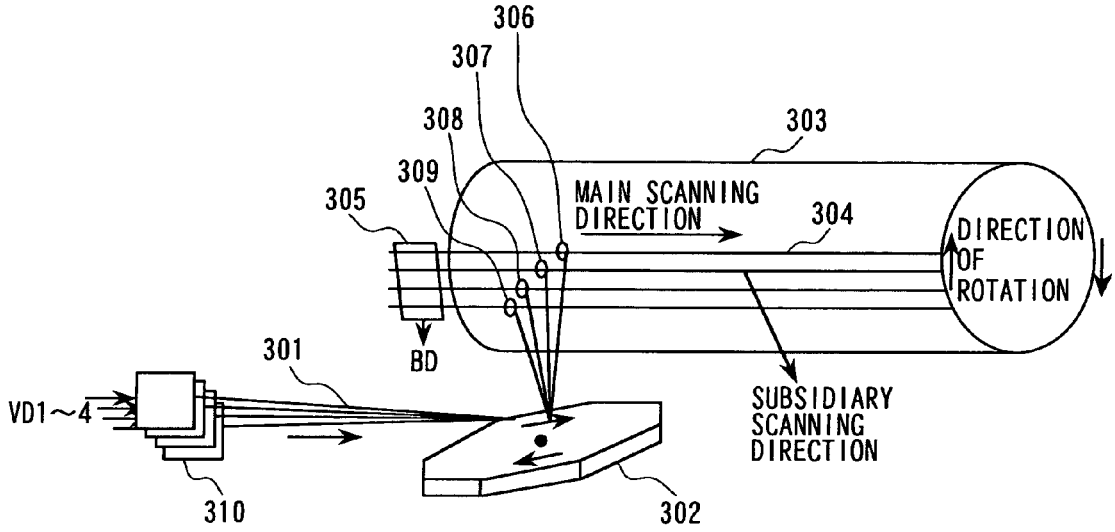
FIG. 3 is a diagram illustrating an exposure system using a plurality of beams.

FIG. 3 shows details of the exposure system used in the engine 205 of FIG. 2. For purpose of simplification, this embodiment assumes that the engine 205 is a monochromatic binary multi-beam laser printer, and only the exposure system related to the present invention will be explained. This embodiment assumes that the exposure system has four laser beams and a rotary polygon mirror 302 with eight faces.

As disclosed in Japanese application patent laid-open publication No. Hei 8-15623 (1996), four laser beams 301 are provided by either providing four laser sources or by dividing one laser beam into four beams, which are emitted onto a rotary polygon mirror 302. In this example, four laser sources 310 are provided to produce the four laser beams, as shown in FIG. 3.

Each of the laser sources 310 usually consists of semiconductor laser and its driver.

Video signals VD1, VD2, VD3, and VD4 are applied to the laser sources 310. When one laser beam is divided into four beams, the laser beams are modulated by AO modulators which are not illustrated in the drawing. As illustrated in FIG. 3, four laser beams 301 are focused onto the surface of the photosensitive drum 303 to form four beam spots 306, 307, 308, and 309. As the rotary polygon mirror 302 rotates, the beam spots move along the main scanning direction.

One scanning forms four scanning lines 304 at a time as four laser beams are applied to the mirror. Therefore, the photosensitive drum rotates by four scanning lines for each scanning. The direction opposite to the direction of rotation of the photosensitive drum 303 is termed a subsidiary scanning direction. The subsidiary scanning direction is perpendicular to the main scanning direction. Laser beam spots formed on the surface of photosensitive drum 303 are numbered 1, 2, 3, and 4 from the upperstream side in the subsidiary scanning direction. In FIG. 3, beam spots 1, 2, 3, and 4 are beam spots 306, 307, 308, and 309.

Problems that the present invention is going to solve will be explained in detail below. One problem is that the positional accuracy of the beam spots in the subsidiary scanning direction is low. When a plurality of light sources are used, the positional accuracy of the beam spots in the subsidiary scanning direction is dependent upon a combination of the structural accuracy of the light sources and the scanning faces of the rotary polygon mirror.

For example, when four semiconductor laser elements are molded into a unit, it is very hard to exactly line up four light emitting points at equal intervals. Similarly when one laser beam is divided into four beams, it is very hard to exactly generate four laser beams.

In addition to this, irregular mirror face tilting makes the positional accuracy of beam spots worse. When the four laser beams pass through a common scanning optical system, their axes are finely changed by these structural irregularities. Consequently, the laser beams have different intensities and intensity distributions, which causes positional errors of beam spots in the subsidiary scanning direction on the photosensitive drum 303 and finally makes scanning line pitches irregular.

Figure 7:
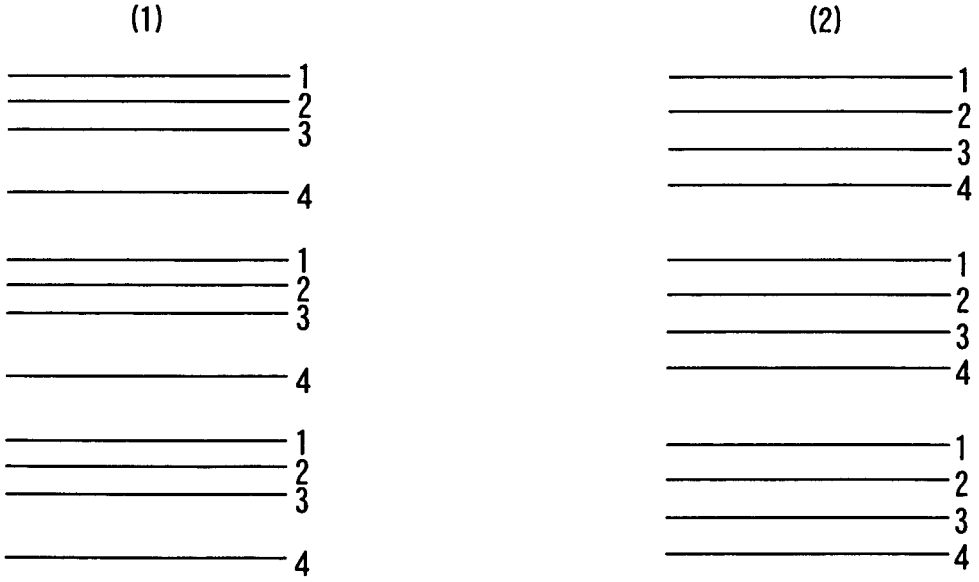
FIGS. 7(*a*) and 7(*b*) are diagrams illustrating scanning unevenness.

FIGS. 7(*a*) and 7(*b*) show examples of positional errors of beam spots (irregular scanning line pitches) in the subsidiary scanning direction due to structural irregularities. Numbers 1, 2, 3, and 4 represent beam spot numbers. These irregular pitches of scanning lines 304 are caused by positional errors due to the structural irregularity of the optical system. In FIG. 7(*a*), the scanning line pitch between beam spots 1, 2, and 3 is narrow but that between beam spots 3 and 4 is wide.

In FIG. 7(*b*), the scanning line pitch between beam spots 1, 2, 3, and 4 is constant but that between beam spots 4 and 1 is wide. This is because the rotational speed of the photosensitive drum 303 is not equal to the subsidiary scanning line speed. The scanning line unevenness which periodically occurs for every certain number of laser beams may drastically deteriorate the image quality because it causes density unevenness, such as a moire pattern, when half tones are recorded with dots and their distances and periods get matched or almost matched.

Figure 22A:
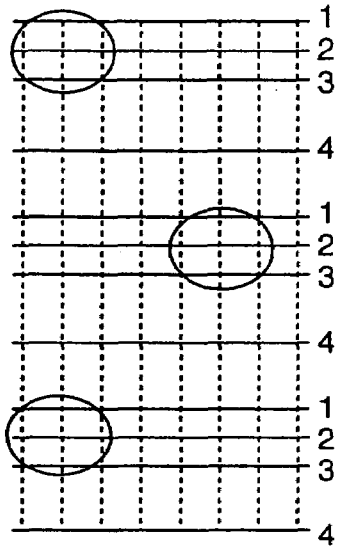
FIGS. 22(*a*) and 22(*b*) are diagrams illustrating scanning line unevenness and spot light unevenness.
Figure 22B:
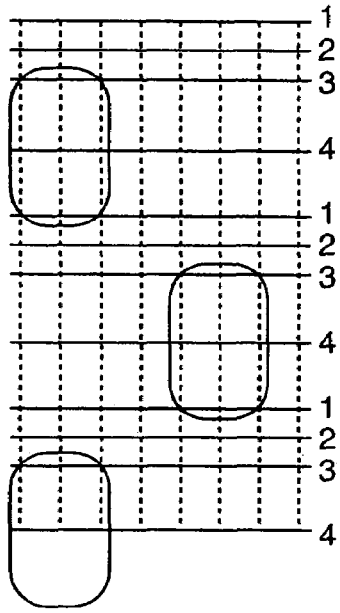

FIGS. 22(*a*) and 22(*b*) show the uneven dot densities caused by irregular scanning line pitches. This example shows a brighter part of a half-tone image made by dots. Usually smaller dots are used to represent a brighter part. It is assumed in FIGS. 22(*a*) and 22(*b*) that the dot centers are disposed periodically at intervals of four scanning lines (by n times where n is 1, 2, 3, . . . ) in the subsidiary scanning direction.

If the scanning lines are irregularly pitched as shown in FIG. 7(*a*), said dots may be disposed as shown in FIG. 22(*a*), FIG. 22(*b*), or in an intermediate status. In FIG. 22(*a*), dots are made smaller and the half-tone image becomes brighter. In contrast, in FIG. 22(*b*), dots are made greater and the half-tone image becomes darker. Further, as the video signal is not in synchronism with the irregular scanning line pitches, the image may have patches of different intensities. Such a symptom occurs also in the slant edges of characters, which makes the characters and images unsmooth, and consequently the image quality is reduced.

Figure 29:
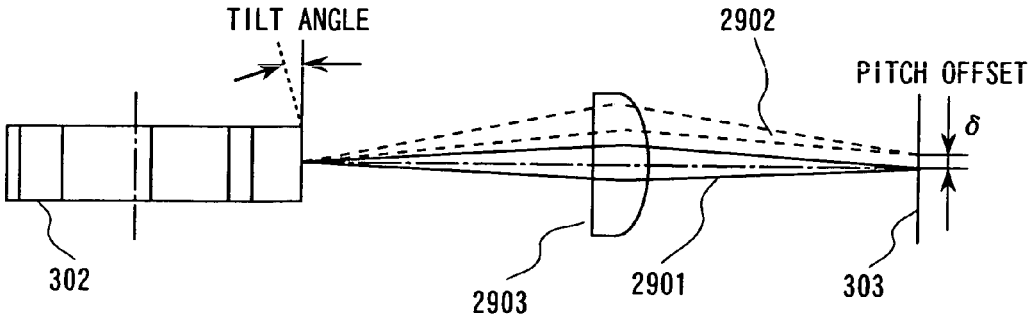
FIG. 29 is a diagram illustrating the tilting of faces of the rotary polygon mirror which is one of problems solved by this invention.

The problem may be also caused by a structural irregularity (a face tilting) of the rotary polygon mirror 302. FIG. 29 shows how a face tilting of the rotary polygon mirror 302 causes an irregularity in the scanning line pitches on the surface of the photosensitive drum 303. The optical system in FIG. 29 employs a complete correction system using a cylindrical lens 2903 in which the scanning faces of the rotary polygon mirror 302 are optically conjugated with the photosensitive drum 303.

As laser beams are usually applied to the scanning surface of the mirror at a certain angle to the optical axis, which is illustrated in FIG. 29, the illustrated position on the rotary polygon mirror 302 moves left and right and thus the complete conjugate system is destroyed. This is also affected by the astigmatism of the lens. As a result, a pitch irregularity δ is formed on the photosensitive drum between a scanning line made by a laser beam 2901 from a non-tilted mirror face and a scanning line made by a laser beam 2902 from a tilted mirror face. The aforesaid description is for a complete correction optical system.

Recently for purpose of simplification of an optical system, there has been an increase in the number of image recording devices using an incomplete correction optical system without a conjugate system. However, the aforesaid trouble may be more serious in such systems. This pitch irregularity δ is caused by a lens correction astigmatism affected by both the structural irregularity of laser beams and the structural irregularity of the rotary polygon mirror 302. Accordingly, the degree of its influence (irregular scanning line pitches) varies according to the tilting of each mirror face.

The irregular scanning line pitches cause uneven exposures. When such an image is developed and visualized, the unevenness is recognized as visual patches in the image. Similar problems may occur also due to irregular light quantities of the laser beams.

The other problem is that the positional accuracy of beam spots in the main scanning direction is low. Referring again to FIG. 3, beam spot scanning positions 306 to 309 in the main scanning direction are usually detected by a beam detector 305 at the top of each scanning line 304. A beam detector 305 is provided at the beginning of each scanning line 304 and generates four different beam detection signals BD for each scanning as beam spots 1 to 4 scan across the beam detector 305.

Usually, beam spot scanning positions 306 to 309 are significantly deviated from each other in the main scanning direction to make the scanning line pitch 304 smaller. In this embodiment, beam spot 1 is positioned right most and beam spots 2 to 4 follows to the left of beam spot 1 at predetermined intervals. Therefore, the beam detector 305 first generates a pulse signal BD1 by a laser beam 1 and then generates the other pulse signals BD2, BD3, and BD4 in this sequence in a short time period. Referring FIG. 4 to FIG. 6, the possible causes of a degrading of the positional accuracy of beam spots in the main scanning direction will be explained.

Figure 4:
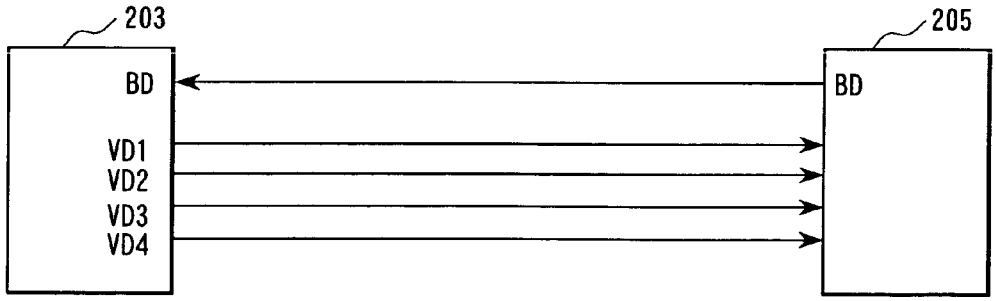
FIG. 4 is a block diagram illustrating synchronization signals flowing between the controller and the engine.

FIG. 4 shows the exchange of synchronization signals between the printer controller 203 and the engine 205. In this example, the aforesaid beam detection signals BD are equivalent to the synchronization signal 206 of FIG. 2. The printer controller 203 receives a signal BD from the engine 205 and separates signals BD1, BD2, BD3, and BD4 from the signal. This signal separation is disclosed in Japanese application patent laid-open publication No. Hei 8-15623 (1996). The printer controller 203 generates pixel clocks DCLK1, DCLK2, DCLK3 and DCLK4 (not illustrated) in phase-synchronism with these synchronization signals BD1, BD2, BD3, and BD4, generates video signals VD1, VD2, VD3, and VD4 corresponding to laser sources 310 in synchronism with the pixel clocks DCLK1, DCLK2, DCLK3 and DCLK4, and sends the video signals to the engine 205.

Figure 5:
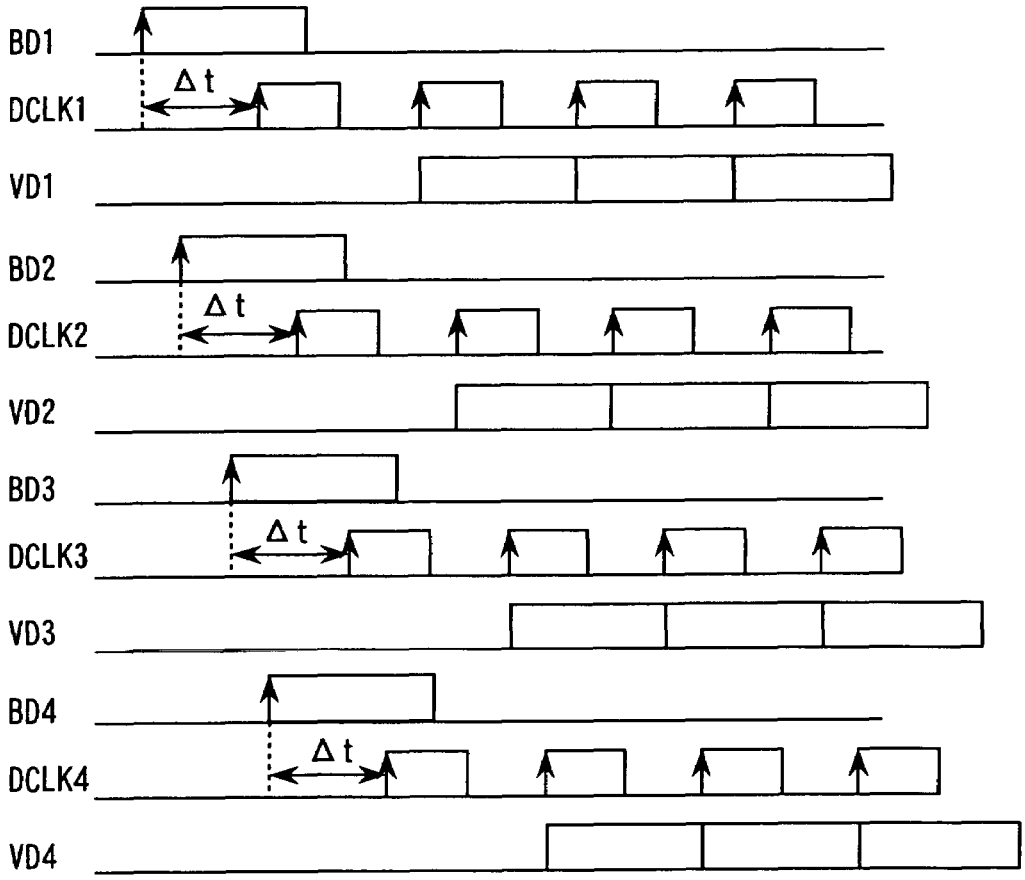
FIG. 5 is a waveform diagram of the synchronizing signals.

FIG. 5 shows waveforms of synchronization signals BD1, BD2, BD3, and BD4, pixel clocks DCLK1, DCLK2, DCLK3, and DCLK4, and video signals VD1, VD2, VD3, and VD4. A time period Δt between each synchronization signal BD and its pixel clock DCLK is retained exactly constant. Each video signal VD is sent exactly in synchronism with its pixel clock. In this way, the beam spot scanning positions 306 to 309 are adjusted to the recording positions.

However, in the multi-beam image recording device, intensities and intensity distributions of beam spots may be different. The position of each beam spot relative to the center of the beam detector 305 may different. (In a 4-beam system, the inner two beam spots are necessarily closer to the center of the beam detector than the outer two beam spots.)

Further, each beam spot has a different relationship between the position of each beam detection signal BD and the actual position of a beam spot in the main scanning direction, because the positions of beam spots in the subsidiary scanning direction are different, as described above. Finally, a positional error occurs in the main scanning direction.

Figure 6:
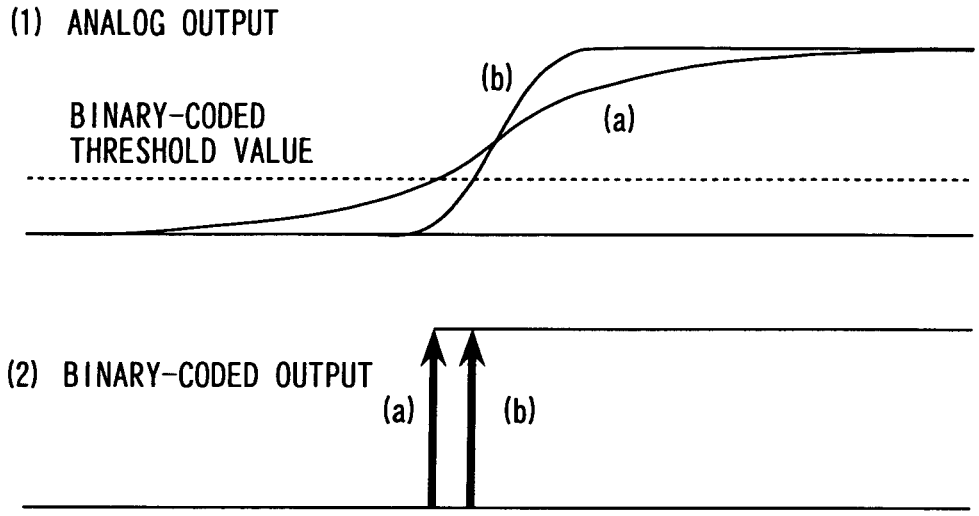
FIGS. 6(*a*) and 6(*b*) are graphs of the output characteristics of the beam detector.

FIG. 6(*a*) shows the inputs to the beam detector 305 of a beam spot having a wide intensity distribution (a) and a beam spot having a narrow intensity distribution (b). The difference in intensity distributions is dependent upon spot diameters and light emitting powers (light intensities). The beam detector 305 receives each laser beam at a photo diode or the like, converts its intensity into an analog electric signal, digitizes it at a certain level (threshold), and outputs a binary digital value, as seen in FIG. 6(*b*).

Even when two beam spots have an identical center position, the analog output of a beam spot having a narrow intensity distribution (b) rises more sharply than the analog output of a beam spot having a wide intensity distribution (a). When the analog outputs are digitized at a threshold value, as shown in FIG. 6(*b*), the binary output of (a) rises earlier. Generally, considering the sensitivity distribution of the light receiving part of the beam detector 305, the positional error of beam spots may occur when the positions of beam spots relative to the beam detector 305 differ.

In the following, examples of several preferred embodiments of this invention for solving the aforesaid problems will be described.

Figure 8:
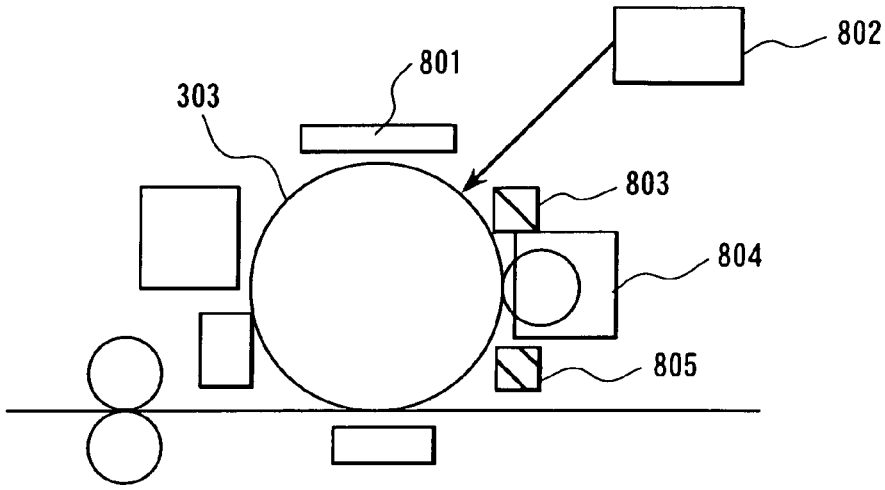
FIG. 8 is a schematic block diagram of an embodiment of an image recording device according to the present invention.

FIG. 8 shows an example of an engine of an image recording device of the present invention. The photosensitive drum 303 is uniformly charged by a charger 801 and scanned with laser beams from an exposure optical system 802 according to video signals 204. An image on the surface of the photosensitive drum is developed by means of toner received from the developer 804.

Immediately before development, the surface potentiometer 803 measures the surface potential on the photosensitive drum 303. The surface potentiometer 803 requires an area of 1 cm square for measurement and measures the average potential of the area.

For purpose of simplification, the following example assumes that printing is not affected by face tilting of the rotary polygon mirror.

Figure 9:
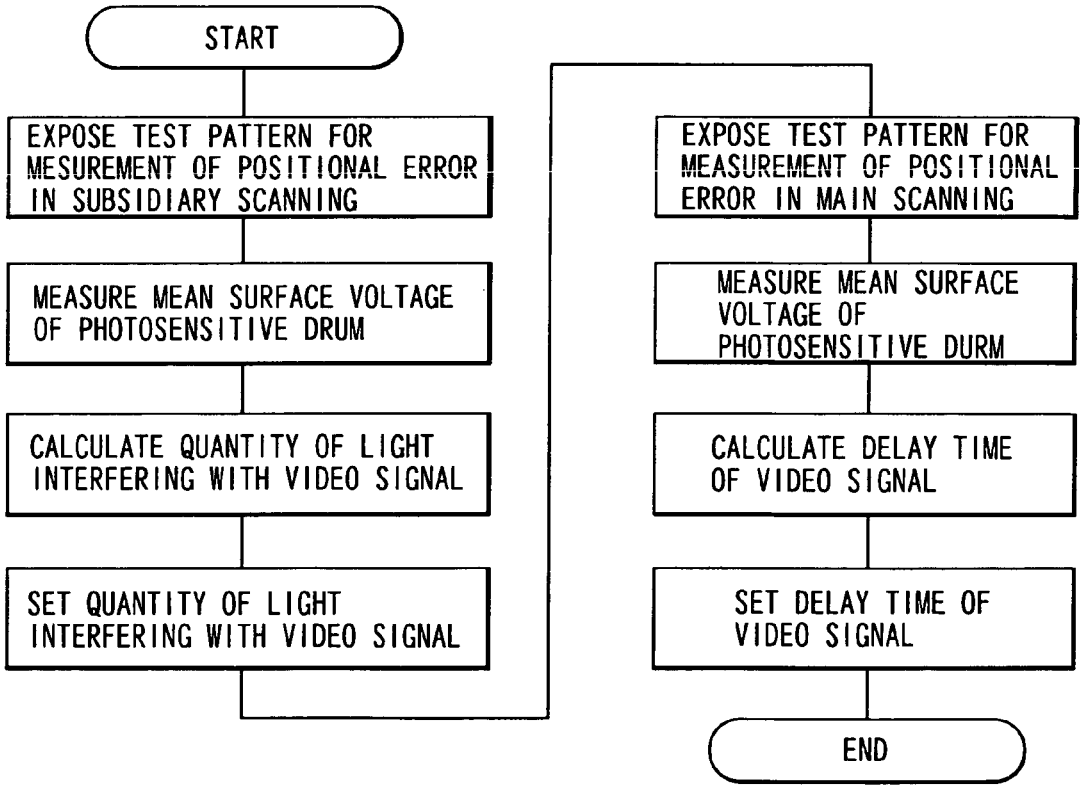
FIG. 9 is a flow diagram of a correcting procedure of a correcting circuit of an image recording device according to the present invention.

FIG. 9 shows a correction procedure of the present invention. This correction procedure starts when the image recording device is powered on or when a job starts. First, the exposure optical system 802 exposes a test pattern for measuring positional errors of adjoining beam spots in the subsidiary scanning direction spot by spot on the surface of the photosensitive drum 303.

Next, the surface potentiometer 803 measures the surface potential on the exposed photosensitive drum 303. Since the mean surface potential of beam spots, whose distance in the subsidiary scanning direction is narrow, is not equal to the mean surface potential of beam spots whose distance in the subsidiary scanning direction is wide, the positional error of beam spots in the subsidiary scanning direction can be calculated from the difference between the aforesaid mean surface potentials.

By adding a video signal to or subtracting it from the light quantity of an adjoining beam according to the result of calculation, the position of beam spots in the subsidiary scanning direction can be corrected.

The light quantity of a beam to be added or subtracted is termed the interference light quantity.

The exposure optical system 802 exposes a test pattern for measuring positional errors of adjoining beam spots in the main scanning direction spot by spot on the surface of the photosensitive drum 303. Next, the surface potentiometer 803 measures the surface potential on the exposed photosensitive drum 303.

In the same manner as described above, the difference between the aforesaid mean surface potentials is calculated to determine the positional errors of beam spots in the main scanning direction. By adding a video signal to or subtracting it from the light quantity of an adjoining beam according to the result of calculation, the position of beam spots in the main scanning direction can be corrected.

With these operations positional errors in the main and subsidiary scanning directions are eliminated and consequently high-quality high-resolution images can be obtained. In the following, details of each step of the procedure shown in FIG. 9 will be explained.

Figures 10, 11:
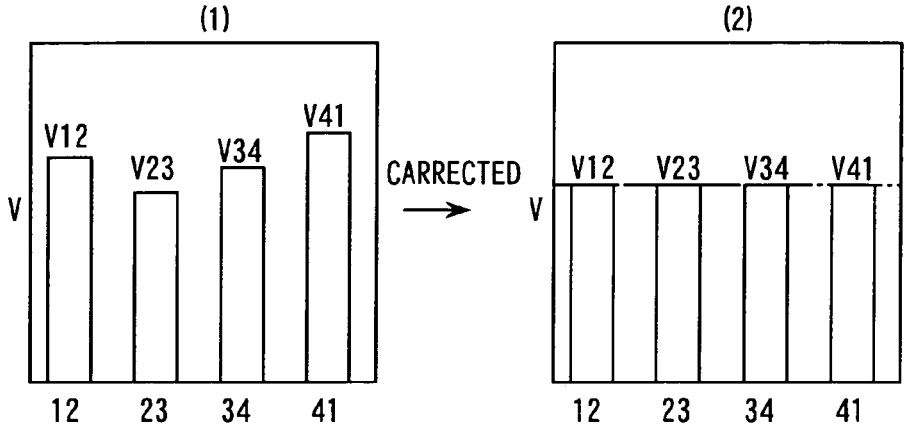
FIG. 10 is a table showing test patterns for measuring a positional error in the subsidiary scanning direction according to the present invention.
FIG. 11 is a diagram which shows the result of measurement of a positional error in the subsidiary scanning direction according to the present invention.

The second column of the table of FIG. 10 shows test patterns for measuring positional errors of beam spots in the subsidiary scanning direction. This embodiment uses a test pattern for measuring the distance between beam spots 1 and 2. To accomplish this, the exposure optical system 802 exposes beam spots 1 and 2 by video signals VD1 and VD2 (see FIG. 4) of "1" (black) and unexposes the other beam spots 3 and 4 by video signals VD3 and VD4 of "O" (white).

When this test pattern is recorded on a 1 cm-square area of the photosensitive drum surface, the surface potentiometer 803 (see FIG. 8) can measure the mean surface potentials of the patterns. The elliptical areas of test patterns (in the second column of the table of FIG. 10) are exposed areas and their surface potentials are low. Generally, the surface of the photosensitive drum 303 is uniformly charged to about −600 volts by the charger 801.

When the charged photosensitive drum is exposed to a laser beam, the potential of the exposed areas on the charged surface goes down. However the quantity of a voltage drop to the quantity of exposure is apt to be saturated and the quantity of exposure for beam spots is strong enough for saturation.

Therefore the elliptic areas of test patterns (in the second column of the table of FIG. 10) has a saturation potential (−50 volt for this embodiment) which is termed the residual potential. However, the surface potentiometer 803 does not have an ability to identify potential differences of scanning lines and takes the average of the potentials.

The first column of FIG. 10 shows different scanning line pitches: standard line pitch B of 42 $\mu$m, narrow line pitch A of 32 $\mu$m, and wide line pitch C of 53 $\mu$m. The third column of FIG. 10 shows their mean surface potentials measured by the surface potentiometer 803.

As seen from this table, the mean surface potential goes lower (that is, the absolute value of the negative potential increases) as the line pitch becomes smaller. This is dependent upon the ratio of the exposed area whose potential is reduced to −50 volts (elliptic area in FIG. 19) to the unexposed area whose potential remains at −600 volts.

The fourth column of the table in FIG. 10 shows the approximate ratios of the elliptical areas calculated from the test patterns shown in the second column of the table. As seen from these ratios, as the scanning line pitch goes narrower, the exposed area becomes smaller and the mean surface voltage remains low.

The mean surface voltages in the third column of the table are examples. Their magnitudes are dependent upon charging and exposing conditions. However, the relationship between scanning line pitches and mean surface potentials which are measured under an identical condition remains unchanged. In other words, scanning line pitches are always identical as far as mean surface potentials are identical. This characteristic can be used for correction of irregular scanning line pitches.

Although FIG. 10 shows test patterns for measuring the distance between beam spots 1 and 2 and the result of measurement of their surface potentials, similar test patterns can be used for each pair of the other beam spots (2 and 3, 3 and 4, and 4 and 1) and similar results of measurement of surface potentials can be obtained.

Example (1) of FIG. 11 shows the result of measurement of surface potentials V12, V23, V34, and V41 in the execution of test patterns for measuring the distance of each pair of beam spots (1 and 2, 2 and 3, 3 and 4, and 4 and 1) in the subsidiary scanning direction.

This example shows that the distance between beam spots 2 and 3 is wide and that between beam spots 4 and 1 is narrow. When a correction is made to make all these surface potentials V12, V23, V34, and V41 identical, as shown in Example (2) of FIG. 11, the scanning line distances become identical (42 μm). A correcting procedure will be explained below with reference to FIG. 1, FIG. 12 to FIG. 15, and FIG. 23.

Figure 12:
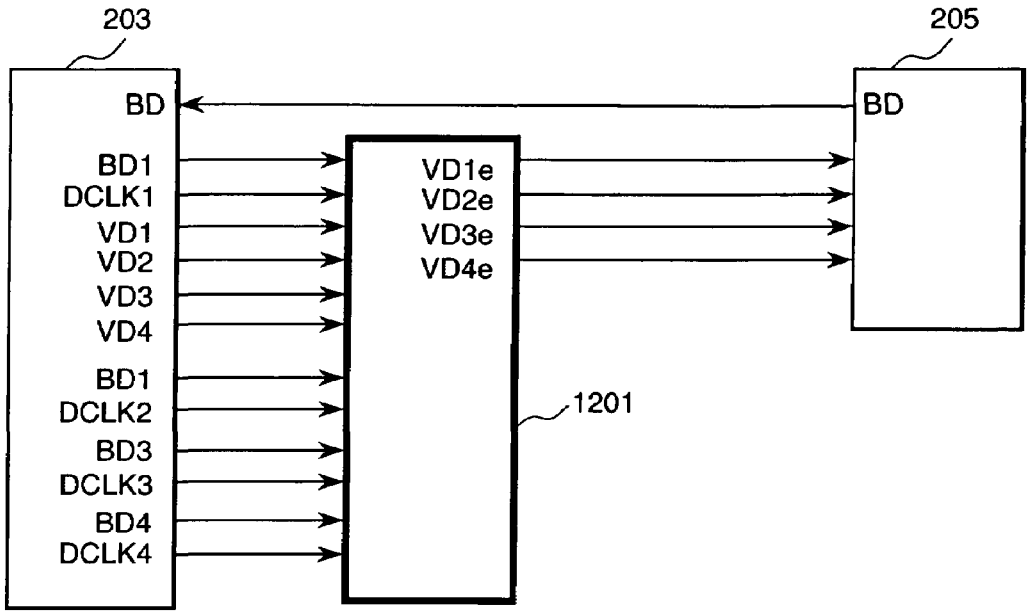
FIG. 12 is a block diagram of an embodiment of an image recording device system for measuring a positional error in the subsidiary scanning direction according to the present invention.

FIG. 12 shows the system configuration of an image recording device of the present invention. The printer controller 203 sends synchronization signals BD1, BD2, BD3, and BD4, pixel clocks DCLK1, DCLK2, DCLK3, and DCLK4, and video signals VD1, VD2, VD3, and VD4 corresponding to laser light sources 310 to the correction circuit 1201 of the present invention.

The correction circuit 1201 corrects the video signals VD1, VD2, VD3, and VD4 to produce corrected video signals VDe1, VDe2, VDe3, and VDe4 and outputs the corrected video signals to the engine 205. The correction circuit can be placed in the output part of the printer controller 203 or in the input part of the engine 205. These signals already have been explained with reference to FIG. 4 and FIG. 5. However, in the image recording device of the present invention, the video signals VD1, VD2, VD3, and VD4 are sent differently. They are explained in detail below.

Figure 23:
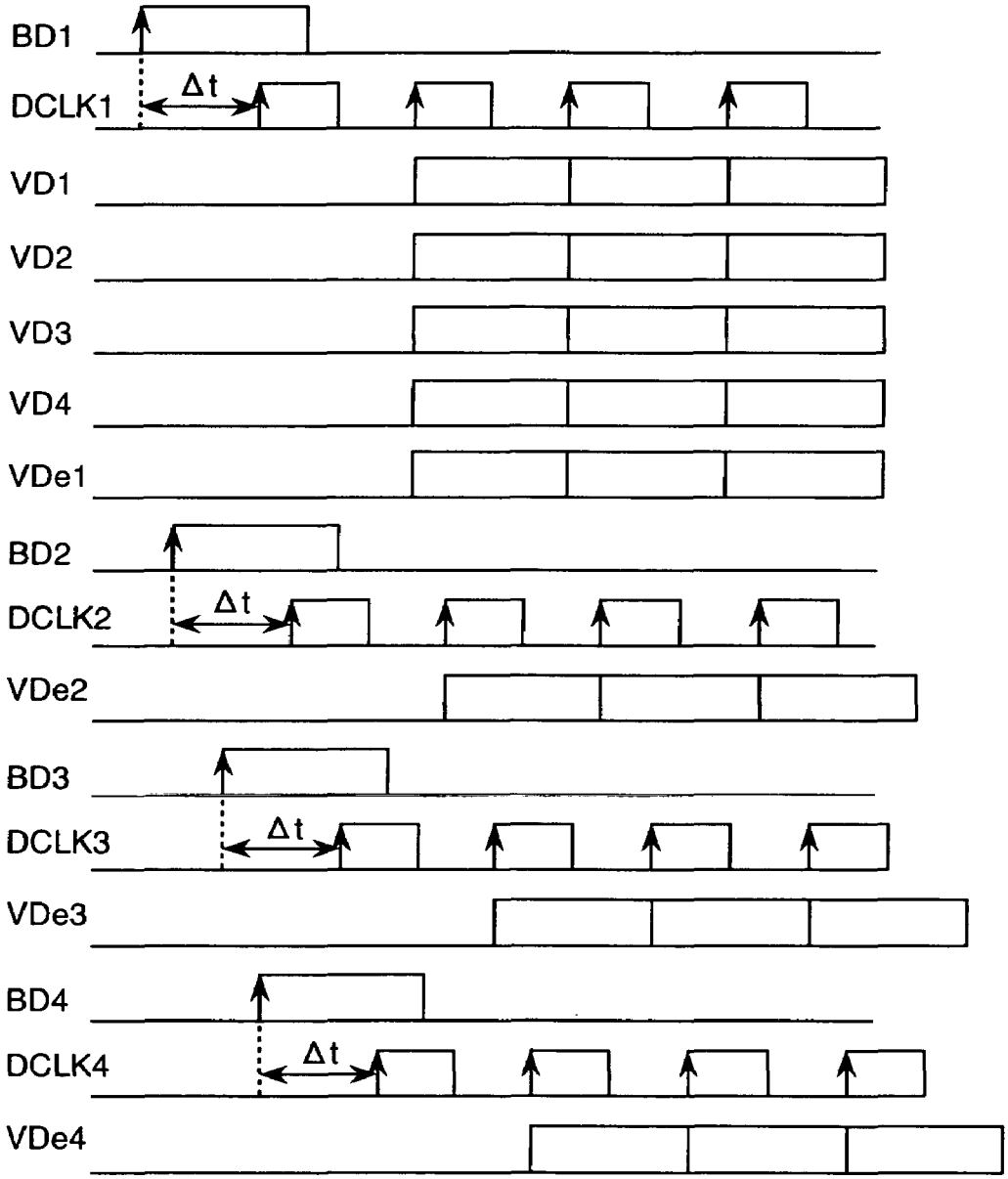
FIG. 23 is a waveform diagram of a synchronizing signal of a correction circuit according to the present invention.

FIG. 23 shows waveforms of synchronization signals according to the present invention. The main difference is that the video signals VD1, VD2, VD3, and VD4 are all sent in synchronism with the pixel clock DCLK1. The correction circuit 1201 modulates the video signals, generates new video signals VDe1, VDe2, VDe3, and VDe4 in synchronism with the respective pixel clocks DCLK1, DCLK2, DCLK3 and DCLK4, and supplies them respectively to the laser light sources 310 of the engine 205.

Figure 1:
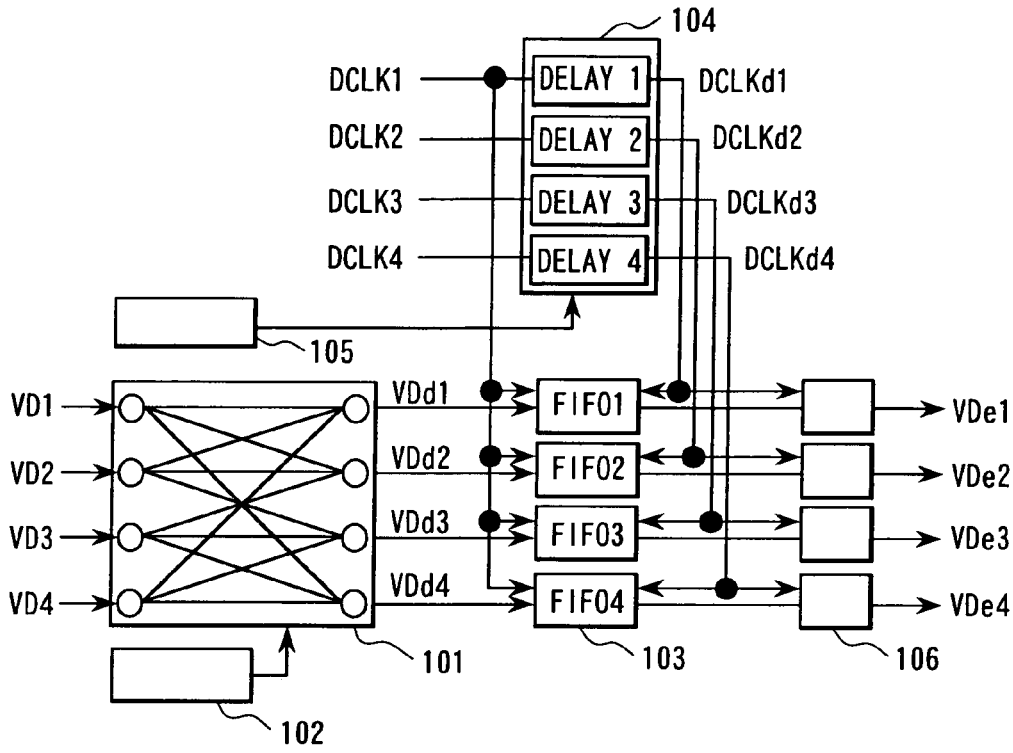
FIG. 1 is a block diagram showing an embodiment of a correction circuit of an image recording device according to the present invention.

The configuration of the correction circuit 1201 of the present invention is illustrated in FIG. 1. The video signals VD1, VD2, VD3, and VD4 from the printer controller 203 are fed to the interference circuit 101. The interference circuit 101 causes the signals to interfere with each other by a light-quantity component preset by a means 102 which determines the quantity of an interfering light of video signals and converts the signals respectively to VDd1, VDd2, VDd3, and VDd4. The signals VDd1, VDd2, VDd3, and VDd4 output from this circuit, for example, are 2-bit digital signals.

These signals are sent to the inputs of 2-bit FIFO (First-In First-Out) memory 103 and are written there in synchronism with the pixel clock DCLK1. On the other hand, pixel clocks DCLK1, DCLK2, DCLK3, and DCLK4 are sent from the printer controller 203 to the delay circuit 104. The delay circuit delays each pixel clock by a time period set by a means 105 which determines a delay time period for each pixel clock and outputs the resulting pixel clocks DCLKd1, DCLKd2, DCLKd3, and DCLKd4 to the outputs of a 2-bit FIFO (First-In First-Out) memory 103.

These pixel clocks are used to read signals VDd1, VDd2, VDd3, and VDd4. The signals VDd1, VDd2, VDd3, and VDd4 from FIFO memory 103 are fed to the pulse modulation circuit 106, modulated there into video signals VDe1, VDe2, VDe3, and VDe4, and output to the engine 205. The interference circuit 101 and FIFO memory 103 work to correct positions of beam spots in the subsidiary scanning direction and the delay circuit 104 and FIFO memory 103 work to correct positions of beam spots in the main scanning direction.

Figure 13:
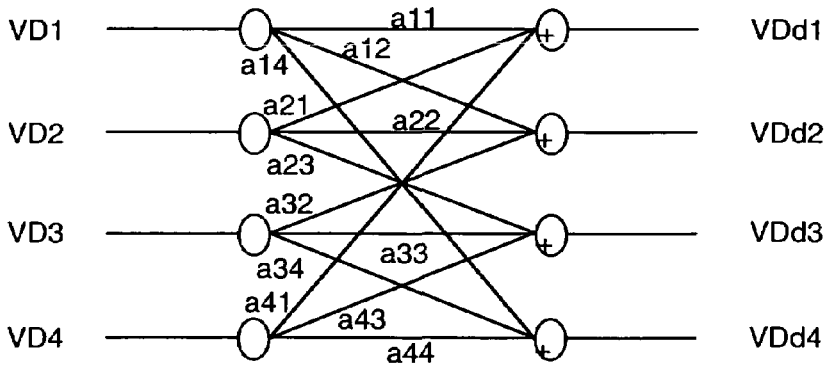
FIG. 13 is a diagram which shows an embodiment of an interference circuit of a correction circuit according to the present invention.

FIG. 13 is a diagram of the interference circuit 101. The interference circuit 101 generates signals VDd1, VDd2, VDd3, and VDd4 from video signals VD1, VD2, VD3, and VD4 and a 4×4 matrix A of actual coefficients which are set by a means 102 for determining the interference light quantity. A coefficient "aij" represents a component of a signal transferred from a signal VDi to a signal VDdj (where "i" and "j" are 1, 2, 3, or 4).

Substantially, in FIG. 13, a 4×1 signal vector (VDd1, VDd2, VDd3, and VDd4) is obtained by multiplying a 4×1 matrix having signals VD1, VD2, VD3, and VD4 as its components by the matrix A. Since non-diagonal components (other than "aii") of the matrix A work to interfere with the adjoining beam spots, this circuit is termed an interference circuit 101. This circuit can be an analog circuit, such as an amplifier or adder, or a digital circuit, such as a computing unit (CPU) and ROM.

Figure 15A:
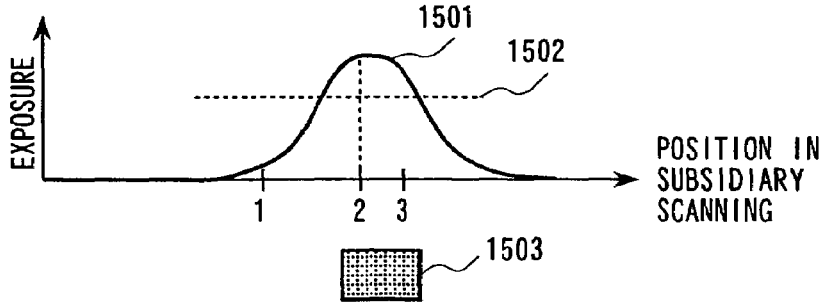
FIGS. 15(*a*) and 15(*b*) are diagrams showing the principle of correcting the scanning line pitch in the correction method according to the present invention.
Figure 15B:
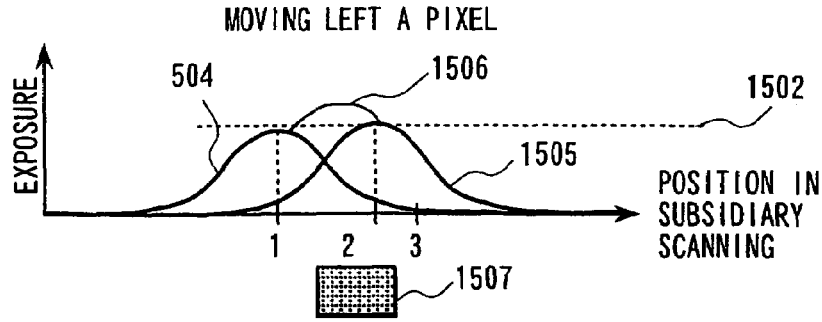

FIGS. 15(*a*) and 15(*b*) show a principle of correction for determining coefficients of the matrix A of FIG. 13. The X-axis of each graph represents the position of scanning lines 1, 2, and 3 made by beam spots 1, 2, and 3 in the subsidiary scanning direction. The Y-axis of each graph represents the quantity of exposure of a beam spot 2 on the surface of the photosensitive drum by the video signal VD2.

In FIGS. 15(*a*) and 15(*b*), the distance (pitch) between the scanning lines 1 and 2 is greater than the standard scanning line pitch and the distance (pitch) between the scanning lines 2 and 3 is smaller than the standard scanning line pitch.

FIG. 15(*a*) shows the distribution of light exposed in a conventional technique and the position of a pixel 1503 which is developed by the developer 804. Assuming that a position whose exposure quantity is over a preset threshold value 1502 (indicated by a dotted line) is developed by the developer 804, the position of a pixel 1503 to be developed necessarily moves toward the scanning line 3 as the exposure distribution part 1501 over the threshold level 1502 is developed.

To move the pixel made by the scanning line 2 left, the image recording device of the present invention adds one part of the component of the video signal VD2 for the scanning line 2 to the component of the video signal VD1 for the scanning line 1 and subtracts the component of the video signal VD2 for the scanning line 2.

In the matrix A of FIG. 13, a22 is 0.7 and a21 is 0.5. As a result, although the intensity distribution of a beam spot usually is a Gaussian distribution (normal distribution) as shown in FIG. 15(*b*), the exposure component 1504 of the scanning line 1 and the exposure component 1505 of the scanning line 2 are optically added to form a new exposure distribution 1506. Therefore, the new exposure distribution 1506 is above the threshold level 1502 and the position of the developed pixel 1507 according to present invention becomes optimum.

Figure 24:
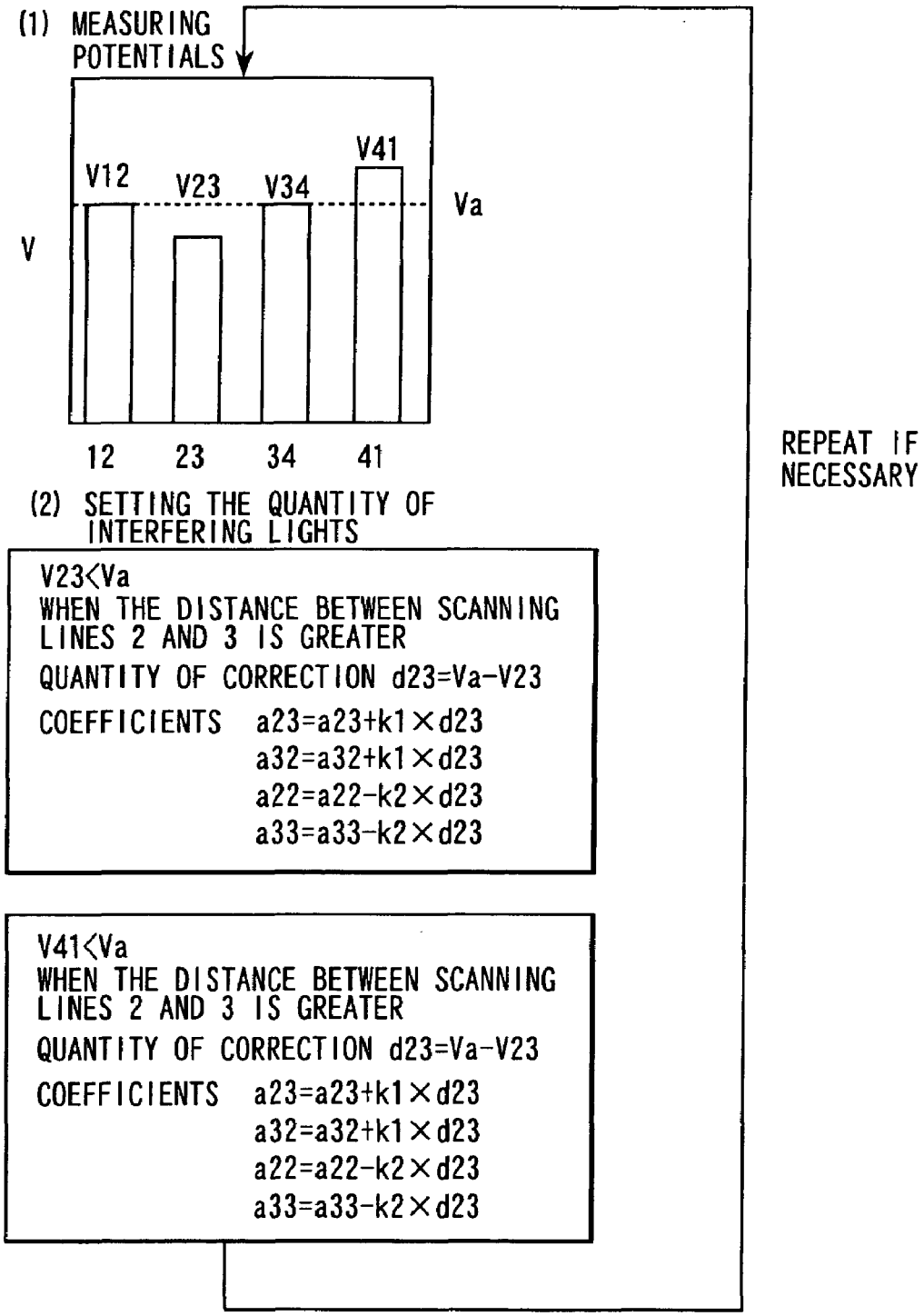
FIG. 24 is a flow diagram showing a means of setting the quantity of interference light of the correction circuit according to the present invention.

FIG. 24 shows an example of means 102 for determining the quantity of interference light. FIG. 24 at step (1) shows the result of potential measurement which is the same as FIG. 11 at example (1). The means 102 calculates the difference between each surface potential (V12, V23, V34, and V41) and the average Va(=(V12+V23+V34+V41)/4) and judges whether the distance between each pair of scanning lines is small or large. In this example, the distance between the scanning lines 2 and 3 is wide and the distance between the scanning lines 4 and 1 is narrow. The means 102 determines the quantity of interference light as shown in FIG. 24 at step (2).

First the means 102 corrects the distance between the scanning lines 2 and 3. This example assumes that the quantity of correction "d23" is Va−V23. The interference coefficients "a23" and "a32" are respectively obtained by adding the product of "k1 "by "d23", to the old coefficients "a23" and "a32." For the first correction, coefficients "a23" and "a32" are respectively 0. The interference coefficients "a22" and "a33" are respectively obtained by subtracting the product of "k2" by "d2" from the old coefficients "a22" and "a33".

For the first correction, it is assumed that coefficients "a22" and "a33" were respectively 1. Constants "k1" and "k2" are experimentally determined according to frequency of correction, stability, and so on. With this correction, the pixel to be developed by the video signal VD2 gets closer to the scanning line 3 from the scanning line 2 and the pixel to be developed by the video signal VD3 gets closer to the scanning line 2 from the scanning line 3. Thus, the distance between the scanning lines becomes smaller.

Next the means 102 corrects the distance between the scanning lines 4 and 1. This example assumes that the quantity of correction "d41" is V41−Va. The interference coefficients "a43" and "a12" are respectively obtained by adding the product of "k1" by "d41" to the old coefficients "a43" and "a12." For the first correction, coefficients "a43" and "a12" are respectively 0. The interference coefficients "a44" and "a11" are respectively obtained by subtracting the product of "k2" by "d41" from the old coefficients "a44" and "al 1." For the first correction, it is assumed that coefficients "a44" and "a11" were respectively 1.

Constants "k1" and "k2", are experimentally determined according to frequency of correction, stability, and so on. With this correction, the pixel to be developed by the video signal VD4 gets closer to the scanning line 3 from the scanning line 4 and the pixel to be developed by the video signal VD1 gets closer to the scanning line 2 from the scanning line 1. Thus, the distance between the scanning lines becomes greater.

Figure 14:
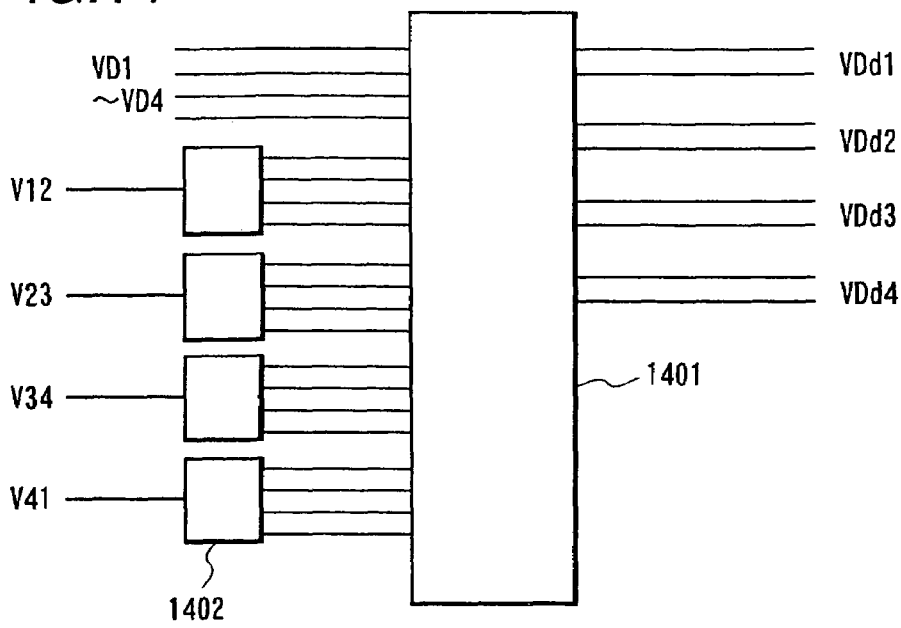
FIG. 14 is a block diagram of another embodiment of an interference circuit of a correction circuit according to the present invention.

FIG. 14 shows an example of an interference circuit 101 using ROM 1401. In the image recording device according to the present invention, after measurement of surface potentials, the resulting signals (V12, V23, V34, and V41) (illustrated in FIG. 11 (1)) are respectively converted into 4-bit signals by the analog-digital converters 1402 (A-D converters), are latched, and are fed to the address inputs of ROM 1401. ROM 1401 determines the coefficients of the matrix A.

ROM 1401 multiplies said 1-bit video signals VD1, VD2, VD3, and VD4 which are fed to the address inputs of the ROM by said matrix A and outputs the resulting 2-bit signals VDd1, VDd2, VDd3, and VDd4 as data. The ROM 1401 stores the results of calculations of all possible combinations of the signals (V12, V23, V34, and V41) and the video signals (VD1, VD2, VD3, and VD4) in advance.

The 2-bit signals VDd1, VDd2, VDd3, and VDd4 are fed to the 2-bit FIFO (First-In First-Out) memory 103 and are output with delays given by the pixel clocks DCLKd1, DCLKd2, DCLKd3, and DCLKd4.

The details of FIFO 103 will be explained later in the description of positional correction of beam spots in the main scanning direction. The signals VDd1, VDd2, VDd3, and VDd4 output from FIFO 103 are fed to the pulse modulation circuit 106 and are output from there as binary modulated video signals VDe1, VDe2, VDe3, and VDe4.

Figure 25:
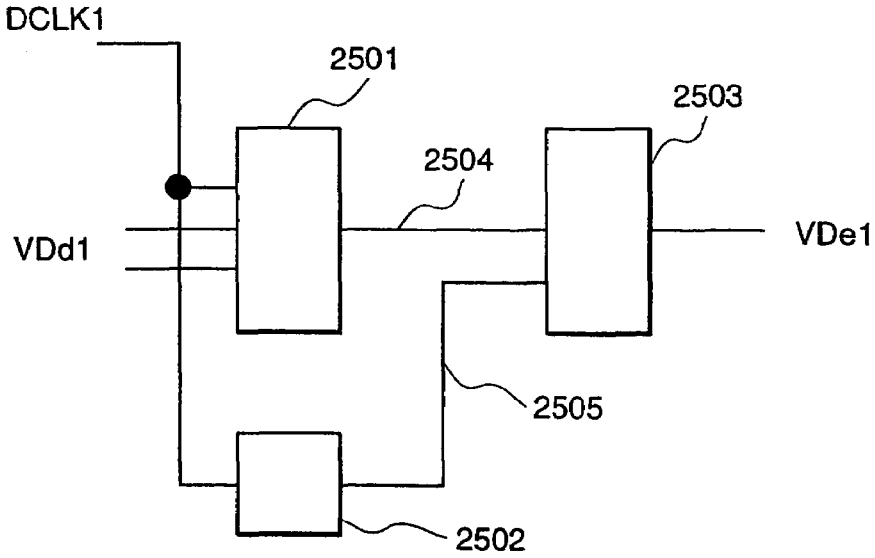
FIG. 25 is a block diagram of an embodiment of the pulse-width modulation circuit of the correction circuit according to the present invention.

FIG. 25 shows an example of a pulse modulation circuit 106 of the present invention. Signals VDd1, VDd2, VDd3, and VDd4 are fed to the digital-analog (D-A) converter 2501. The digital-analog (D-A) converter 2501 latches these signals in response to the pixel clock DCLK1 and converts them into analog signals 2504. When receiving the pixel clock DCLK1, the saw-tooth generator 2502 increases the output voltage linearly to form a saw-tooth wave 2505 until the next pixel clock DCLK1 comes.

The comparator 2503 compares the saw-tooth wave 2505 with the analog signal 2504. The comparator 2503 outputs a binary signal VDe1 of" 1" when the analog signal 2504 is greater than the saw-tooth wave 2505 or a binary signal VDe1 of "0" when the analog signal 2504 is not greater than the saw-tooth wave 2505.

Figure 26:
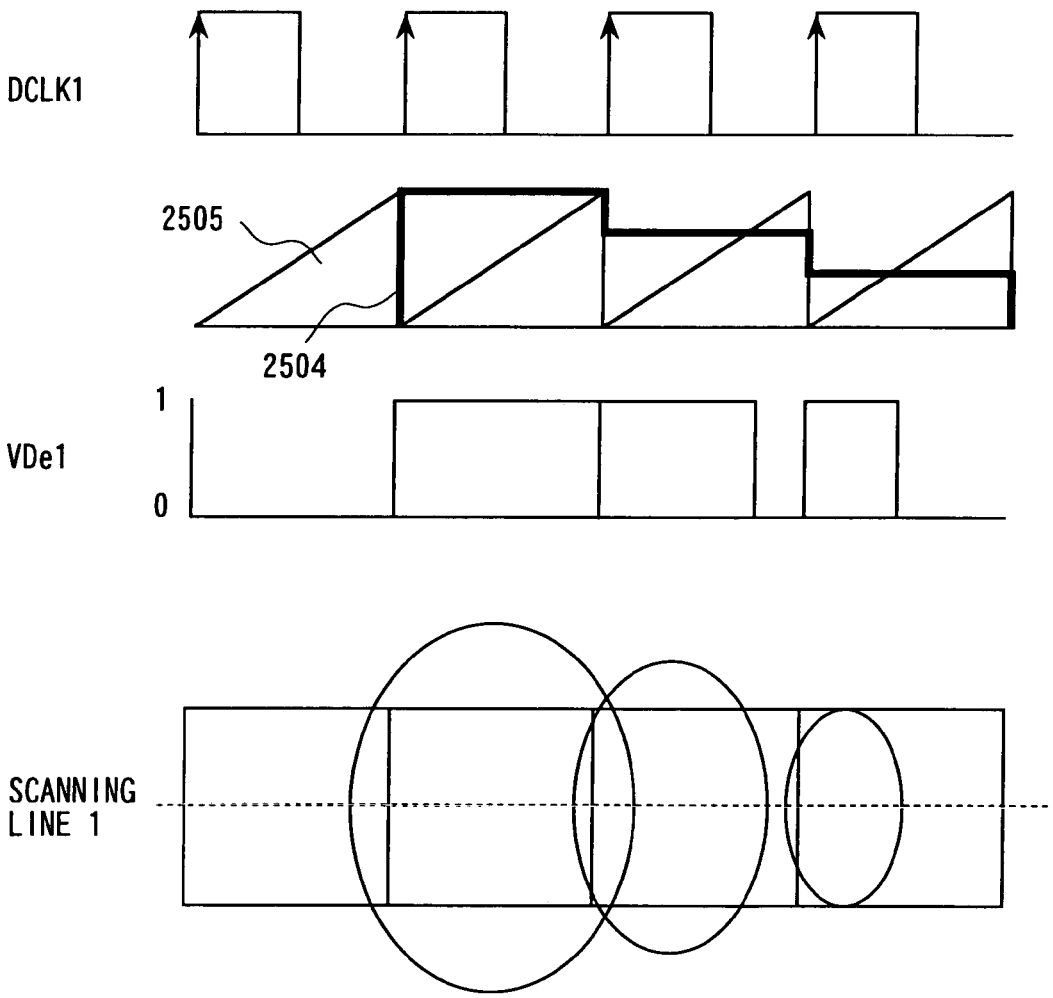
FIGS. 26(*a*) and 26(*b*) are diagrams which show the result of operation of the pulse-width modulation circuit of FIG. 25.

FIG. 26(*a*) shows the result of modulation by said pulse modulation circuit 106. It shows a pixel clock DCLK1, an analog signal 2504, a saw-tooth wave 2505, and a signal VDe1, and FIG. 26(*a*) shows pixels which are developed actually. In this example, one pulse is generated between two consecutive pixel clocks DCLK1 and its width is modulated.

This is effective when the response of the laser light sources 310 is not enough. If the response of the laser light sources 310 is high enough, it is possible to generate two or more pulses and modulate their widths. In such a case, horizontal lines can be recorded smoothly. When the laser light source 310 can input analog signals, the analog signal 2504 can be directly output as VDe1.

In this way, the image recording device according to the present invention can form high-quality high-resolution images without any irregularity of scanning line pitches (without positional errors of beam spots 1, 2, 3, and 4 in the subsidiary scanning direction).

After correcting the positional errors of beam spots in the subsidiary scanning direction, the image recording device of the present invention corrects the positional errors of beam spots in the main scanning direction.

The image recording device of the present invention exposes the test pattern for measuring the positional errors in the main scanning direction spot by spot on the photosensitive drum 303.

Figures 16, 17:
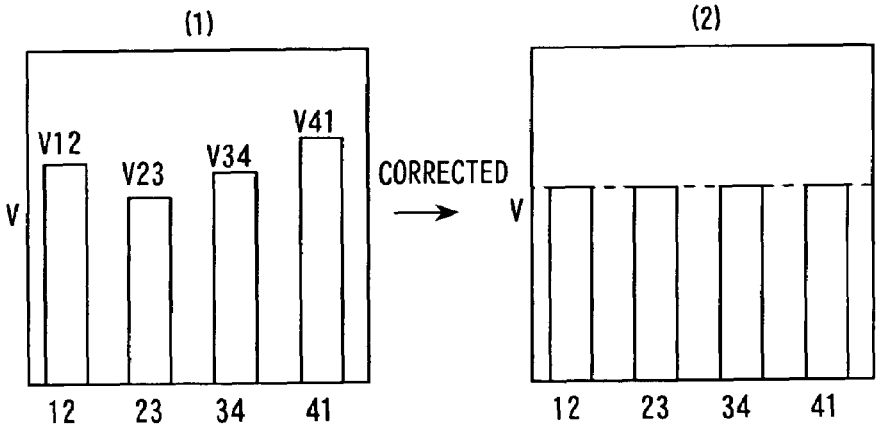
FIG. 16 is a table showing test patterns for measuring a positional error in the main scanning direction according to the present invention.
FIG. 17 is a diagram which shows the result of measurement of a positional error in the main scanning direction according to the present invention.

The second column of the table of FIG. 16 shows test patterns for measuring positional errors of beam spots in the main scanning direction. This embodiment uses a test pattern for measuring the distance between beam spots 1 and 2. To accomplish this, the exposure optical system 802 exposes beam spots 1 by repeatedly applying a video signal VD1 of "1000" ("1" for black and "0" for white), beam spots 2 by repeatedly applying a video signal VD2 of "0100," and unexposes the other beam spots 3 and 4 by repeatedly applying video signals VD3 and VD4 of "0000".

When this test pattern is recorded on a 1 cm-square area of the photosensitive drum surface, the surface potentiometer 803 (see FIG. 8) can measure the mean surface potentials of the patterns. The elliptical areas of test patterns (in the second column of the table of FIG. 16) are exposed areas and their surface potentials are low. Generally, the surface of the photosensitive drum 303 is uniformly charged to about −600 volts by the charger 801. When the charged photosensitive drum is exposed to a laser beam, the potential of the exposed areas on the charged surface goes down. However, the quantity of a voltage drop to the quantity of exposure is apt to be saturated and the quantity of exposure for beam spots is strong enough for saturation.

Therefore, the elliptic areas of test patterns (in the second column of the table of FIG. 16) are at a saturation potential (−50 volt for this embodiment) which is termed a residual potential. However, the surface potentiometer 803 does not have an ability to identify potential differences of scanning lines and takes the average of the potentials.

The first column of FIG. 16 shows changes of scanning line pitches: optimum line position B without any deviation, left-deviated line position A (by 20 μm) and right-deviated line position B (by 20 μm). The third column of FIG. 16 shows their mean surface potentials measured by the surface potentiometer 803. As seen from FIG. 16, the mean surface potential negatively increases as the beam spot 2 moves left away from the beam spot 1.

This is dependent upon the ratio of the exposed area whose potential is reduced to −50 volts (elliptical area in the second column of FIG. 16) to the unexposed area whose potential remains at −600 volts. The fourth column of the table in FIG. 16 shows the approximate ratios of the elliptical areas calculated from the test patterns given in the second column of the table. As seen from these ratios, as the beam spot 2 moves left away from beam spot 1, the exposed area becomes smaller and the mean surface voltage will not go low.

The mean surface voltages in the third column of the table of FIG. 16 are examples. Their magnitudes are dependent upon charging and exposing conditions. However, the relationship of the distances between beam spots 2 and 1 in the main scanning direction and mean surface potentials which are measured under an identical condition remains unchanged.

In other words, the distances between beam spots 2 and 1 in the main scanning direction are always identical so long as the mean surface potentials are identical. This characteristic can be used for correction of deviations of beam spot in the main scanning direction.

Although FIG. 16 shows test patterns for measuring the relative distance between beam spots 1 and 2 in the main scanning direction and the result of measurement of their surface potentials, similar test patterns can be used for each pair of the other beam spots (2 and 3, 3 and 4, and 4 and 1) and similar results of measurement of surface potentials can be obtained.

FIG. 17 at example (1) shows the surface potentials V12, V23, V34, and V41 measured in the execution of a test pattern for measuring relative distances between beam spots 1 and 2, 2 and 3, 3 and 4, and 4 and 1 in the main scanning direction. This result shows that the relative distance between beam spots 2 and 3 is great and that the relative distance between beam spots 4 and 1 is short.

When a correction is made to make all these surface potentials V12, V23, V34, and V41 identical as shown in Example (2) of FIG. 17, all relative distances of beam spots become equal to the standard width (42 μm) of one pixel. In other words, all beam spots are not deviated in the main scanning direction. Such a correcting procedure will be explained below.

Figure 27:
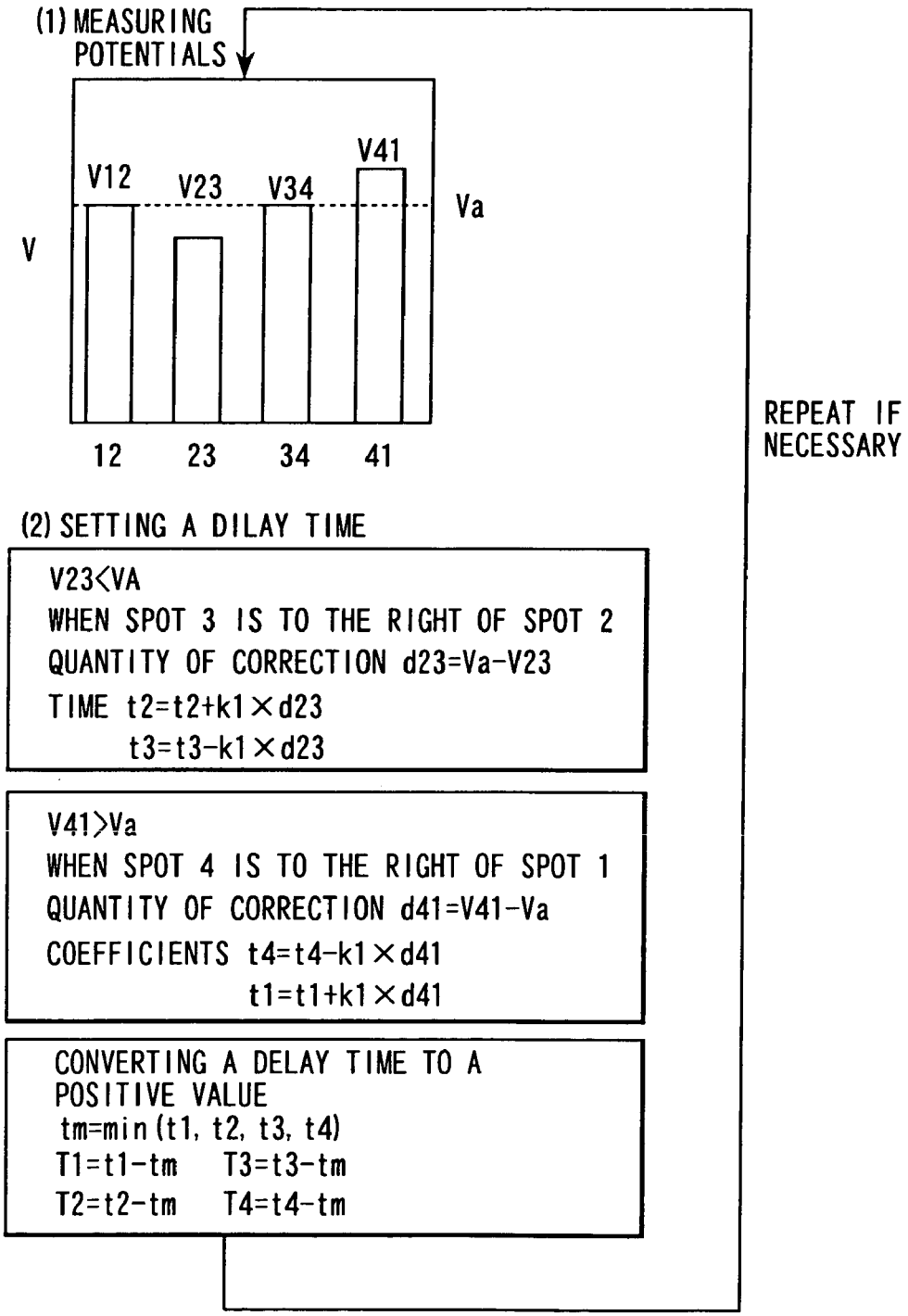
FIG. 27 is a flow diagram showing a means of setting a delay time of the correction circuit according to the present invention.

FIG. 27 shows an example of means 105 for determining delay time periods according to the present invention. FIG. 27 at step (1) shows the result of potential measurement which is the same as shown in FIG. 17. The means 105 calculates the difference between each surface potential (V12, V23, V34, and V41) and the average Va (=(V12+V23+V34+V41)/4) and judges whether the relative distance between each pair of beam spots is small or large in the main scanning direction.

In this example, as the surface potential V23 is lower than the average voltage Va, the beam spot 3 is moved right away from the beam spot 2. Similarly, as the surface potential V41 is higher than the average voltage Va, the beam spot 1 is moved left away from the beam spot 4. For correction of these deviations, the means 105 determines delay time periods as shown in FIG. 27 at step (2).

First the means 105 corrects the positional relationship between beam spots 2 and 3 in the main scanning direction. This example assumes that the quantity of correction "d23" is Va−V23. The delay time periods "t2" and "t3" are respectively obtained by adding the product of "k1" by "d23" to the old delay time period "t2" and subtracting the product from "t3."

For the first correction, delay time periods "t2" and "t3" are respectively 0. The correction constant "k1" is experimentally determined according to frequency of correction, stability, and so on. This correction eliminates the unwanted distance between a pixel developed by the video signal VD2 and a pixel developed by the video signal VD3 in the main scanning direction.

Next the means 105 corrects the positional relationship between beam spots 2 and 3 in the main scanning direction. This example assumes that the quantity of correction "d41" is V41−Va. The delay time periods "t4" and "t1" are respectively obtained by subtracting the product of "k1" by "d41" from the old delay time period "t4" and adding the product to "t1." For the first correction, delay time periods "t4" and "t1" are respectively 0.

The correction constant "k1" is experimentally determined according to frequency of correction, stability, and so on. This correction eliminates the unwanted distance between a pixel developed by the video signal VD4 and a pixel developed by the video signal VD1 in the main scanning direction.

Then, the means 105 makes the delay time periods positive. As actual delay elements cannot generate negative delay time periods, the means 105 performs a simple operation to make them positive. The means 105 subtracts the minimum delay time period "tm" from each of said delay time periods "t1," "t2," "t3," and "t4." The resulting differences "T1," "T2," "T3," and "T4" are positive values.

For actual delay elements, the minimum delay times usually are greater than 0. In this case, the delay time periods "T1," "T2," "T3," and "T4" can be made greater by making "tm" smaller. Although the whole image moves by a time period "tm" along the main scanning direction in this operation, this deviation usually is one pixel or less and can be ignored unless the image is corrected during recording.

The resolution in this embodiment of the present invention is 600 dots per inch (dpi) and 1 pixel is 42 μm. The pixels are scanned at a rate of 50 nsec. The delay time periods "T1=28," "T2=28," "T3=8," and "T4=8" are set for the result of measurement shown in FIG. 17 for correction. With these delays, the position of the beam spots 1 and 2 are corrected by about 17 μm in the main scanning direction.

Figure 18:
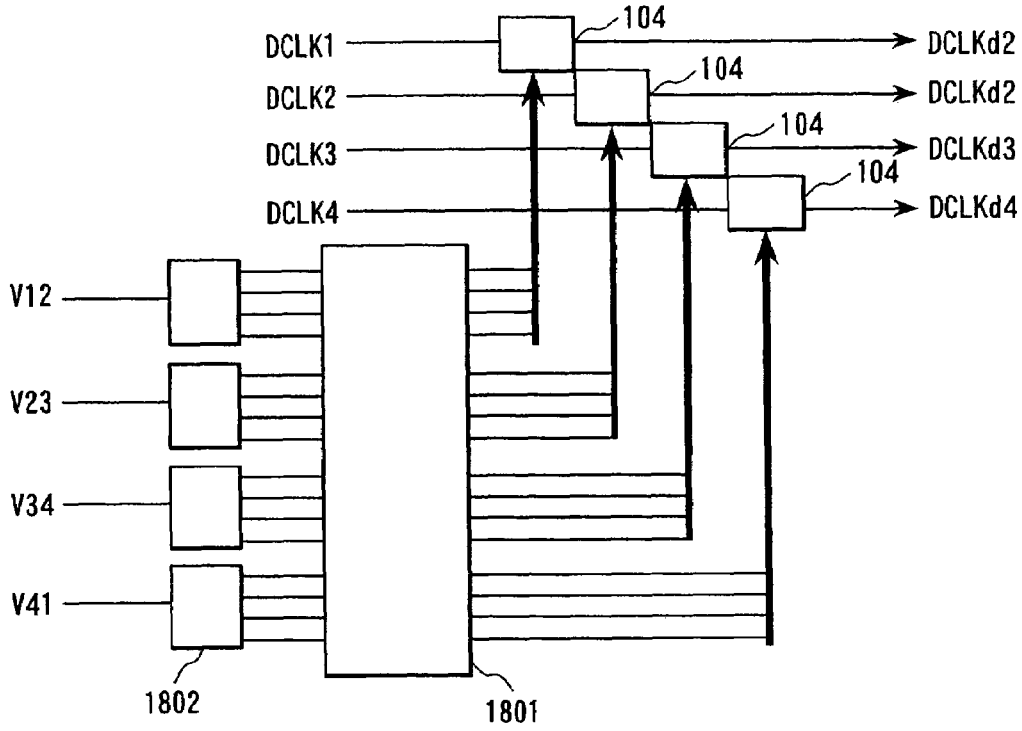
FIG. 18 is a block diagram of an embodiment of a delay circuit of a correction circuit according to the present invention.

FIG. 18 shows an example of a means 105 which uses ROM 1801 to determine delay time periods and delay circuits 104. After measurement of surface potentials, the resulting signals (V12, V23, V34, and V41) (illustrated in FIG. 11) are respectively converted into 4-bit signals by the analog-digital converters 1802 (A-D converters), are latched, and are fed to the address inputs of ROM 1801.

ROM 1801 determines the delay time periods "T1," "T2," "T3," and "T4" by said calculation and outputs them as 4-bit signals respectively to the delay circuits 104. The ROM 1401 stores the results of calculations of all possible combinations of the signals (V12, V23, V34, and V41) in advance. The means 105 for determining delay time periods consists of delay lines with 16 normal taps and a selector for selecting one of 16 delay signals output from the taps by 4-bit delay time signals "T1," "T2," "T3," and "T4."

This embodiment uses delay circuits 104, each of which can select 8, 12, 16, 20, . . . , 68 nsec. With these, the pixel clocks DCLK1, DCLK2, DCLK3, and DCLK4 are delayed respectively by "T1," "T2," "T3," and "T4" into DCLKd1, DCLKd2, DCLKd3, and DCLKd4. The resulting pixel clocks control the output of FIFO 103.

Figure 28:
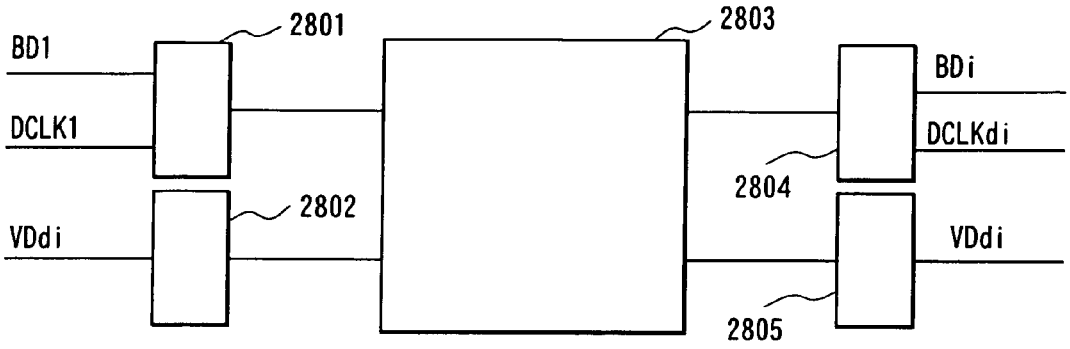
FIG. 28 is a block diagram of a FIFO register of the correction circuit according to the present invention.

FIG. 28 shows an example of the FIFO 103 used by the present invention. The write address counter 2801 is cleared to zero by a synchronization signal BD1 and is incremented by a pixel clock DCLK1. The video signal VDdi (i=1, 2, 3, and 4) which is fed in synchronism with the pixel clock DCLK1 is stored in the temporary buffer 2802, and then is written at an address pointed to by the write address counter 2801 of memory 2803.

On the other hand, the read address counter 2804 is cleared to zero by a synchronization signal BDi and is incremented by a pixel clock DCLKdi. As a result, the video signal VDdi which has been stored in the address pointed to by the read address counter 2804 in memory 2803 is set in the temporary output buffer 2805 and is output from there in synchronism with the pixel clock DCLKdi.

In FIFO 103, the write pixel clock DCLK1 and the read pixel clock DCLKdi work completely independently. Therefore, after FIFO 103, the video signals VDe1, VDe2, VDe3, and VDe4 that were in synchronism with the pixel clock DCLKI are in synchronism with the pixel clocks DCLKd1, DCLKd2, DCLKd3, and DCLKd4 for each beam spot whose positional error in the main scanning direction is corrected.

When printed by the engine 205, the recorded image is a high-quality and high-resolution image without jitters caused by positional errors of beam spots in the main scanning direction.

The aforesaid explanation does not include any influence by face tilting of the rotary polygon mirror 302. Although the aforesaid control can average the influences of scanning faces and the image quality can be increased, it is also possible to make the control more accurately by controlling the scanning faces individually as this control can be done in real time. Substantially the same circuit configuration as FIG. 14 is used and the same operation is repeated as many times as the number of scanning faces. This technique requires less hardware load, but its controlling accuracy is low.

Figure 30:
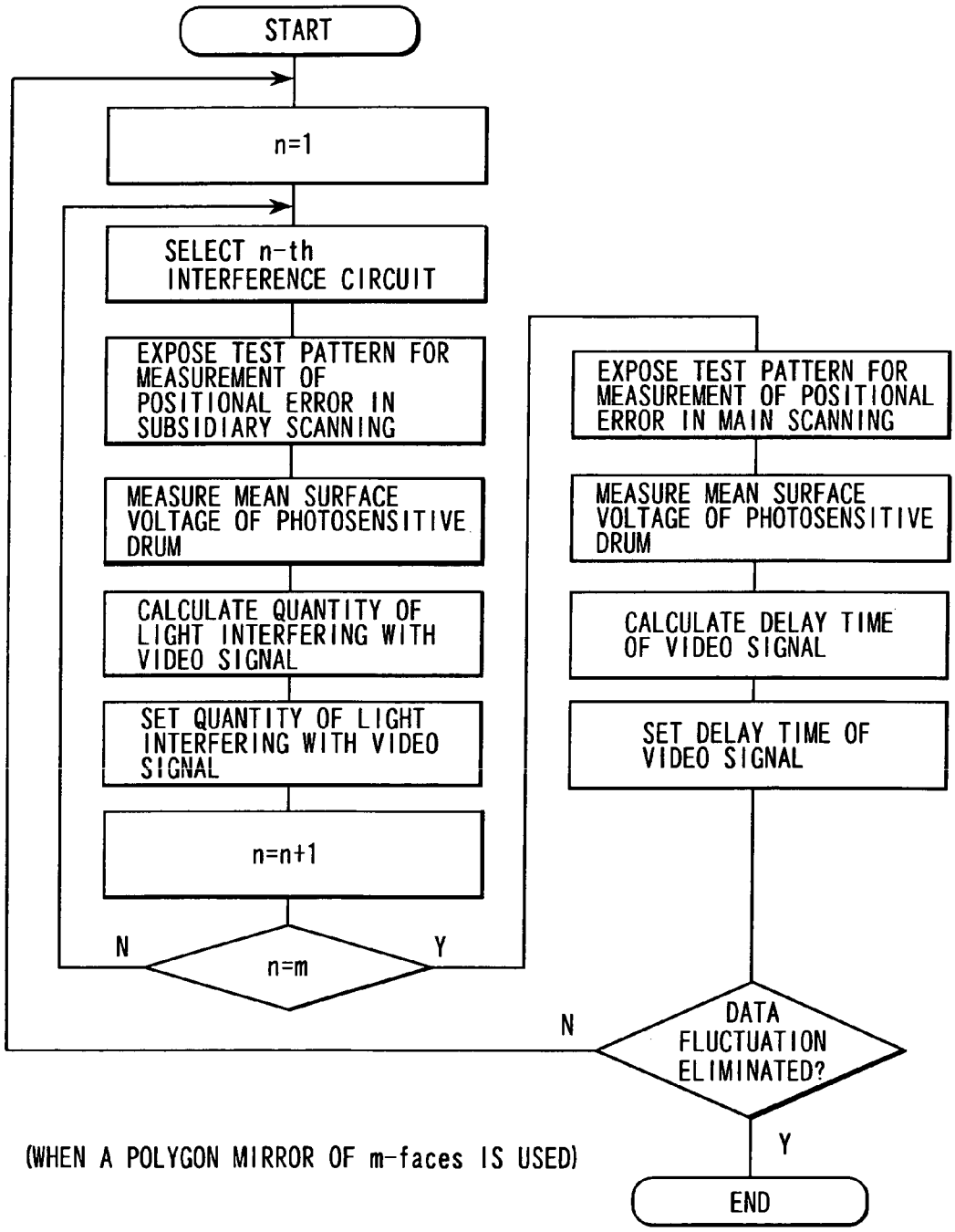
FIG. 30 is a flow diagram of the correcting procedure of the correction circuit according to the present invention.

In actual practice, the same number of interference circuits 101 as there are scanning faces are provided and control is switched for each face. This repetitive control can effectively reduce influences by the circumferential dispersion or flaws on the photosensitive drum which cannot be removed by a single controlling operation, using data of each face which has been stored in advance. This control sequence, which is illustrated in FIG. 30, can eliminate the irregularity of scanning pitches of laser beams on each face.

Now we must consider that scanning lines may be deviated on scanning faces because of face tilting, although the scanning pitches of beams are well controlled on a single face. For example, let's assume that the rotary polygon mirror has four faces for purpose of simplicity. In this example, we can easily recognize that the same test patterns and control circuits can be used to determine the quantity of correction by handling four beams (on one face) as one unit and by replacing the above-explained beams by a scanning face.

Figure 31:
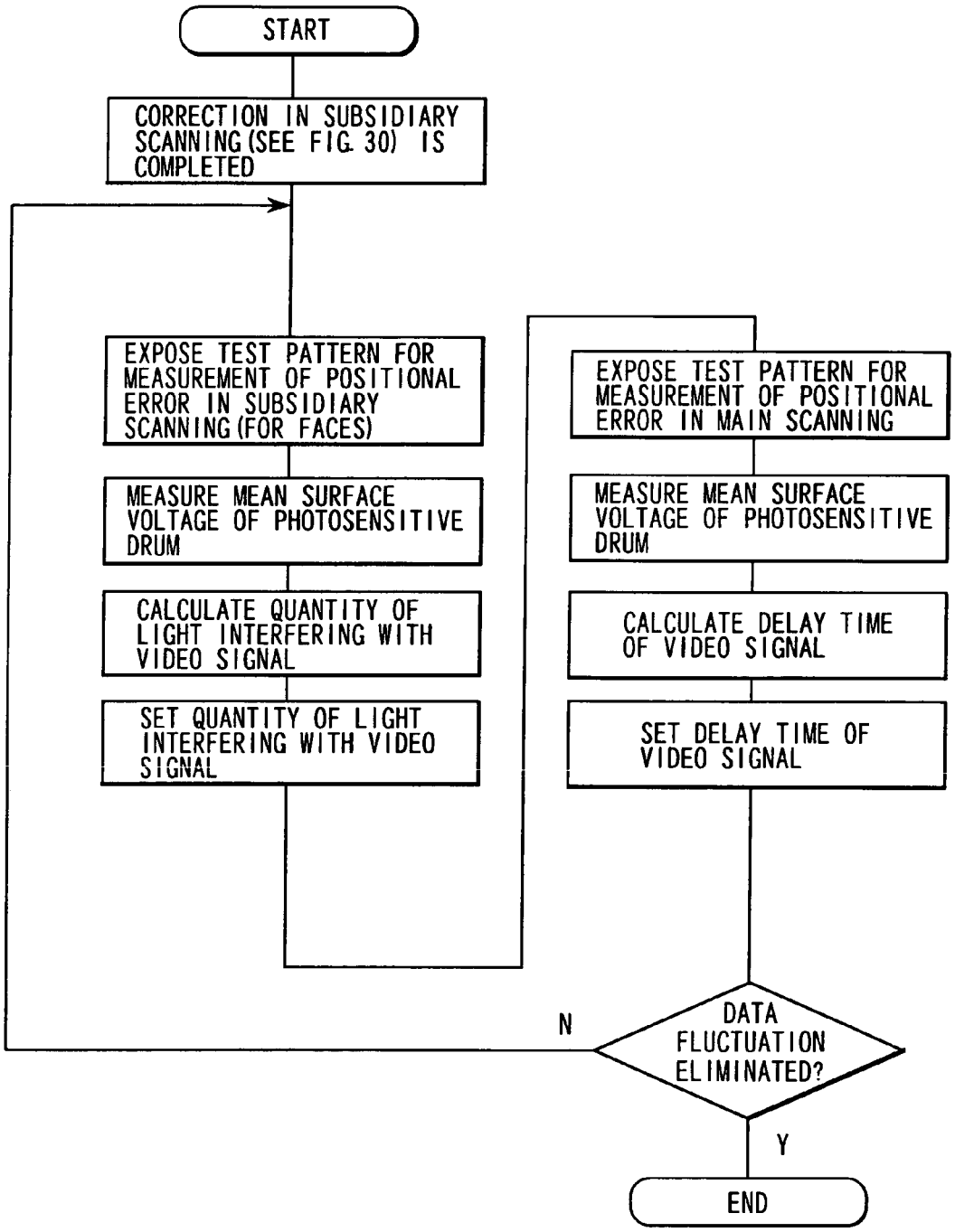
FIG. 31 is a flow diagram of the correcting procedure of the correction circuit according to the present invention.

One embodiment of the control sequence is illustrated in FIG. 31. First, control is effected for a single scanning face, and then is applied to other scanning faces. In the aforesaid explanation, we have discussed the irregularity in the gray level as an item to be controlled.

However, the present and advanced control will be more complicated and higher accuracy of control is required because it contains low-frequency components which are sensitive to visual characteristics of persons (the number of beams by the number of scanning faces or the number of beams by the number of scanning faces by a dithering pattern pitch (when considering a dithering pattern pitch)).

With this, the correcting procedure of the present invention is completed. Now, it is possible to produce high-quality and high-resolution images without any positional error of beam spots in main and subsidiary scanning directions.

This correcting procedure first performs correction of positional errors in the subsidiary scanning direction and then correction of positional errors in the main scanning direction. However, this order cannot be reversed because the test pattern for measuring positional errors in the main scanning direction is not available if there exists a positional error in the subsidiary scanning direction, although the test pattern for measuring positional errors in the subsidiary scanning direction is available even when there exists a positional error in the main scanning direction. Only one correcting procedure is enough, but it is recommended to repeat this correcting procedure a number of times for higher accuracy.

For example, it is desirable to print out some pages after correction, then repeat this correcting procedure once more. It is possible to also correct positional errors due to environmental changes, etc. Further, this correcting procedure simply measures potentials of exposed surfaces on the photosensitive drum and requires no recording medium, such as toner and paper, because images need not be developed and transferred. Further the engine 205 need not be modified, because surface potentiometers are found in almost all conventional image recording devices.

With this, the explanation of control-related features has been completed. Next, items on optical system hardware to support the aforesaid control will be considered.

Figure 32:
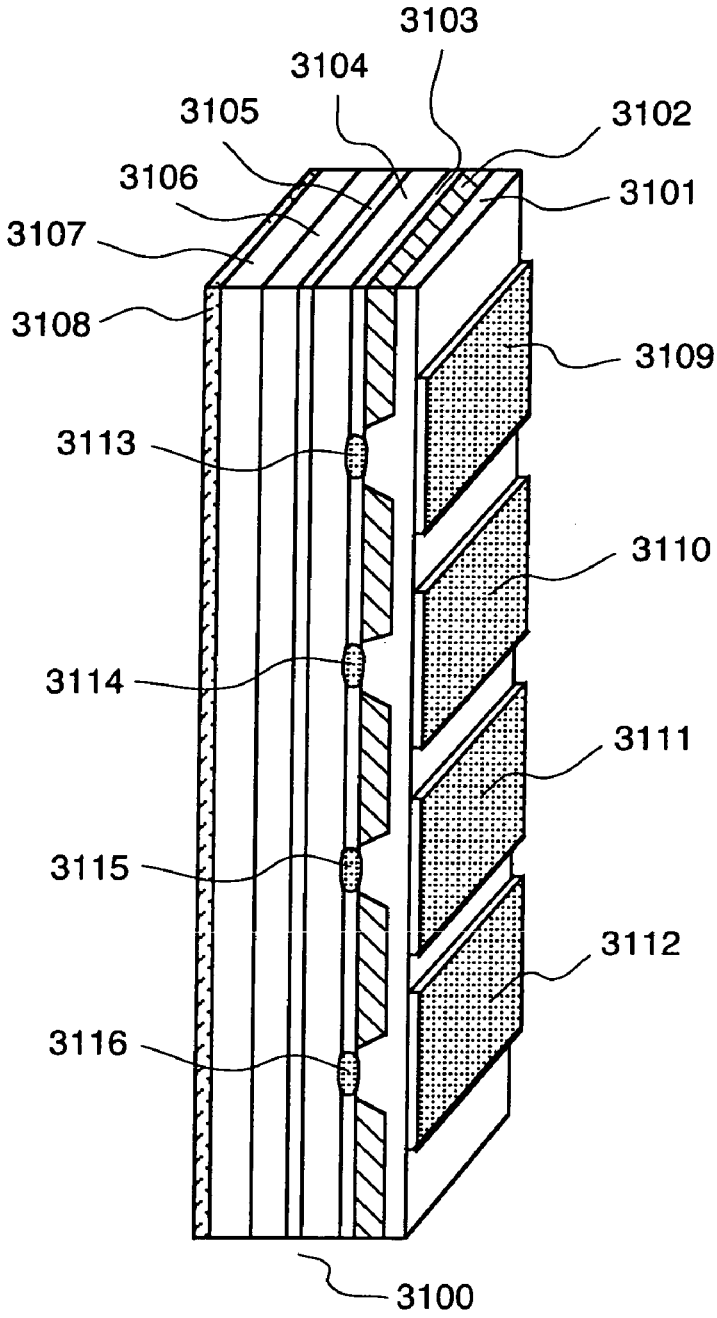
FIG. 32 is a perspective view of a section of a laser array according to the present invention.

As for light sources, semiconductor laser arrays are preferred judging from their easy installation, compactness, and easy control. FIG. 32 shows the structure of an example of a section of a laser array. This is a typical laser array and so a detailed explanation thereof is omitted. The emitting powers of laser beams are controlled by currents fed from the p-electrodes 3109 to 3112. In this case, the laser light source must be disposed to satisfy the optical magnification (the ratio of the diameter of a beam spot on the surface of the photosensitive drum to the diameter of the light emitting point of the laser array). A usual semiconductor laser array has light emitting points 3113 to 3116 of 5 $\mu$m size equally spaced at intervals of 100 $\mu$m.

When the semiconductor laser array is designed to form beam spots of about 50 $\mu$m on the surface of the photosensitive drum 303, the light-emitting points of the laser array must be spaced at intervals of about 1 mm considering the optical magnification, fan-out angle of the beam emission. The subsidiary scanning pitch of 1 mm is too large, although there is a skip-scanning technique. Therefore, the semiconductor laser array is tilted about 90 degrees as shown in FIG. 33(*a*) and arranged so that the scanning line pitch of a preset value may be made on the photosensitive drum.

Figure 33:
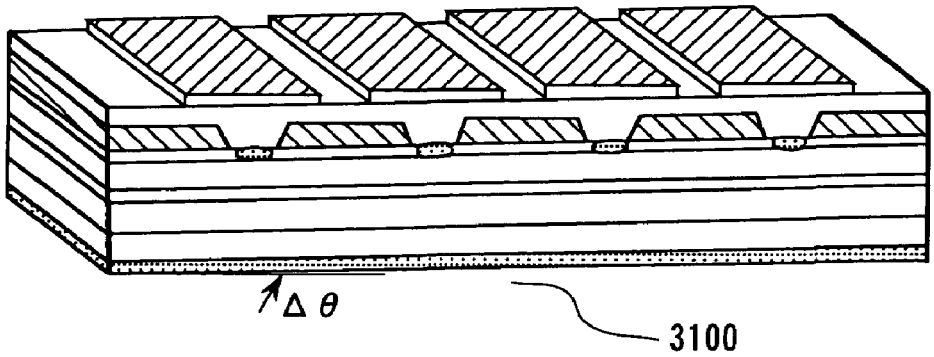
FIG. 33(*a*) is a perspective view of the configuration of the laser array of FIG. 32, and FIG. 33(*b*) is a diagram of beam scanning by the laser array.
Figure 33:
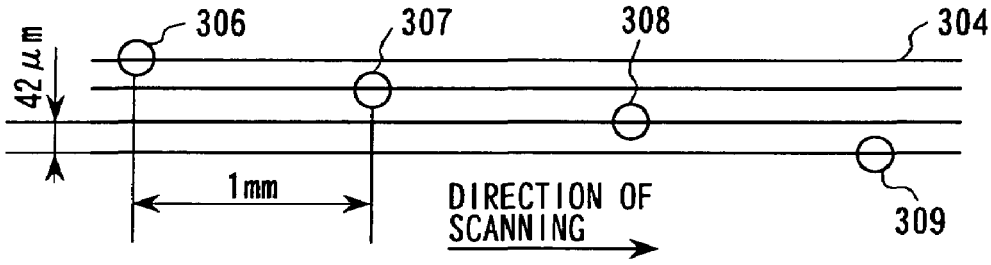

FIG. 33(*b*) shows a scanning example of 600 dpi in which the scanning lines are spaced at intervals of 42 $\mu$m. In this example, positional errors of beam spots may be generated, but they can be eliminated by setting offset times of 1 mm, 2 mm, and 3 mm by the delay circuits 104 in FIG. 1. The greatest merit of this configuration is that the structural dispersion of beams in the subsidiary scanning direction can be reduced greatly.

In other words, the pitch irregularity $\delta$ of beams in the subsidiary scanning direction (using a semiconductor laser array shown in FIG. 32) can be greatly reduced at a rate of $\delta \tan \theta$ and consequently, the laser arrays can be produced with less manufacturing load.

When said semiconductor laser array is used in combination with the particular control called for by the present invention, higher control can be accomplished. When this control is considered differently, the feedback control using by test patterns according to this example can be used for initial fine control and further provides for easier adjustment.

Figure 34:
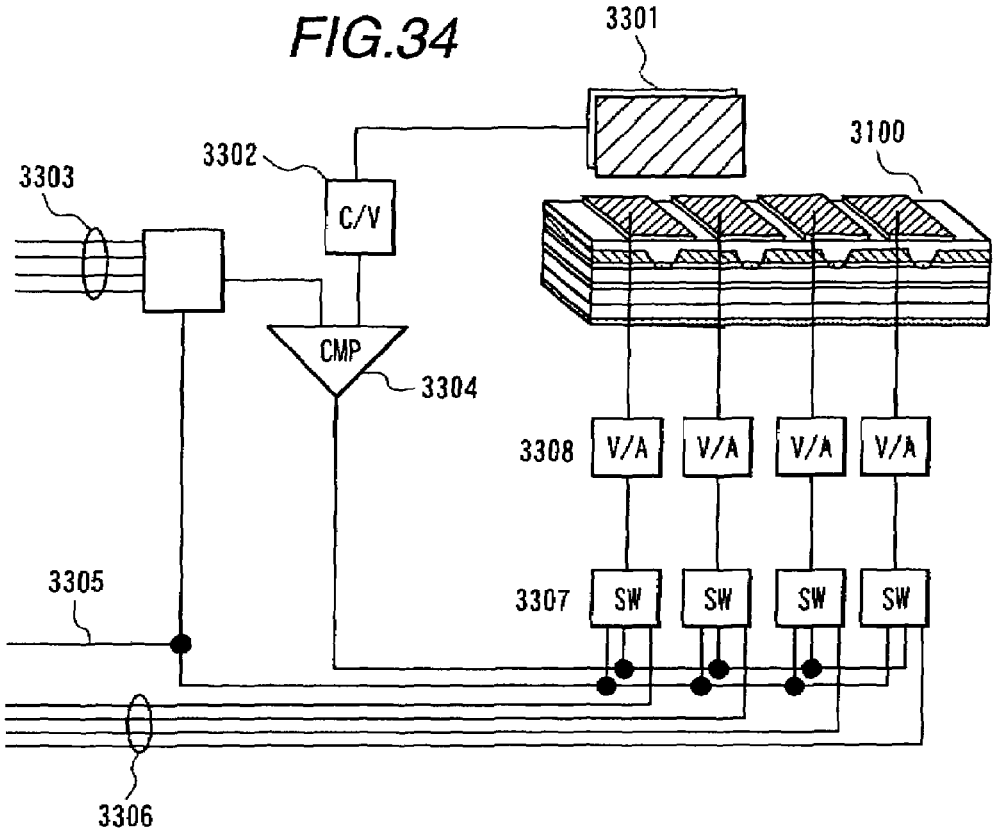
FIG. 34 is a schematic diagram of a light-quantity control system for the laser array of FIG. 32.

For example, as shown in FIG. 34, the monitor PD3301 is placed behind the laser emitting surface of the laser array 3100. In this configuration, the monitored intensity of a laser beam from the center of the laser array is not equal to the monitored intensity of a laser beam from the end of the laser array because the laser emission angle is great even when the laser beams have the same power. As seen from the figure, it is ideal to provide a monitor PD3301 for each laser source, but this is substantially impossible due to the installation technique.

Another technique can be considered in which the light quantity is fed back in a time-division manner. However, it is extremely difficult to cause an identical percentage of laser beam to be applied to the monitor PD3301. The last possible technique is to judge the efficiency of use of laser beams to the monitor PD3301 by feedback from a surface potential detector over the photosensitive drum. As the difference of laser powers is very sensitive to the rise characteristics of the above-mentioned line synchronization sensor, exact control is required.

This is very dependent upon the performances and dispositions of the laser array, the monitor PD, the rotary polygon mirror, the optical scanning lens, and the BD sensor. A method of measuring actual latent images and controlling by feedback or by quantity of exposure is extremely effective as a method of easily bringing the total system closer to the optimum values.

Figure 37:
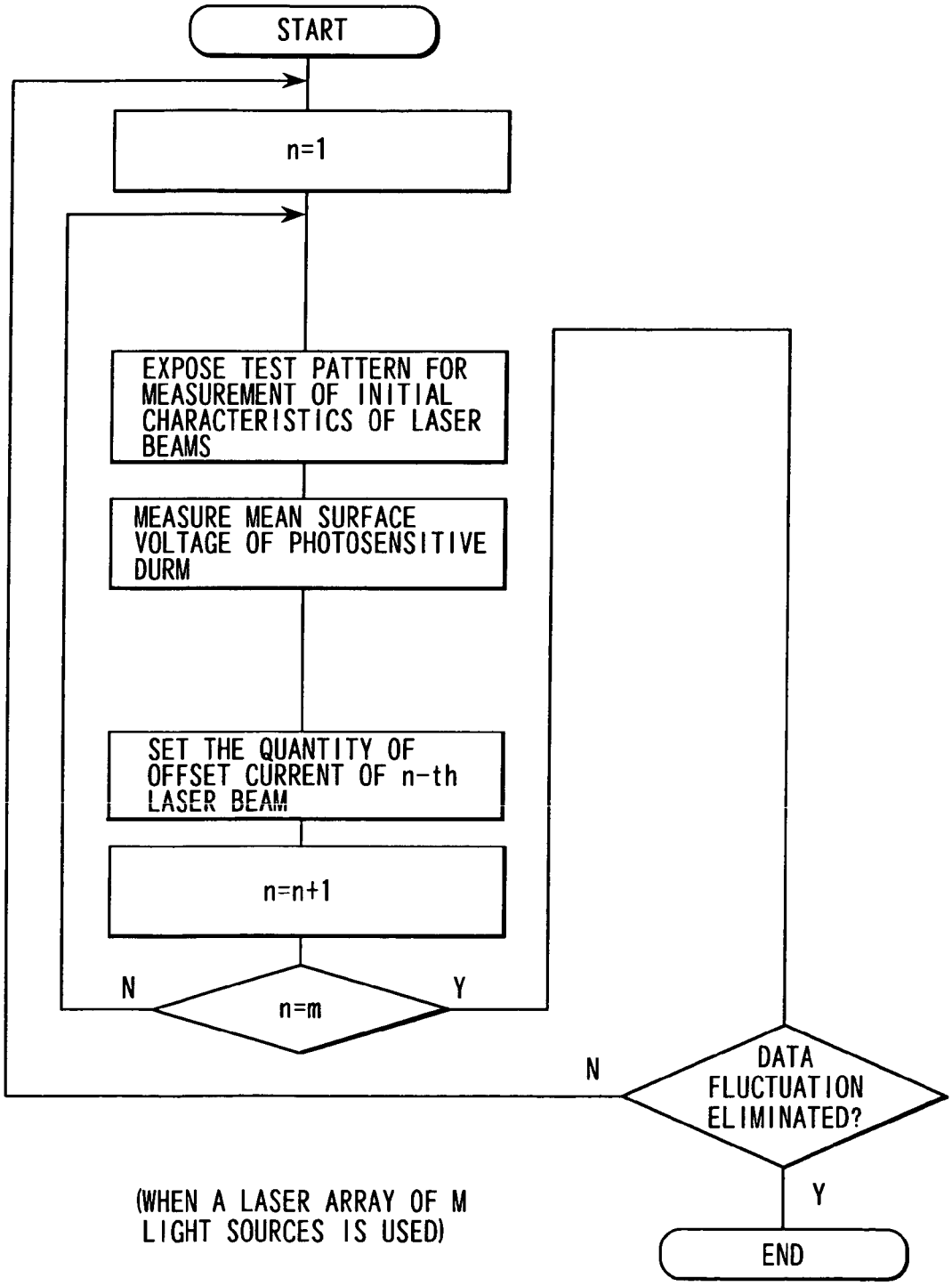
FIG. 37 is a flow diagram showing a sequence of the measurement of initial characteristics of a laser array according to the present invention.

Next, FIG. 37 shows a sequence of steps for measuring the initial characteristics of the laser array. The purpose of this sequence is to solve problems dependent upon the performance and disposition of each laser source and to perform exact initial setting by contact-exposing test patterns of a non-saturation light quantity (e.g. half of the quantity of exposure) onto the photosensitive drum and feeding back the result for control.

It is effective to apply a test pattern repeatedly by changing its light quantity levels and perform feedback control until the influence by the environmental changes (e.g. temperature changes) is eliminated and the values become fixed.

Recently, there have been developed various plane-illumination laser units having small beam fan-out angles and small laser emitting pitches (about 10 $\mu$m) as the laser manufacturing technique improves. The latest laser light source can give a beam spot pitch of about 60 $\mu$m (equivalent to 400 dots per inch) on the surface of a photosensitive drum. With this laser light source, a high-resolution optical system can be accomplished by means of a skip scanning technique without tilting the semiconductor laser array.

Figure 35:
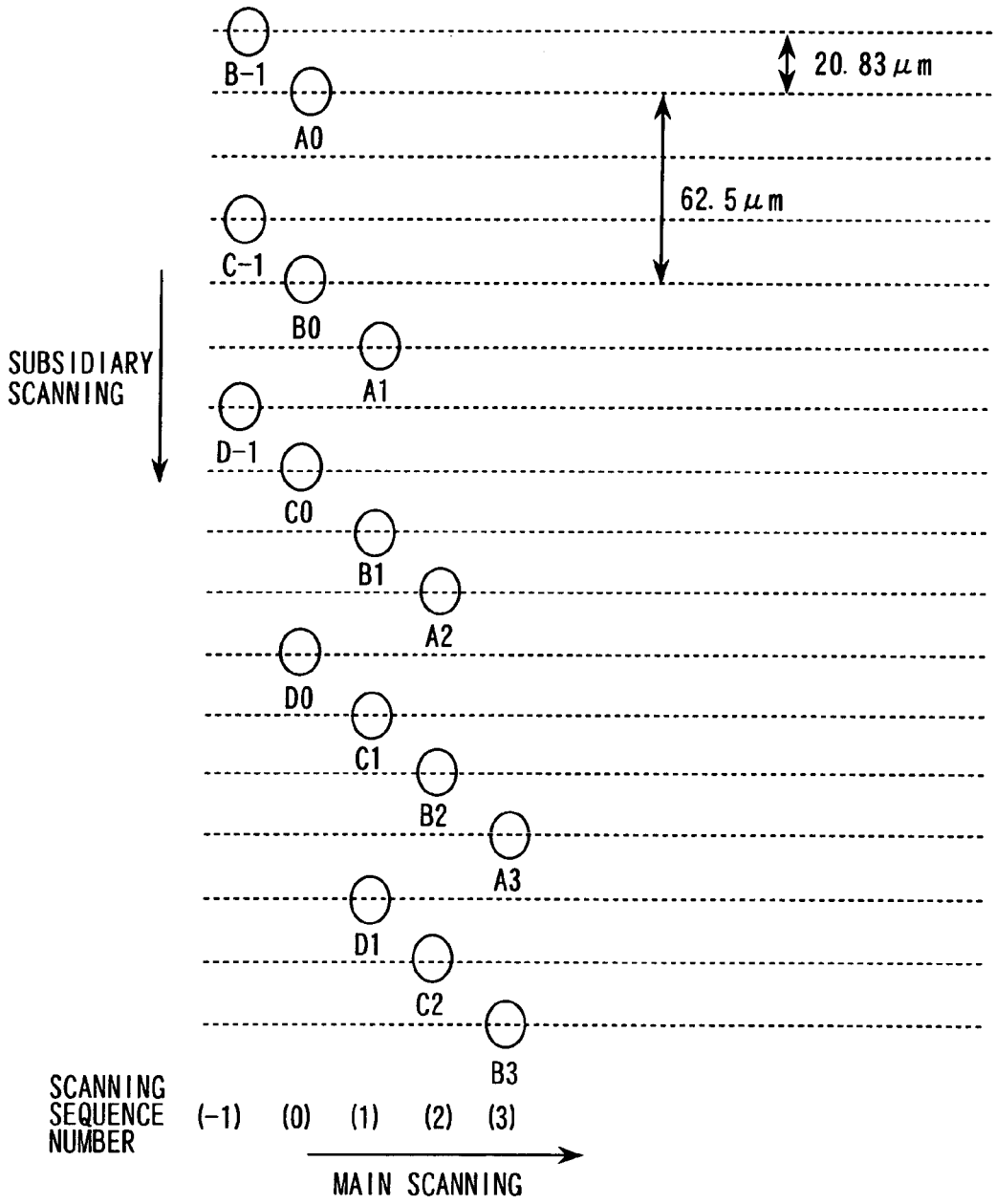
FIG. 35 is a diagram showing a scanning method of the laser array of FIG. 32.

FIG. 35 shows an example of skip scanning by a semiconductor laser array having four laser beam emitting points. It can be easily seen that this kind of laser light source is applicable to the present invention. Although this kind of laser light source can be installed more easily than a tilted semiconductor laser array, it has a demerit in that the positional errors of laser beam emitting points will directly influence the scanning line pitches.

It is assumed that the present correcting method depending upon design performance is not enough for the future image recording devices which require higher resolutions. In contrast, the light quantity controlling method capable of adjusting the scanning line pitches in the subsidiary scanning direction according to the present invention is believed to be extremely effective to increase the image resolution.

Further, the image resolution is affected by the number of laser beams, the number of faces of the rotary polygon mirror, and the number of pixels in the subsidiary scanning direction in a cell on which area half-toning is performed. It is impossible to completely eliminate irregularities in the subsidiary scanning direction by various corrections. The least common multiple of the aforesaid three factors will cause irregularities in images. Judging from the visual transfer function of the human eye, the aforesaid least common multiple must not be a low frequency.

Figure 36:
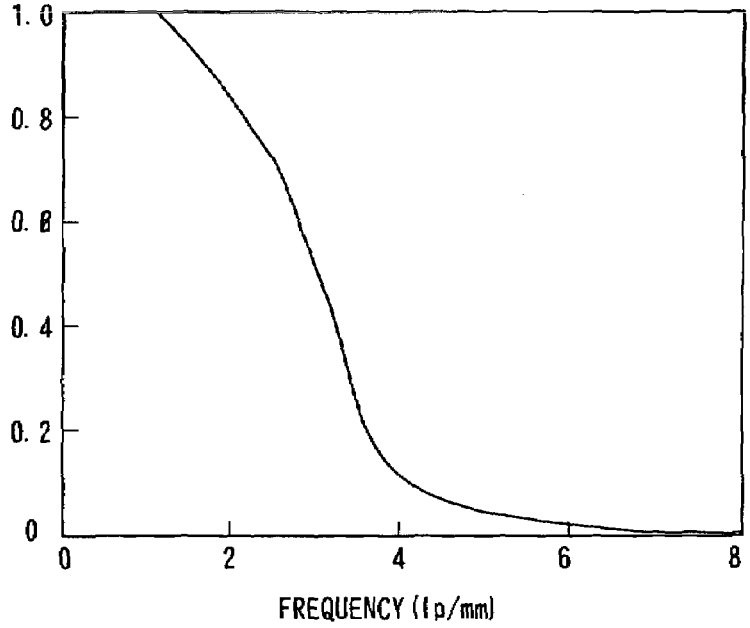
FIG. 36 is a graph showing the visual characteristics of the human eye.

FIG. 36 shows a visual transfer function of the human eye. We hardly recognize images of higher frequencies than 4 line pais per mm. Therefore, if the aforesaid least common multiple goes over 4 line pais per mm, the visual transfer function of the human eye does not matter. However, this cannot be ignored when the image has a continuous halftone range. For example, an image recording device having a resolution of 600 dpi (24 lines per mm) and 8 mirror faces may form images of 4 line pais/mm.

Now returning to the consideration of influences by major factors (the number of laser beams, the number of faces of the rotary polygon mirror, and the number of pixels in the subsidiary scanning direction in a cell on which area half-toning is performed), the resolution is less affected as the least common multiple of these factors becomes smaller.

For example, a rotary polygon mirror of a fast image recording device generally has eight faces, considering the scanning angle. Accordingly, the use of four laser beams and 4 or 8 pixels in the subsidiary scanning direction in a cell on which area half-toning is performed is standard. If the rotary polygon mirror has six faces, using 3 or 6 laser beams and 3 or 6 pixels in the subsidiary scanning direction is standard.

In other words, it is significant that any other values than the three maximum values are divided by integers without a remainder. In such a case, the maximum is equal to the least common multiple. The number of mirror faces and the least common multiple can be reduced by increasing the number of laser beams.

At the same time, increasing the number of laser beams means that the positional error of a laser beam becomes greater. Thus, judging from this, the above-explained exposure quantity control is extremely effective. It is needless to say that the method of freely changing scanning positions has a greater degree of freedom of design than any other methods.

One cause of irregularity that has not been explained may be an irregular scanning speed in the subsidiary scanning direction, that is the irregular rotational speed of the photosensitive drum. The long-span moving errors caused by an environmental condition (temperature, relative humidity, etc.) can be absorbed by the above-explained methods.

However, the short-span moving errors caused by vibrations, etc. are represented by a function of the number of mirror faces and the number of laser beams and can be reduced greatly by the correction control according to the present invention. To make the system resistant to shocks and vibrations, the basic clock source for driving the mechanism should be provided separately from the clock source for driving the rotary polygon mirror (to make them out of synchronization).

Below will be explained the BD signal generating means of the beam detector 305 which is related to the irregularities in the main scanning direction. The conventional BD signal generating means has digitized analog outputs at a threshold level as shown in FIG. 6(*a*). In an image recording device using multi-beams, a combination of beam fan-out diameter differences (image surface curve errors and laser specific errors) and laser power differences are great problems. Such problems are logically big loads to the above-explained method.

To avoid this a peak hold circuit is effectively used instead of a circuit for digitizing the rises of BD signals. The peak-hold circuit raises the binary outputs at peak-power timing. Saturation of analog outputs (if any) can be effectively prevented by a light-quality filter placed before the sensor. Raising the binary output at peak power timing can prevent expansion of laser spots, eliminate power errors, and further improve the accuracy and logical load of the correcting method.

Figure 19A:
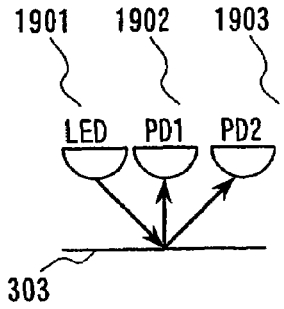
FIGS. 19(*a*) and 19(*b*) are schematic diagrams of optical density sensors.
Figure 19B:
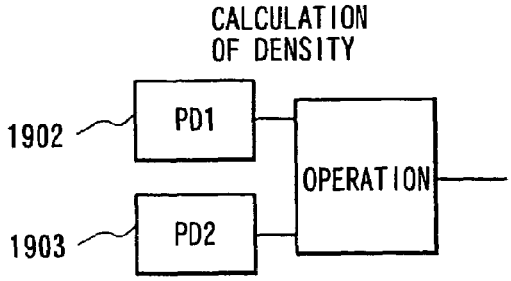

Referring to FIG. 8, FIG. 10, FIG. 16, FIG. 19(*a*) and FIG. 19(*b*), the correcting method will be explained below.

FIG. 8 shows an embodiment of an image recording device of the present invention. Although the embodiment previously described with reference to FIG. 8 uses a surface potentiometer 803 as a means to measure the result of exposure of a test pattern, this embodiment uses an optical density sensor 805 to measure it. The exposure optical system exposes a test pattern for measuring positional errors on the surface of the photosensitive drum 303. The electrostatic latent image on the photosensitive drum is developed by means of toner from the developer 804.

The optical density sensor 805 senses the density of toner on the surface of the photosensitive drum. In this case, the surface potentiometer 803 and the optical density sensor 805 may be easily covered with toner, which may cause measurement errors. Accordingly it is hard to effect fine control over an extended lifetime. Therefore, it may be recommended to mount the surface potentiometer 803 and the optical density sensor 805 in a unit on the developer or toner cartridge and replace them together with the cartridge periodically (at a preset print-out count).

FIG. 19(*a*) shows an example of an optical density sensor. The light-emitting unit 1901 usually is a light emitting diode (LED) having a narrow directivity. The light receiving units 1902 and 1903 are photo diodes or photo transistors PD1 and PD2 having a narrow directivity. The light receiving unit 1902 receives a diffused and reflected light component and the light receiving unit 1903 receives a regular reflected light component.

The positions of these units are determined according to the reflection characteristics of the toner and the surface of the photosensitive drum 303, the directivities of the light emitting and receiving units, etc. Namely, the units are placed at positions which have the greatest signal changes. As shown in FIG. 19(*b*), this embodiment produces an output by calculating the signals of the light receiving units 1902 and 1903. Usually, lights from areas of about 1 cm in diameter are measured and averaged.

The "Optical density" fields of FIG. 10 and FIG. 16 show the results of actual measurement. Their units are optical reflection densities. Therefore, "Measure mean surface voltage of photosensitive drum" (2 places) in FIG. 9 can be replaced by "Measure optical density of toner on the photosensitive drum." The other items in the operational flow are the same as those of the prior embodiment.

Unlike the method which involves measuring the mean surface potentials of the photosensitive drum, this method (of measuring the mean optical densities of toner on the photosensitive drum) requires the application of toner (to develop test patterns) and the wiping away of toner from the surface of the photosensitive drum after measurement. This imposes a load on the engine 205, but the measurement is very exact. The reason for this will be explained below.

The developing characteristic (surface potential vs. quantity of attached toner) of the developer 804 has a more striking saturation characteristic than the exposure characteristic (quantity of exposure vs. surface potential) of the photosensitive drum 303. Further, the optical characteristic (quantity of attached toner vs. optical reflection factor) of the optical density sensor 805 also has a saturation characteristic.

When the light from the exposed part of the test pattern (see "Test Pattern" fields of FIG. 10 and FIG. 16) is converted into a signal by the optical density sensor 805 through said exposure characteristic, developing characteristic, and optical characteristic, the signal is digitized at a preset threshold level and has completely binary characteristics (quantity of exposure vs. optical reflection factor).

The binary characteristics make the measurement resistant to noises, such as density fluctuations. This phenomenon is common in most electronic photographic processes. The densities of a toner image formed on the photosensitive drum can be easily checked by taking a picture of the toner image using a camera and measuring the densities of the picture image on film by means of a microscopic densitometer.

Accordingly, the mean optical density values in the "Optical Density" fields of FIG. 16 are linearly proportional to the "Ratio of exposed area" values. As a result, this embodiment can provide a measurement of the positional errors of beam spots which is more accurate and more resistant to noises than the old embodiment of measuring the surface potentials on the photosensitive drum.

Figure 20:
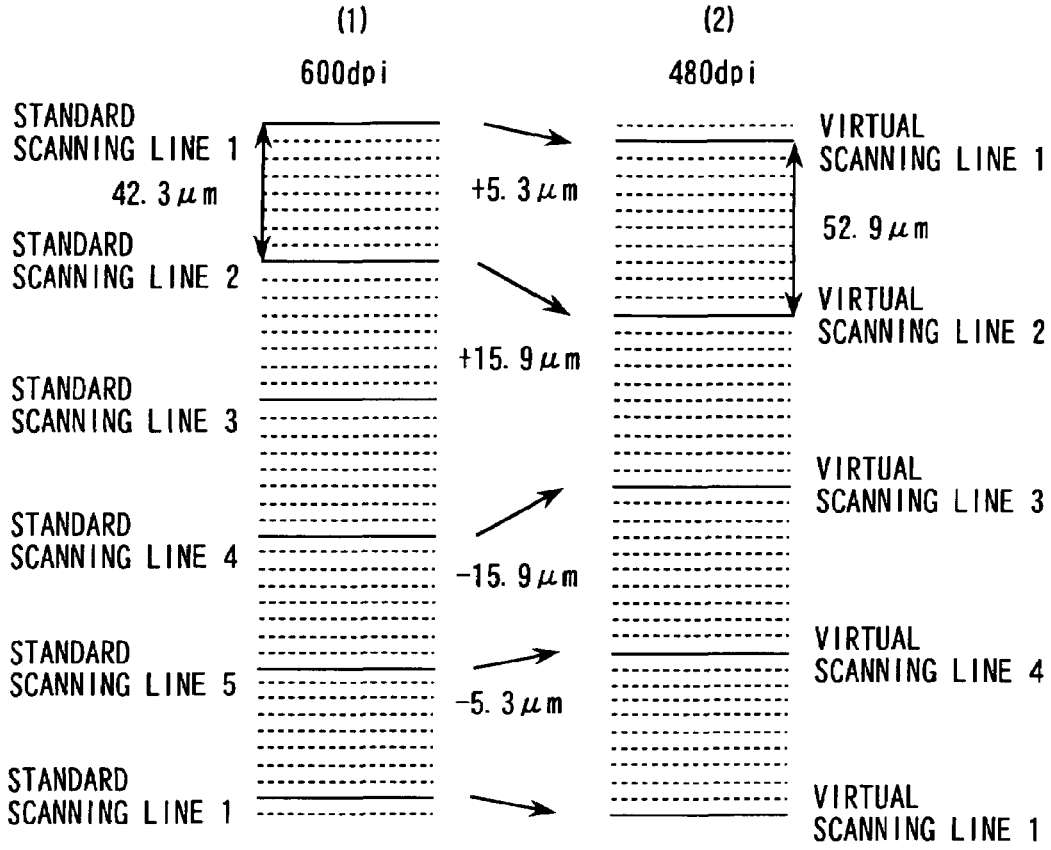
FIG. 20 is a diagram showing the correction of a scanning line pitch by the correction circuit according to the present invention.
Figure 21:
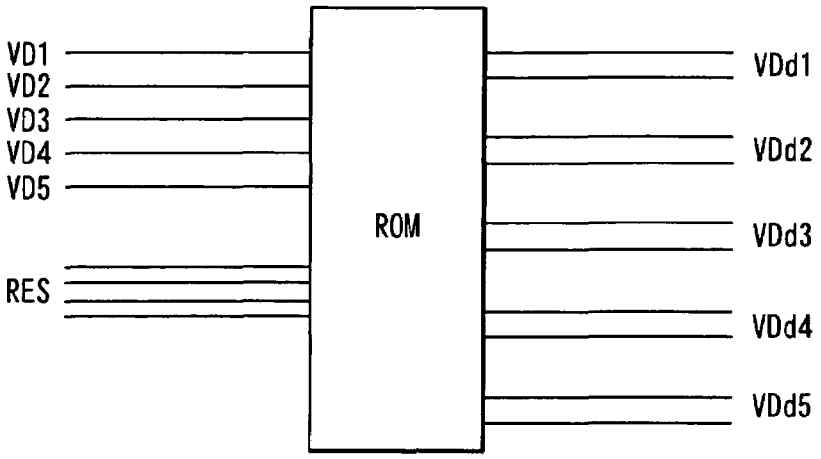
FIG. 21 is a block diagram of another embodiment of an interference circuit of a correction circuit according to the present invention.

Referring to FIG. 20 and FIG. 21, the scanning line pitches will be explained. The purpose of the above-described embodiment is to make the pitches of actual scanning lines equal to the standard scanning line pitch determined by the engine 205. The purpose of this embodiment is to make the pitches of actual scanning lines equal to any other scanning line pitch than that determined by the engine 205.

For example, this image recording device has a resolution of 600 dots per inch which is equivalent to a standard scanning line pitch of 42.3 $\mu$m. This embodiment changes this scanning line pitch to 52.9 $\mu$m (equivalent to a resolution of 480 dots per inch). The scanning lines which have been changed from standard scanning lines are termed virtual scanning lines.

FIG. 20 in pattern (1) shows how scanning line positions are corrected. The embodiment of an image recording device of the present invention is a multi-beam laser printer having a resolution of 600 dots per inch using five laser beams. This embodiment assumes that five standard scanning lines 1, 2, 3, 4, and 5 (represented by solid lines) are correctly formed by beam spots 1, 2, 3, 4, and 5. All these scanning lines are equally spaced at an interval of 42.3 $\mu$m. FIG. 20 in pattern (2) shows virtual scanning lines formed at a resolution of 480 dots per inch.

For convenience, a set of four virtual scanning lines are numbered 1, 2, 3, and 4 from the top. The virtual scanning lines are equally spaced at an interval of 52.9 $\mu$m. The dotted lines are shown at intervals of 5.3 $\mu$m to clarify the positional relationship between the standard and virtual scanning lines. Standard lines at a resolution of 600 dots per inch are drawn for every eight dotted lines and virtual lines at a resolution of 480 dots per inch are drawn for every ten lines.

As seen from FIG. 20, the virtual scanning line 1 is between standard scanning lines 1 and 2. To get a virtual scanning line 1, the standard scanning line 1 is moved downward (toward the standard scanning line 2) by +15.3 μm. This is accomplished by dividing the signal VD1 into VDd1 and VDd2 using the interference circuit 101 of FIG. 1. As shown in FIG. 13, increase the coefficient "a12" and reduce the coefficient "a11" by that amount in the matrix A (expanded to have elements 5×5).

Similarly, the virtual scanning line 2 is between standard scanning lines 2 and 3. To get a virtual scanning line 2, the standard scanning line 2 is moved downward (toward the standard scanning line 3) by +15.9 μm. This is accomplished by dividing the signal VD2 into VDd2 and VDd3 using the interference circuit 101 of FIG. 1. As shown in FIG. 13, increase the coefficient "a23" and reduce the coefficient "a22" by that amount in the matrix A (expanded to have elements 5×5).

Also, similarly, the virtual scanning line 3 is between standard scanning lines 3 and 4. To get a virtual scanning line 3, the standard scanning line 4 is moved upward (toward the standard scanning line 3) by +15.9 μm. This is accomplished by dividing the signal VD4 into VDd3 and VDd4 by the interference circuit 101 of FIG. 1. As shown in FIG. 13, increase the coefficient "a43" and reduce the coefficient "a44" by that amount in the matrix A (expanded to have elements 5×5).

Further, the virtual scanning line 4 is between standard scanning lines 4 and 5. To get a virtual scanning line 4, the standard scanning line 5 is moved upward (toward the standard scanning line 4) by +5.3 μm. This is accomplished by dividing the signal VD5 into VDd4 and VDd5 by the interference circuit 101 of FIG. 1. As shown in FIG. 13, increase the coefficient "a54" and reduce the coefficient "a55" by that amount in the matrix A (expanded to have elements 5×5).

In this case, no signal is applied to VD3, but the signal VDd3 has interference light quantity components "a23" and "a43" of signals VD2 and VD4. Therefore, the beam spot on the standard scanning line also illuminates.

FIG. 21 shows another embodiment of an interference circuit 101 using a ROM. The ROM receives five video signals VD1, VD2, VD3, VD4, and VD5 corresponding to beam spots 1, 2, 3, 4, and 5 from the printer controller 203 and a RES signal (4 bits in this example) related to a new resolution. The resolution of 480 dots per inch is commanded by the RES signal. Unlike the above-described embodiment, this embodiment can switch resolutions in response to the RES signal at any time during recording.

In this embodiment (to change resolutions to 480 dots per inch), the video signal VD3 of VD1 to VD5 sent from the printer controller is always off. Thus, only the video signals VD1, VD2, VD4, and VD5 are fed to the ROM. The ROM stores the results of calculations (output signals VDd1, VDd2, VDd3, and VDd4) of all possible combinations of the video signals (VD1, VD2, VD3, and VD4) and the RES signal in advance. Further, coefficients of the matrix A are also determined experimentally in a manner similar to the above-mentioned embodiment.

This embodiment can record image data 207 at a resolution of 480 dots per inch directly on a 600-dpi engine 205. Here the resolution in the main scanning direction will not be explained because it is well known that the resolution in the main scanning direction can be changed simply by changing the frequency of the pixel clock DCLK (in case of a laser printer).

In comparison to a method of changing resolutions (480 dpi to 600 dpi) of image data 207 by calculation, this method has various advantages, such as correct line width, no moire pattern in half-tone images made by dots, and high-quality recorded images. It is also possible to combine this embodiment with the aforesaid embodiment for correcting scanning line pitches by rewriting the data of the ROM of FIG. 14, FIG. 16, and FIG. 21.

Other embodiments will be explained below with reference to the drawings.

Figure 38:
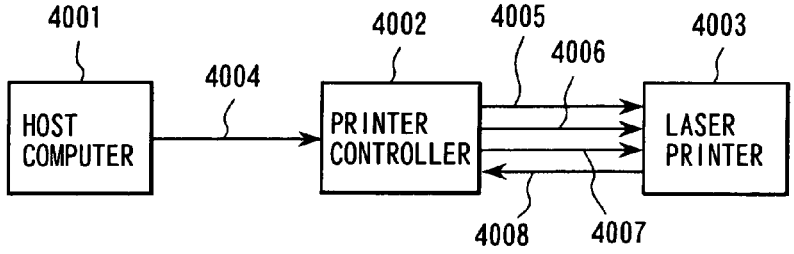
FIG. 38 is a block diagram of an image recording device according to the present invention.

FIG. 38 shows a block diagram indicating the operating environment of an image recording device according to the present invention. The user creates Image data 4004 on the host computer (personal computer) 4001 and sends it to the printer controller 4002.

Usually, most image data 4004 is page description data representing the content of a recorded page, but part of image data can be raster data that can be directly fed to the laser printer 4003. This embodiment assumes that most of the image data 4004 is page description data.

When printing starts, the image data 4004 is sent from the host computer 4001 to the printer controller 4002 through a network and the like, is read page by page by the printer controller 4002 and is expanded into a raster image represented as an array of 2-dimensional image data on the bit-map memory.

When creation of a raster image is completed, the printer controller 4002 outputs a print request signal 4005 to the laser printer 4003 to start the printer. In response to a BD (Beam Detection) signal 4008 from the laser printer 4003, the printer controller 4002 sends print data (print dot size data) 4006 to the laser printer 4003. The laser printer 4003 forms an electrostatic latent image on the photosensitive drum according to the print data 4006, develops it with toner and transfers the toner image to a recording medium.

Figure 39:
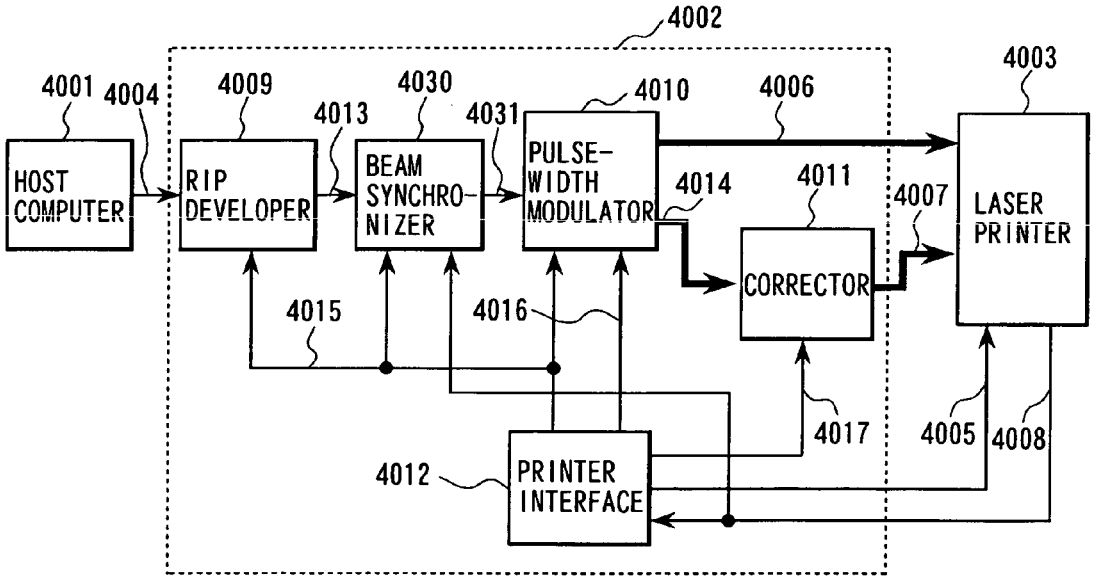
FIG. 39 is a block diagram of a controller according to the present invention.

FIG. 39 is a block diagram of the printer controller 4002 of FIG. 38. The printer controller 4002 consists of an RIP (Raster Image) expansion unit 4009, a beam synchronizer 4030, a pulse-width modulator 4010 (pulse generation block: multi-leveling unit) for laser driving signals, a signal corrector 4011 (multi-level correcting unit) for laser driving signals, and a printer interface block 4012.

The RIP expansion unit 4009 receives image data 4004 which is page description data from the host computer 4001, expands it into a raster image and outputs it as multi-level image data 4013 which can be represented with halftones.

The beam synchronizer 4030 receives multi-level image data 4013 and outputs multi-level image data 4031 to the pulse-width modulator 4010 in synchronism with the BD signals 4008 for the laser beams.

The pulse-width modulator 4010 converts multi-level image data 4031 into multi-level print data (dot size data) 4006 by modulating the widths of binary pulses (having high and low levels) according to dot sizes (beam sizes) and outputs the print data 4006 to the laser printer 4003. The pulse-width modulator 4010 requires as many pulse generators (pulse-width modulating units) as the number of laser beams which the laser printer 4003 uses. Accordingly, there should be as many print data lines as the number of laser beams.

The printer interface 4012 sends a print request signal 4005 to the laser printer 4003. It also receives BD signals 4008 and generates pixel clocks 4015.

The printer interface 4012 outputs a beam error correction command 4017 to the signal corrector to correct the dispersion of image forming laser beams when the correction mode is set. This beam error correction will be explained below with reference to FIG. 40.

Figure 40:
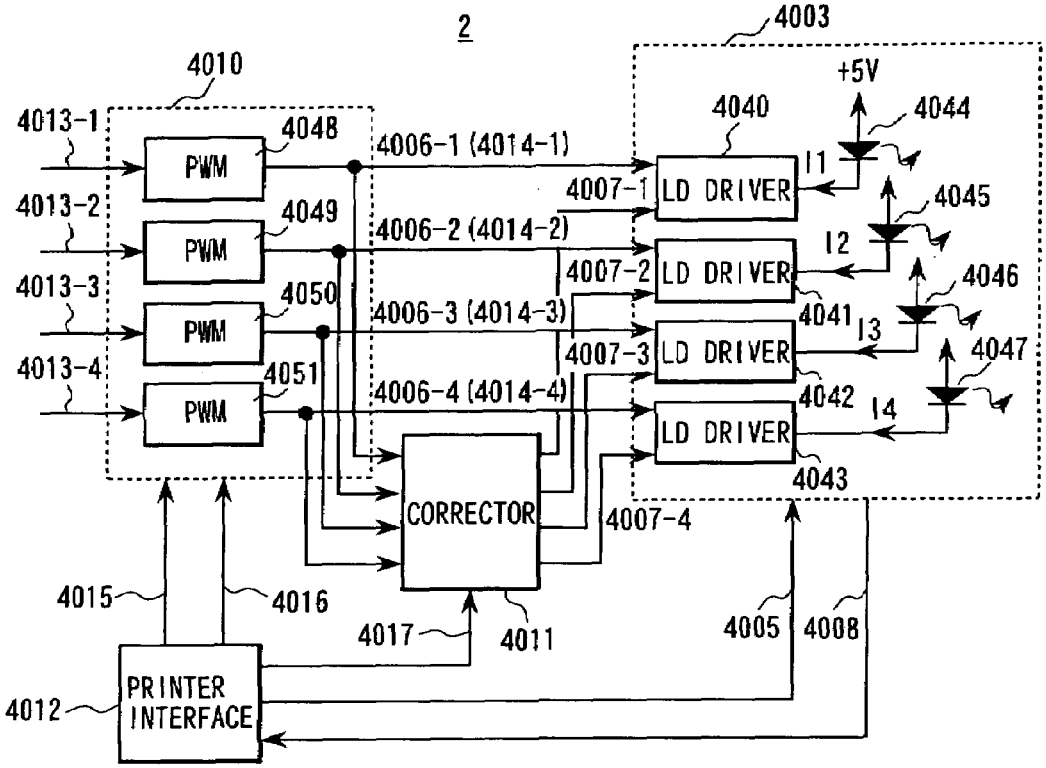
FIG. 40 is a block diagram of the controller of FIG. 39.

FIG. 40 is a more detailed block diagram of a portion of the printer controller 4002 of FIG. 39, which receives image data for four laser beams. The pulse-width modulator 4010 contains as many pulse-width modulating units (hereinafter abbreviated as PWM) as laser beams used for scanning. They are a first PWM4048, a second PWM4049, a third PWM4050, and a fourth PWM4051. These pulse-width modulating units respectively modulate the pulse-widths of multi-level image data 4013-1 through 4013-4 and output the resulting print data (laser driving signals) lines 4006-1 through 4006-4.

When receiving the aforesaid "Dispersion Correction" command 4017 output from the printer interface 4012, PWM4048 through PWM4051 outputs laser driving signals 4014-1 through 4014-4 for monitoring on the basis of identical image data (monitoring image data). These monitoring laser driving signals 4014-1 through 4014-4 are equivalent to a kind of print data 4006-1 through 4006-4 and are used to determine the dispersion in the result of the pulse-width modulation. In this point, this kind of print data is different from the normal print data.

The laser driving signals 4014-1 through 4014-4 for monitoring are fed to the laser driving circuits (LD) 4040 through 4043 and to the corrector 4011. The corrector 4011 calculates the dispersion in the pulse-width modulation of the laser driving signals 4014-1 through 4014-4 and corrects the laser driving signals 4006-1 through 4006-4 (to be used for image generation) according to this dispersion in pulse-width modulation.

The print data (laser driving signals) 4006-1 through 4006-4 and the light-quantity correction data 4007-1 through 4007-4, which is output by the corrector 4011, are respectively output to the LD drivers 4040 through 4043 to supply currents I1 through I4 respectively to the LD light sources (laser light sources) 4044 through 4047. The LD light sources 4044 through 4047 illuminate at intensities determined by the driving current I1 through I4.

As for the relationship of the inputs to the LD drivers LD4040 through 4043 (the laser driving signals 4006-1 through 4006-4 and the light-quantity correction data 4007-1 through 4007-4) and the outputs from the LD drivers LD4040 through 4043 (the currents I1 through 14 to the LD light sources 4044 through 4047), the light-quantity correction data 4007-1 through 4007-4 controls the magnitudes of the currents I1 through I4 (peak values of pulse currents) to be supplied to the LD light sources 4044 through 4047. The print data 4006-1 through 4006-4 determines the continuity periods (pulse widths) of currents I1 through I4 supplied to the LD light sources 4044 through 4047.

Figure 41:
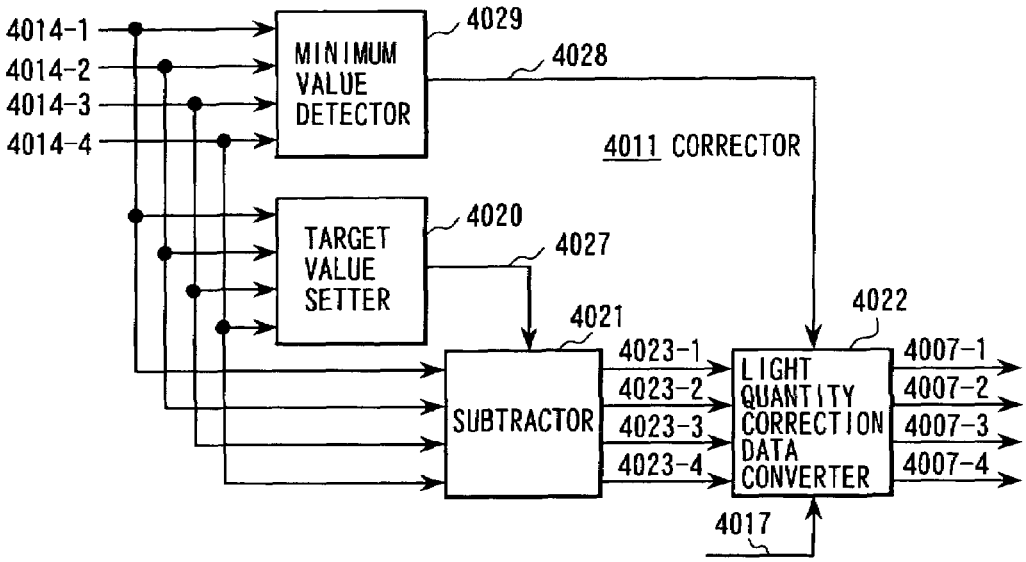
FIG. 41 is a block diagram of a device for correcting laser driving signals in the controller of FIG. 40.

FIG. 41 shows a block diagram of the corrector 4011 of FIG. 40. The corrector 4011 consists of a target value setting unit 4020, a minimum value detecting unit 4029, a subtracting unit 4021, and a light-quantity data converting unit 4022.

The target value setting unit 4020 selects one of the monitoring laser driving signals (pulses) 4014-1 through 4014-4 sent from PWM4048 through PWM4051 in the pulse-width modulator 4010 as a reference value used for calculation of dispersions in the pulse-width modulation of these driving signals and outputs it as a target modulation value (reference pulse-width modulation value) 4027 to the subtraction unit 4021. Although this example uses a laser driving signal having the greatest pulse width among signals 4014-1 through 4014-4 as a target value, the user can select a laser driving signal having any pulse width.

The subtraction unit 4021 takes a pulse-width difference between the target value and each monitoring laser driving signal (4014-1 through 4014-4) and outputs the result (4023-1 to 4023-4) to the light-quantity correction data converter.

The minimum value detection unit 4029 detects a monitoring laser driving signal having a minimum pulse width among the signals (4014-1 through 4014-4) sent from the pulse-width modulator 4010 and outputs it as a minimum reference modulation value 4028. This value 4028 is used as a base of a triangular wave generation signal for generation of light-quantity correction data (to be explained with reference to FIG. 49).

The light-quantity correction data converter 4022 receives the results of subtraction 4023-1 through 4023-4 and the minimum reference modulation value 4028 and converts them into light-quantity correction data 4007-1 through 4007-4.

Figure 42:
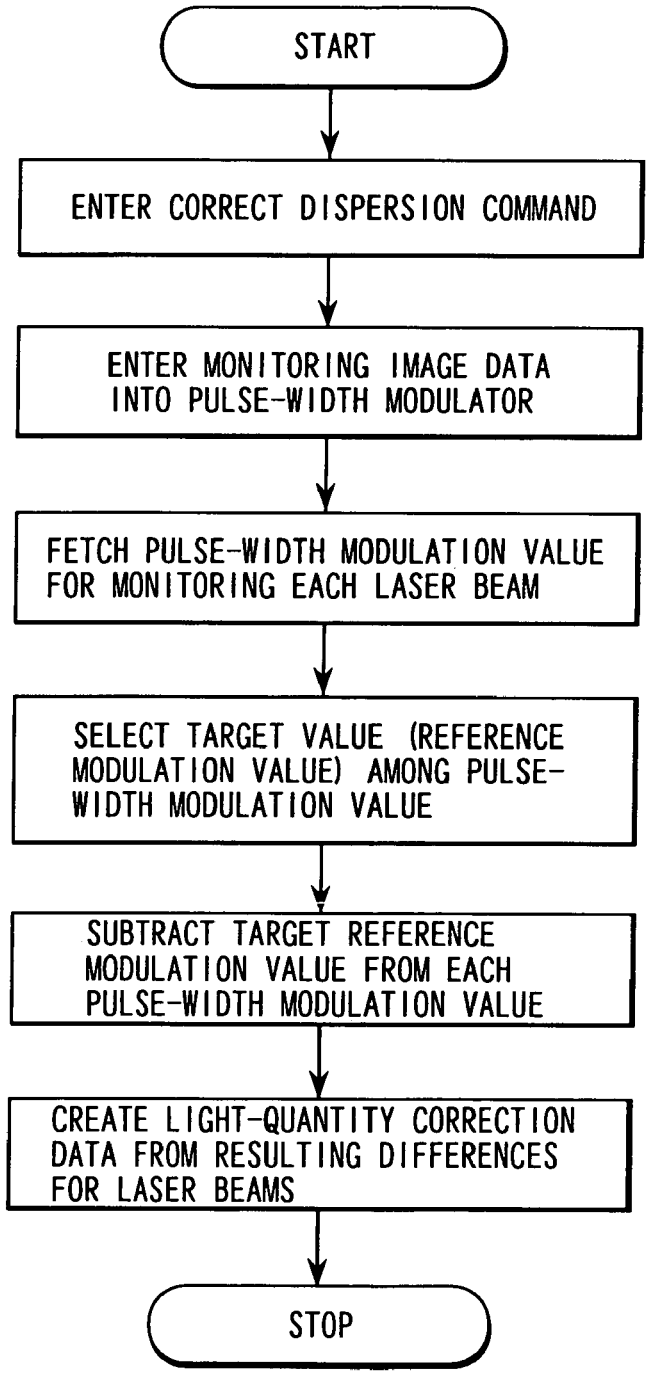
FIG. 42 is a flow chart of the operations of a device for correcting laser driving signals in the controller of FIG. 40.

Referring to FIG. 42, the operation of the corrector 4011 (for correcting the laser driving signals) will be explained. FIG. 42 shows an operational flow of the corrector 4011 (for correcting the laser driving signals).

When the printer interface 4012 (illustrated in FIG. 40) issues a "Dispersion Correction" command 4017 (in Dispersion Correction mode), the RIP (Raster Image) expansion unit 4009 outputs identical image data for monitoring to each PWM (4048 through 4051) in the pulse-width modulator 4010.

The corrector 4011 fetches pulse-width modulation values (sometimes assigned codes-4014-1 through 4014-4 for explanation) of the laser driving signals 4014-1 through 4014-4 based on the monitoring image data which is output from the PWMs in the pulse-width modulator 4010.

Next, the target value setting unit 4020 selects one of monitoring pulse-width modulation values 4014-1 through 4014-4 as a target value, takes a pulse-width difference between the target value 4027 and each pulse-width modulation value 4014-1 through 4014-4, and then outputs light-quantity correction data 4007-1 through 400-4 corresponding to the result of subtraction. The result of the subtractions represents the dispersion of pulse widths created by PWMs (4048 to 4051) in the pulse-width modulator 40101. This dispersion is corrected by the light-quantity correction data 4007-1 through 4007-4, which equalizes the light power energy (for print dots) that the LD light sources 4044 through 4047 emit.

Figure 43:
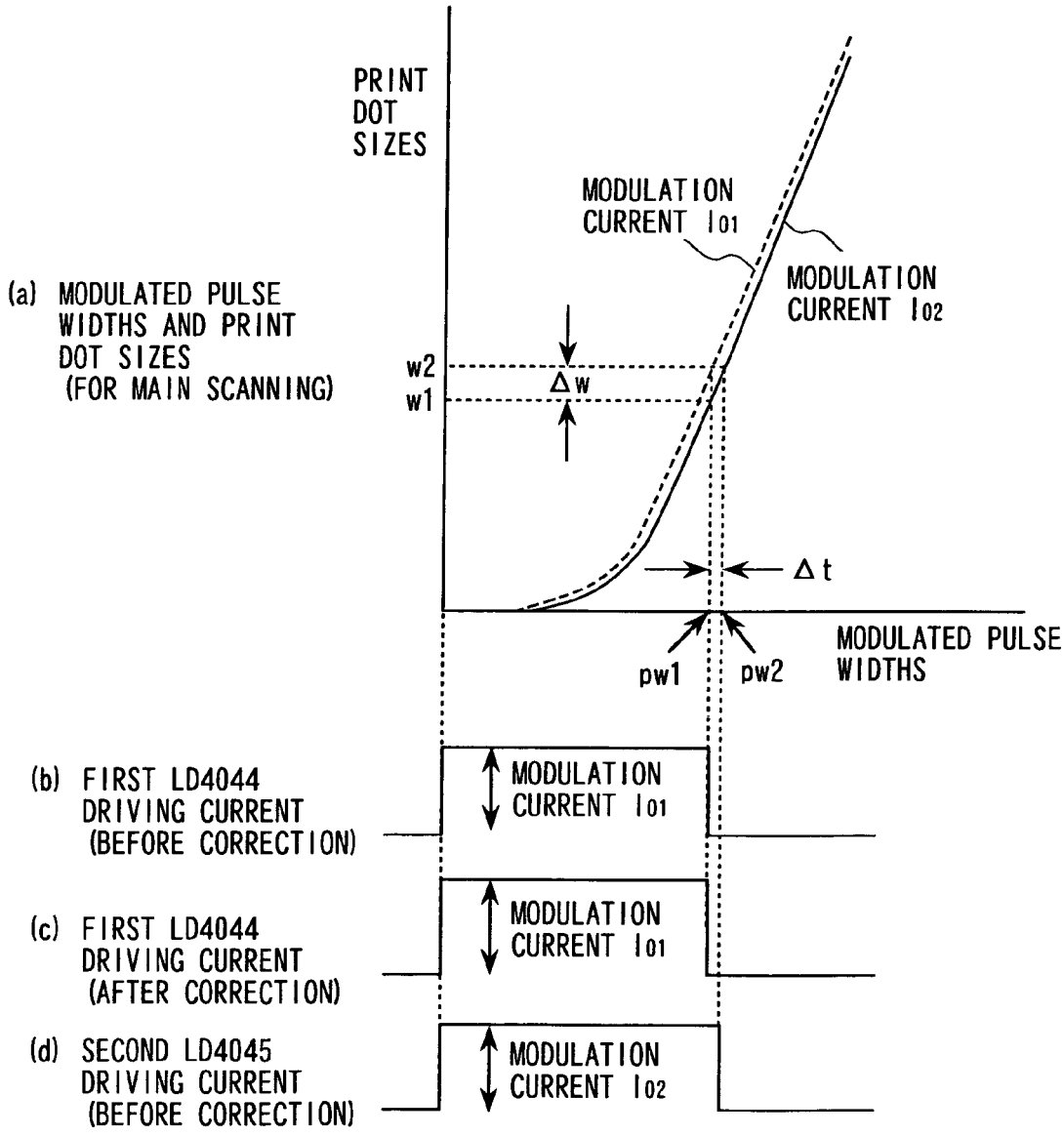
FIG. 43 is a diagram showing the relationship between currents supplied to light sources and dot sizes printed on paper sheets.

Referring to FIG. 43, the above-explained operation for equalizing the light power energy will be explained in detail. FIG. 43 shows the relationship of driving currents (modulation currents) supplied to the LD light sources 4044 to 4047 (illustrated in FIG. 43), their modulation pulse widths (pulse-width modulation values), and the sizes of dots printed in the main scanning direction. This example involves the two light sources 4044 and 4045 among the four LD light sources 4044 to 4047.

In this example, it is assumed that identical multi-level image data 4013-1 and 4013-2 is fed to PWM4048 and PWM4049 (illustrated in FIG. 40) and the outputs (laser driving signals 4014-1 and 4014-2) from PWM4048 and PWM4049 have different pulse widths "pw1" and "pw2" (although they must be identical). As a result, before correction, a driving current (modulation current) as shown in FIG. 43 at line (b) is fed to the LD light source 4044 and a driving current (modulation current) as shown in FIG. 43 at line (d) is fed to the LD light source 4045. An adjustment has been made in advance to set the amplitudes (peak values) of the driving currents of the light sources 4044 and 4045 to 102.

Since the amplitudes I02 (peak values) of the driving currents of the light sources 4044 and 4045 are identical, the LD light sources 4044 and 4045 have different light emission energies if their pulse widths are not equal (having a pulse difference Δt=pw2−pw1). Consequently, the print dots have different sizes (dot size difference Δw=w2−w1).

To correct the dot size difference Δt, namely to correct the print dot size of the LD light source 4044 to "w2" in FIG. 43, the amplitude of the driving current of the LD light source 4044 is increased to 101. When the amplitude of the driving current is increased to 101, the characteristic curve of modulation pulse width vs. print dot size moves as indicated by a dotted curve in FIG. 43. Even when the modulation pulse width is smaller by Δt, the print dot size of the LD light source 4044 becomes w2.

Figure 44:
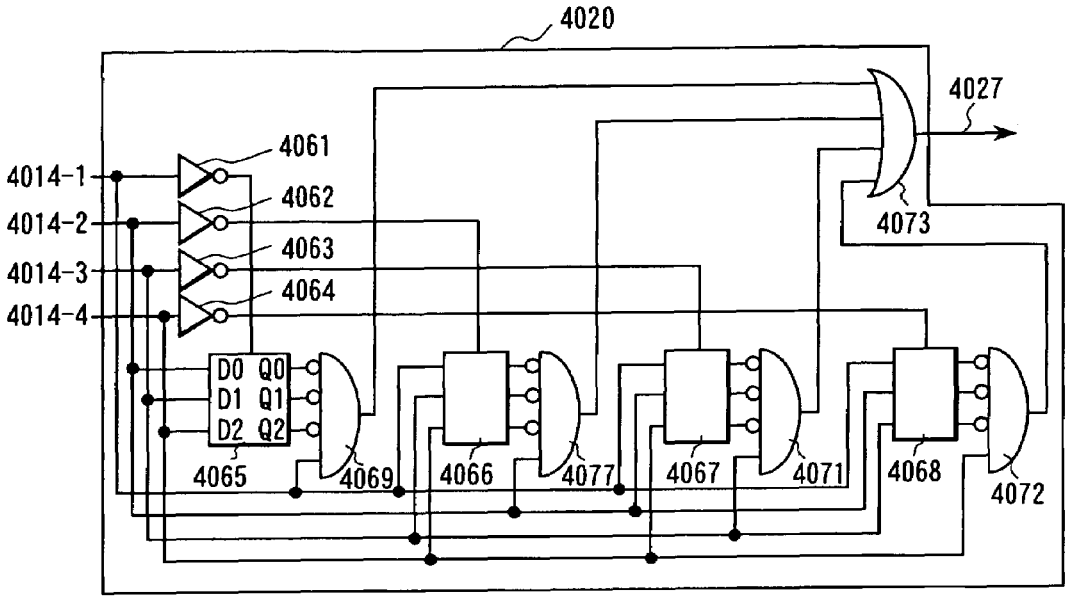
FIG. 44 shows an embodiment of a target value detecting unit of FIG. 41.

FIG. 44 shows a circuit diagram of the target value setting block 4020 of FIG. 41. The target value setting block 4020 consists of inverters 4061 to 4064, latches 4065 to 4068, composite gates 4069 to 4072, and an OR gate 4073. In the circuit of FIG. 44, the maximum pulse width of the monitoring laser driving signals 4014-1 to 4014-4 is selected as a target modulation value 4027.

Figure 45:
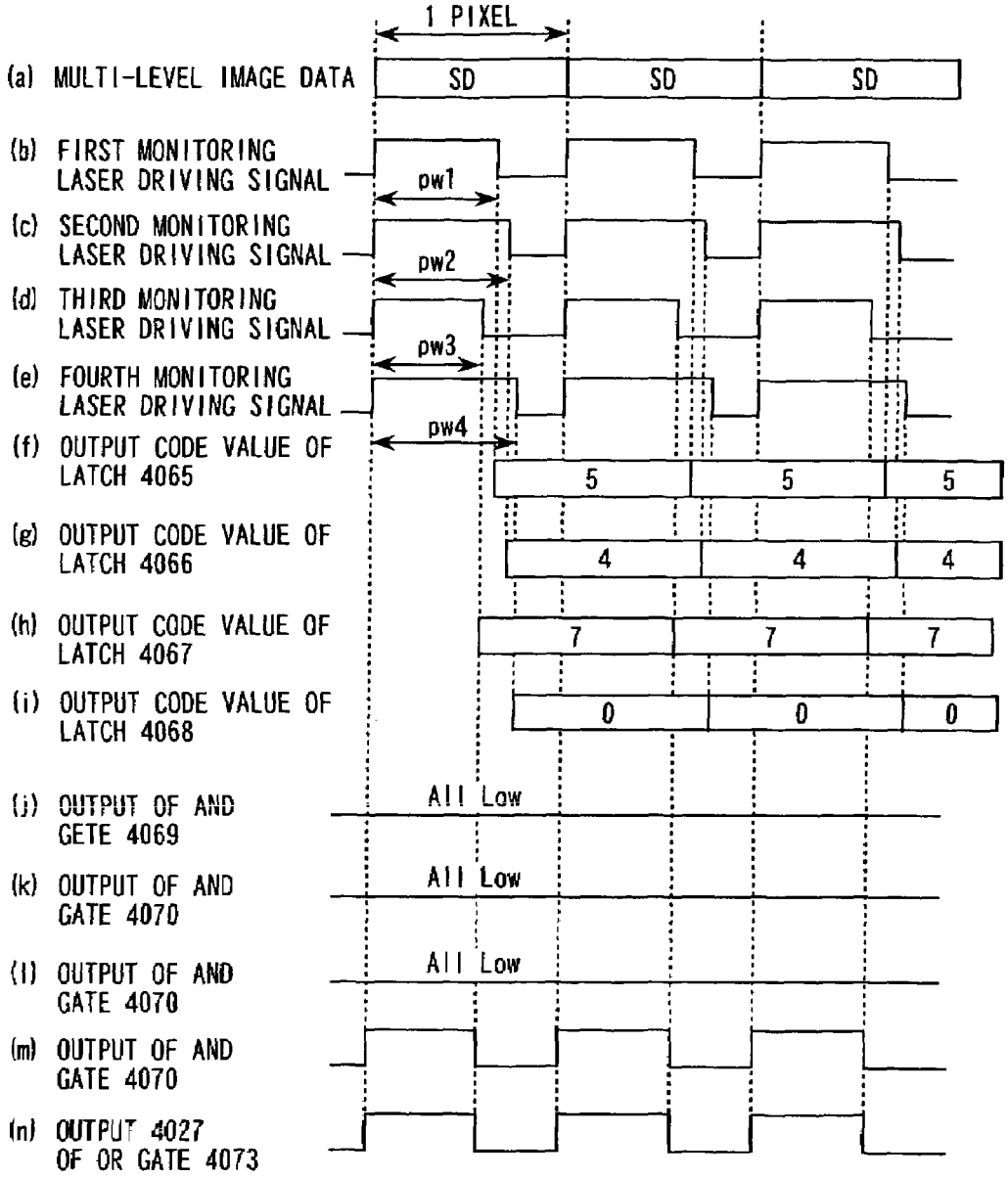
FIG. 45 is a timing diagram of the operations of a target value detecting unit in the corrector of FIG. 41.

Referring to FIG. 45, the operation of the target value setting unit 4020 of FIG. 44 will be explained below.

FIG. 45 shows waveforms of signals of the target value setting block 4020 of FIG. 44.

When identical image data SD is fed as multi-level image data (4013-1 through 4013-4) to PWM4048 through PWM4051 (as shown in line (a) of FIG. 45), the monitoring laser driving signals (pulse-width modulation values) 4014-1 through 4014-4 are output as shown in lines (b) through (e). Here, the pulse widths of lines (b) to (e) are designated pw1 to pw4 and their relationship is expressed by pw3<pw1<pw2<pw4.

The output of the latch 4065 in line (f) is QO=1 (least significant bit), Q1=0, and Q2=1 (most significant bit) as the monitoring driving signals (pulse width modulation values) 4014-2 to 4014-4 are sampled at the fall of the first monitoring laser driving signal (pulse width modulation value). This binary output value "101" is equivalent to "5" in decimal notation.

Similarly, the output values of latches 4066 in line (g) through 4068 in line (i) are respectively "4," "5," and "6" in decimal notation. When the output of a latch has a value of "O" in decimal notation, that is when QO through Q2 are all zeros, the output of a composite gate that entered this code "O" is determined as a target modulation value 4027. Accordingly, in FIG. 45, the target pulse modulation value 4027 is the input of the composite gate 4072 to which the output of the latch 4068 is connected, that is, the monitoring laser driving signal 4014-4 having a pulse width pw4.

Figure 46:
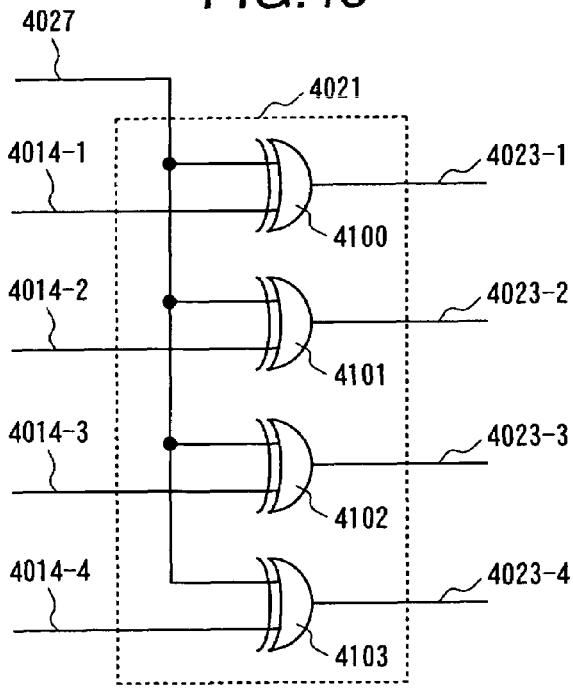
FIG. 46 is a circuit diagram of a processing unit in the corrector of FIG. 41.
Figure 47:
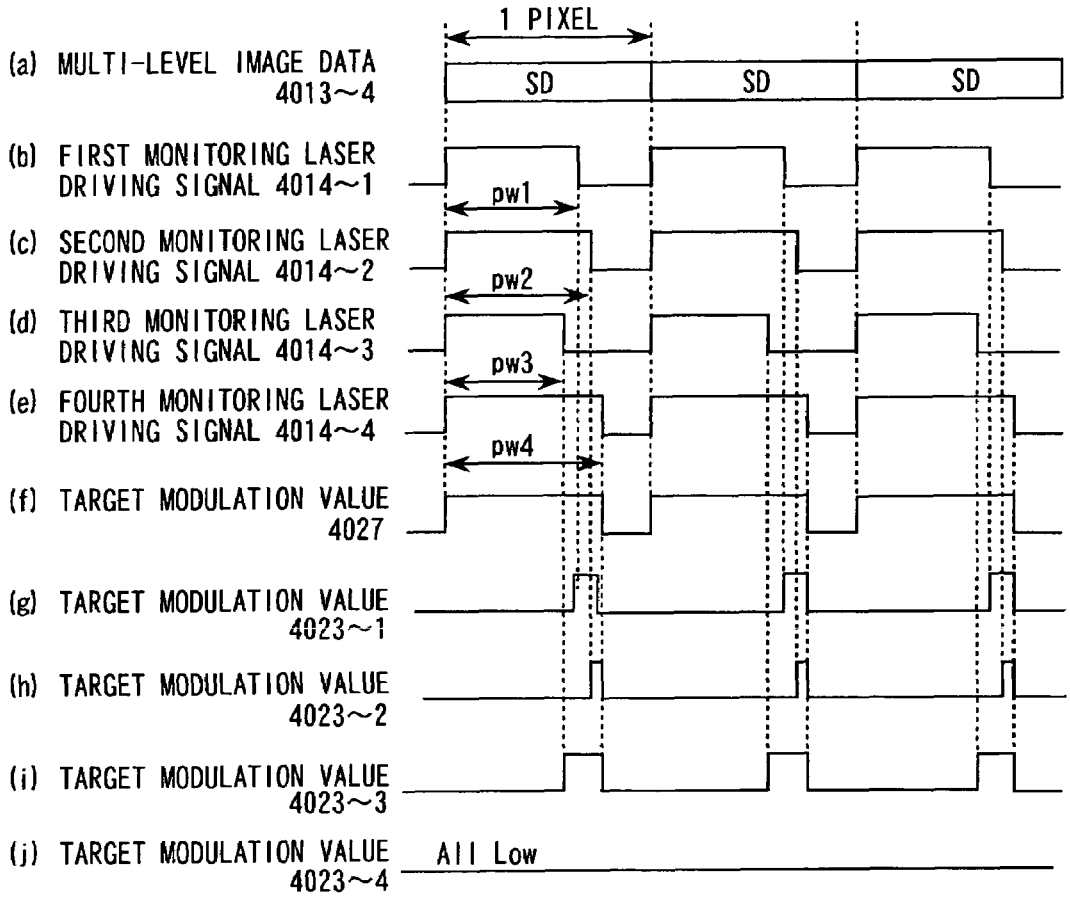
FIG. 47 is a timing diagram of operations of the processing unit of FIG. 46.

FIG. 46 is a circuit diagram of the subtraction unit 4021 of FIG. 41. Elements 4100 to 4103 are exclusive OR gates. Referring to FIG. 47, the operation of the subtraction unit 4021 of FIG. 46 will be explained.

When identical image data SD is fed as multi-level image data (4013-1 through 4013-4) to PWM4048 through PWM4051 (as shown in line (a) of FIG. 45), the monitoring laser driving signals (pulse-width modulation values) 4014-1 through 4014-4 are output as shown in line (b) through line (e). Here, the pulse widths of lines (b) to (e) are named pw1 to pw4 and their relationship is expressed by pw3<pw2<pw2<pw4.

The target modulation value 4027 that the target value setting unit 4020 outputs (illustrated in FIG. 41) is as shown in line (f). The exclusive OR of the target modulation value 4027 in line (f) and respective pulse width modulation values 4014-1 in line (b) through 4014-4 in line (e) are the differential pulse widths as shown by the subtraction values 4023-1 in line (g) to 4023-4 in line (j).

Figure 48:
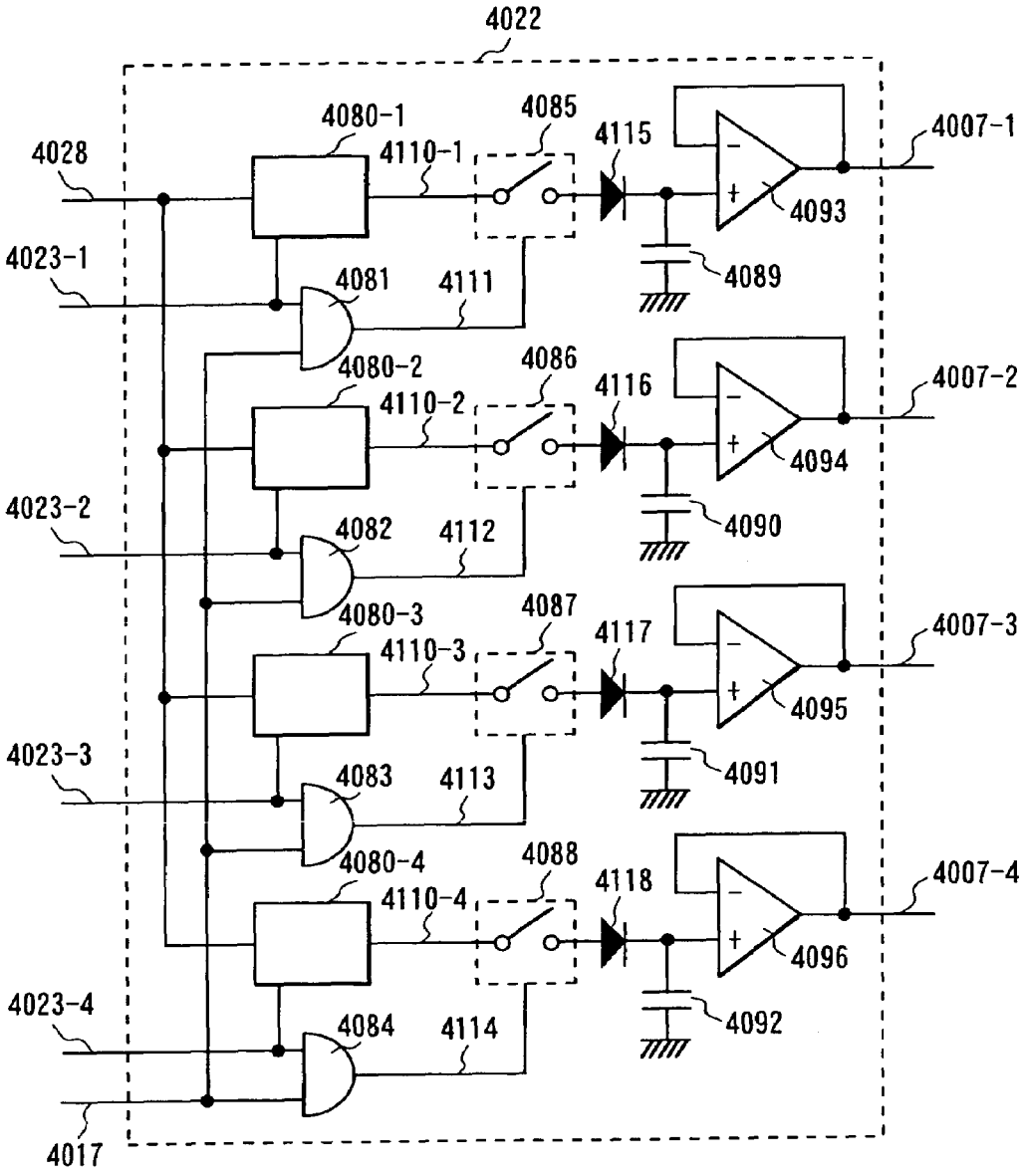
FIG. 48 is a circuit diagram of a unit for converting light-quantity correction data in the corrector of FIG. 41.

FIG. 48 is a block diagram of the light-quantity correction data converting unit 4022 in the corrector 4011 of FIG. 41. This unit 4022 consists of triangular wave generators 4080-1 through 4080-4, AND gates 4081 through 4084, sampling switches 4085 through 4088, hold capacitors 4089 through 4092, OP amplifiers 4093 through 4096, and diodes 4115 through 4118.

Figure 49:
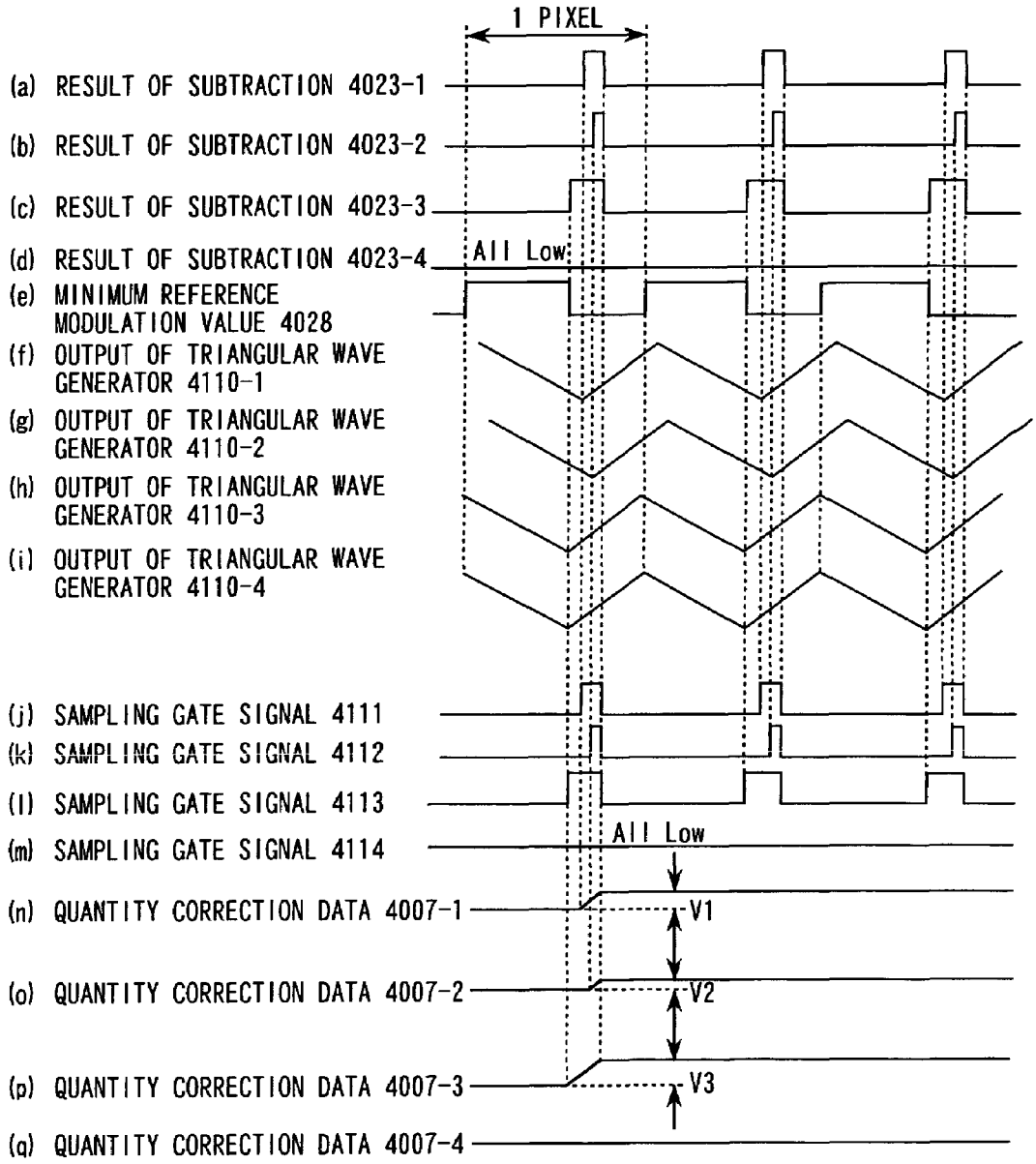
FIG. 49 is a timing chart of operations of the unit for converting light-quantity correction data of FIG. 48.

Referring FIG. 49, the operation of the light-quantity correction data converting unit 4022 of FIG. 48 will be explained. When receiving a Dispersion Correct command 4017 from the printer interface 4012 of FIG. 40, the AND gates 4081 through 4084 in the light-quantity correction data converting unit 4022 generate sampling gate signals 4111 of line (j) through 4114 of line (m) from the results of subtraction 4023-1 in line (a) through 4023-4 in line (d) sent from the subtraction unit 4021 of FIG. 41.

The triangular wave generators 4080-1 through 4080-4 generate triangular waves 4110-1 through 4110-4 at the rises of subtraction values 4023-1 through 4023-4 periodically at intervals of the minimum reference modulation value 4028 as seen in line (e).

The sampling switches 4085 through 4088 send the triangular signals 4110-1 through 4110-4 to the hold capacitors 4089 through 4092 to charge them by the sampling gate signals 4111 in line (j) through 4114 in line (m). In other words, the sampling switches 4085 through 4088 allow triangular signals 4110-1 through 4110-4 to pass while the sampling gate signals 4111 through 4114 are high.

The charge voltages of the hold capacitors 4089 through 4092 are impedance-converted into light-quantity correction data 4007-1 of line (n) through 4007-4 of line (q). The correction values by the light-quantity correction data 4007-1 of line (n) through 4007-4 of line (q) are respectively V1, V2, V3, and 0 in that order.

In this way, the magnitudes of the results of subtraction, that is, the magnitudes of differences of pulse widths between the monitoring driving signals 4014-1 through 4014-4 and the target modulation value 4027 are added to the light-quantity correction data 4007-1 through 4007-4, that is, the amplitudes (peak values) of the laser driving signals 4006-1 to 4006-4 are converted into the magnitudes of light-quantity correction voltages.

Figure 50:
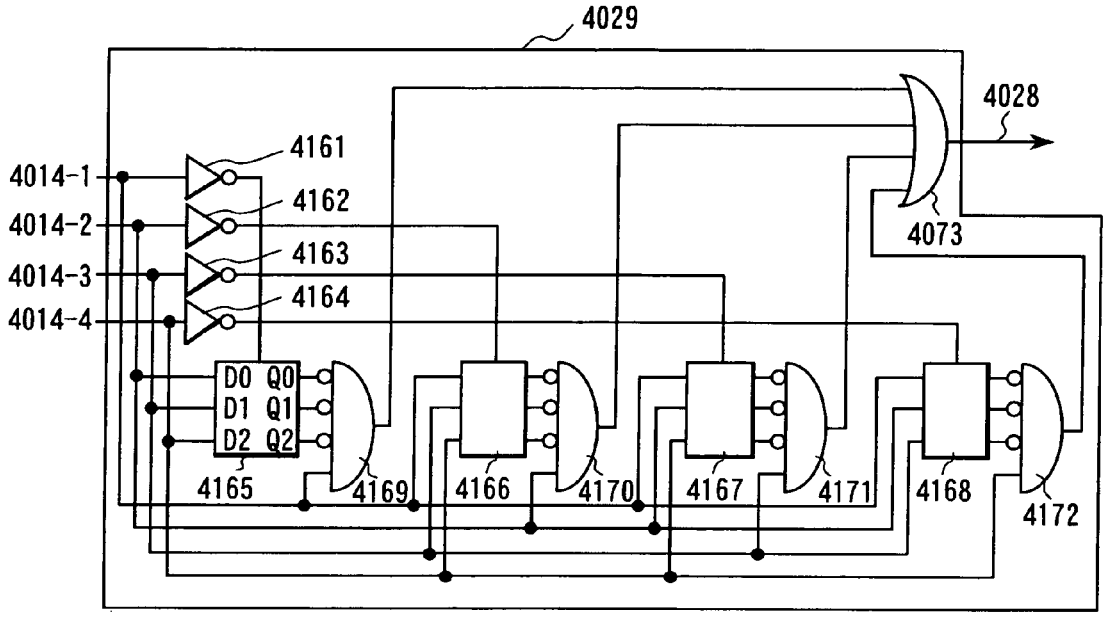
FIG. 50 is a circuit diagram of a minimum value detecting unit in the corrector of FIG. 41.

FIG. 50 is a block diagram of the minimum value or detecting unit 4029 of FIG. 41. The minimum value detecting unit consists of inverters 4161 through 4164, latches 4165 through 4168, AND gates 4169 through 4172, and an OR gate 4173.

The operation of detecting a minimum modulation value 4028 among pulse modulation values of the monitoring driving signals 4014-1 through 4014-4 is not explained here because it is the same as that of detecting a target modulation value 4027, as explained with reference to FIG. 44.

Figure 51:
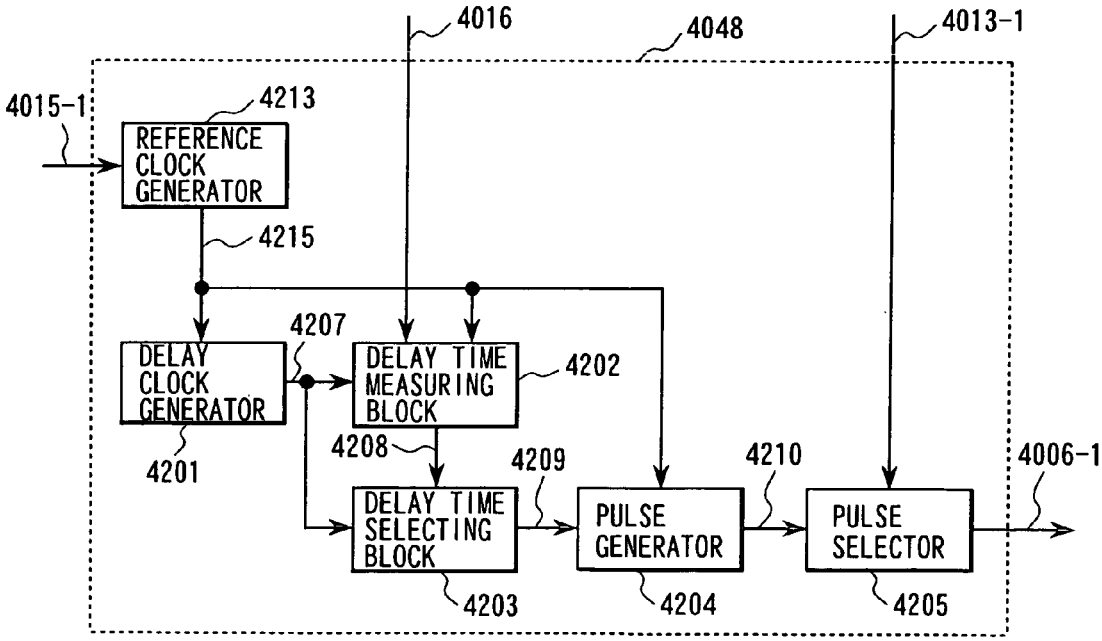
FIG. 51 is a block diagram of a pulse-width modulation (PWM) unit in the controller of FIG. 40.

FIG. 51 is a block diagram of the pulse-width modulation unit PWM4048 of FIG. 40. (The other pulse-width modulation blocks PWM4049 through PWM4051 have the same circuit configuration.) PWM4048 consists of a reference clock generator 4213, a delay clock generator 4201, a delay time measuring block 4202, a delay clock selector 4203, a pulse generator 4204, and a pulse selector 4205.

Figure 52:
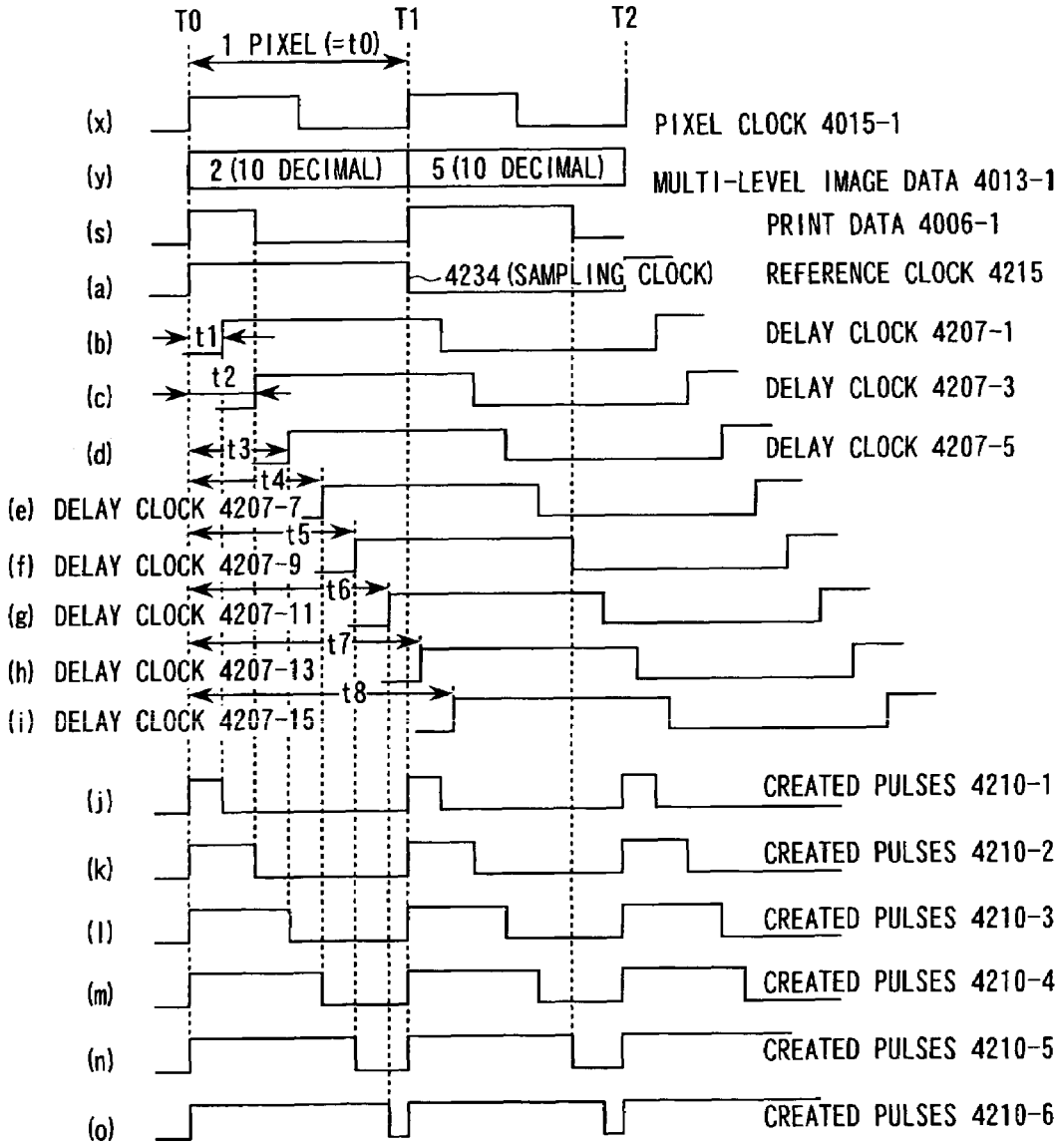
FIG. 52 is a timing diagram of the pulse-width modulation (PWM) unit of FIG. 51.

Referring to FIG. 52, the operation of PWM4048 of FIG. 51 will be explained. The reference clock 4215 (line (a) in FIG. 52) is obtained by dividing the synchronization clock (pixel clock 4015-1) of one pixel by 2. Namely, multi-level image data 4013-1 (line (y) in FIG. 52) is input in synchronism with a pixel clock 4015-1 (line (x) in FIG. 52).

The delay clock generator 4201 generates a plurality of delay clocks 4207 having different delay time periods (line (b) to (i) of FIG. 52). FIG. 52 shows eight odd-numbered delay clocks (4207-1, 4207-3, 4207-5, . . . ) among 16 delay clocks that the delay clock generator 4201 generates. "t1" to "t8" are delay time periods of the eight delay clocks 4207 (lines (b) to (i)) relative to the reference clock 4215.

The delay time measuring unit 4202 measures delay time periods of delay clocks 4207 by the input of a delay time measuring signal periodically or non-periodically, such as at the startup of the device or just before image formation. Namely, the delay time measuring unit 4202 selects a delay clock 4207 to obtain a delay time equivalent to time "t0" of one pixel at the rise (time T1) of the reference clock 4215 as a sampling clock 4234.

In the example, the delay time measuring unit 4202 detects a delay clock 4207-11 in line (t6) and a delay clock 4207-13 in line (t7) which change their signal states (from "0" to "1") just before or after time T1. With this, the delay time measuring block 4202 judges that the delay clock 4207-11 of line (t6) is a delay clock to obtain a delay time equivalent to "t0" and outputs "11" (in decimal) as a delay time measuring value 4208.

The delay clock selector 4203 selects a desired number of delay clocks (among 16 delay clocks 4207 generated) which are within the delay time measurement value 4208. This number of delay clocks is determined according to the maximum tones (resolution) of the input image information or half-tones required by output images.

The example illustrated in the drawing selects and outputs six delay clocks 4209 from the odd-numbered buffer gates among delay clocks 4207-1 through 4207-11 which are in the delay time measurement value 4208 so that the differences of pulse widths of the generated pulses 4210 may be approximately equal to each other (strictly different judging from the characteristics of said buffer gates). To select delay clocks 4209, the user can select so that the ratio of pulse widths of the generated pulses 4210 may be constant in addition to the above method of selection.

The pulse generator 4204 performs logical operations on the reference clock 4215 and the six selected delay clocks 4209 and generates six pulse signals 4210 (lines (j) to (O) in FIG. 52)).

The pulse selector 4205 receives multi-level (8-level) image data 4013-1, selects one of the six generated pulse signals, an all-white pulse signal (of all zeros) and an all-black pulse signal (of all ones) and outputs it as print data 4006-1 which is modulated (pulse-width modulated) along the time base.

In FIG. 52, as the multi-level image data 4013-1 (line (y) in FIG. 52) is "2" (in decimal) during a time period (T0 to T1), the pulse selector 4205 outputs a generated pulse 4210-2 (line (k) in FIG. 52). The signal becomes print data 4006-1 (line (s) in FIG. 52). Similarly as the multi-level image data 4013-1 (line (y) in FIG. 52) is "5" (in decimal) during a time period (T1 to T2), the pulse selector 4205 outputs a generated pulse 4210-5 (line (n) in FIG. 52). The signal becomes print data 4006-1.

This embodiment can obtain a dispersion of laser drive signals (pulse width modulation values) corresponding to multi-level image data in a multi-beam system from the dispersion of pulse-width modulation values of the monitoring laser driving signals which a plurality of PWM4048 through PWM4051 output by a Dispersion Correction signal and can generate light-quantity correction data to correct the dispersion.

With this, the energies of laser beams for print dots become equal to each other and the dispersion of print dot sizes is eliminated according to the image data. Consequently, high-quality multi-level images can be recorded in a multi-beam system.

Although this embodiment eliminates the dispersion in pulse-width modulation of the laser driving signals in a multi-beam image recording system by level correction of pulse peak values of the laser driving signals, the user can correct the dispersion of pulse-width modulation values by equalizing the pulse widths.

Referring to FIG. 53 to FIG. 60, an embodiment will be explained for correcting the dispersion of pulse-width modulation values of laser beams by correction of pulse widths.

Figure 53:
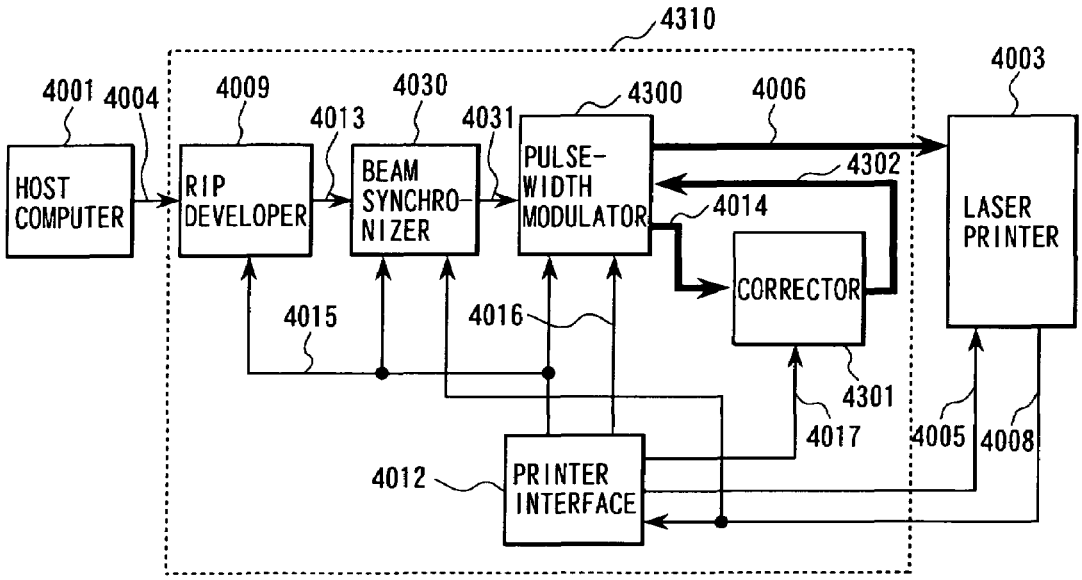
FIG. 53 is a block diagram of a controller according to the present invention.

FIG. 53 is a block diagram of the printer controller 4002 of FIG. 38. The numbers and symbols in FIG. 53 to FIG. 60 are the same as those in FIG. 38 to FIG. 52.

The difference between FIG. 53 and FIG. 39 is that the light-quantity correction data (correction pulse widths) output from the laser driving signal corrector 4301 (substitution for the laser driving signal corrector 4011 of FIG. 39) is fed to the pulse-width modulator (multi-leveling unit) 4300.

The pulse-width modulator 4300 is controlled by the light-quantity correction data which is output from the corrector 4301 so as to correct the dispersion of pulse widths and converts the multi-level image data 4013 into print data (laser driving signal) 4006 by pulse-width modulation. This correction is done to equalize the pulse widths.

To know the dispersion in pulse-width modulation of print data 4006 (laser driving signals) which are output from PWMs in the pulse-width modulator 4300, the corrector 4301 fetches a plurality of monitoring pulse-width modulation values 4014 (monitoring laser driving signals) and converts them into a plurality of light-quantity correction data 4302 (pulse-width correction data).

Figure 54:
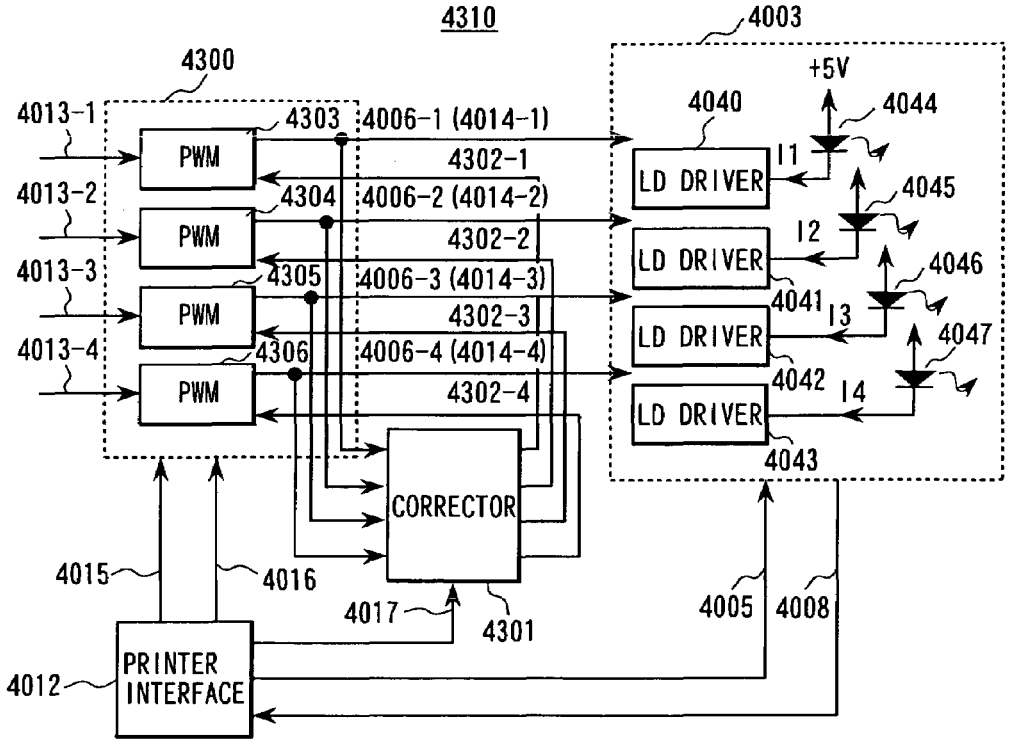
FIG. 54 is a detailed block diagram of the controller of FIG. 53.

FIG. 54 is a the block diagram of the printer controller 4310 of FIG. 53, which uses four laser beams.

The pulse-width modulator 4300 has as many PWMs as laser beams. They are the first PWM 4303, the second PWM 4304, the third PWM 4305, and the fourth PWM 4306. The PWM4303 through PWM4306 respectively convert multi-level image data (4013-1 through 4013-4) into print data (laser driving signals 4006-1 through 4006-4).

The monitoring pulse-width modulation values (monitoring laser driving signals) 4014-1 through 4014-4 which are sent to the corrector 4301 are functionally the same as print data 4006-1 to 4006-4, but are used for monitoring to obtain the dispersion of the pulse widths.

Print data 4006-1 through 4006-4 are sent to the corrector 4301 and at the same time to the LD drivers 4040 through 4043. The light-quantity correction data 4302-1 through 4302-4 output from the corrector 4301 are respectively sent to PWM4303 through PWM4306.

Figure 55:
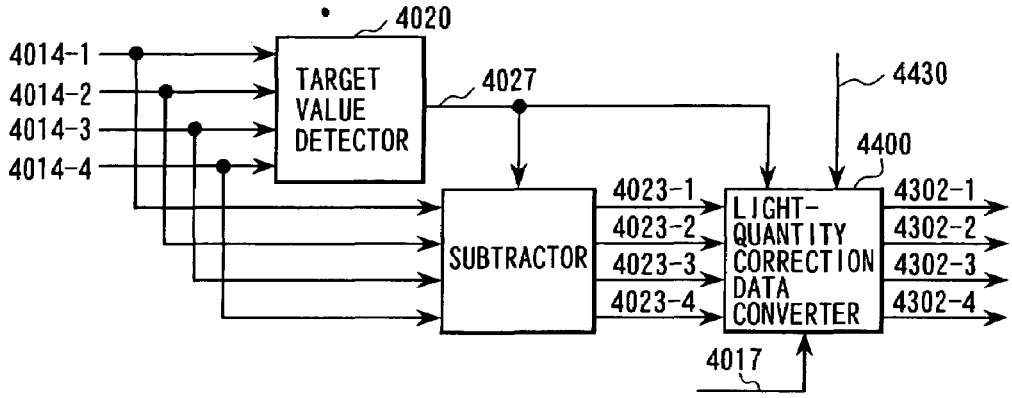
FIG. 55 is a block diagram of a multi-level correction unit in the controller of FIG. 54.

FIG. 55 is a functional block diagram of the corrector 4301 of FIG. 54. The corrector 4301 consists of a target value detecting unit 4020, a subtracting unit 4021, and a light-quantity data converting unit 4400. The target value detecting unit 4020 and the subtracting unit 4021 are functionally the same as those of FIG. 41.

The light-quantity correction data converter 4400 converts the fine clock 4430 and the results of subtraction 4023-1 through 4023-4 into light-quantity correction data 4302-1 through 4302-4 by a Dispersion Correction command 4017.

Figure 56:
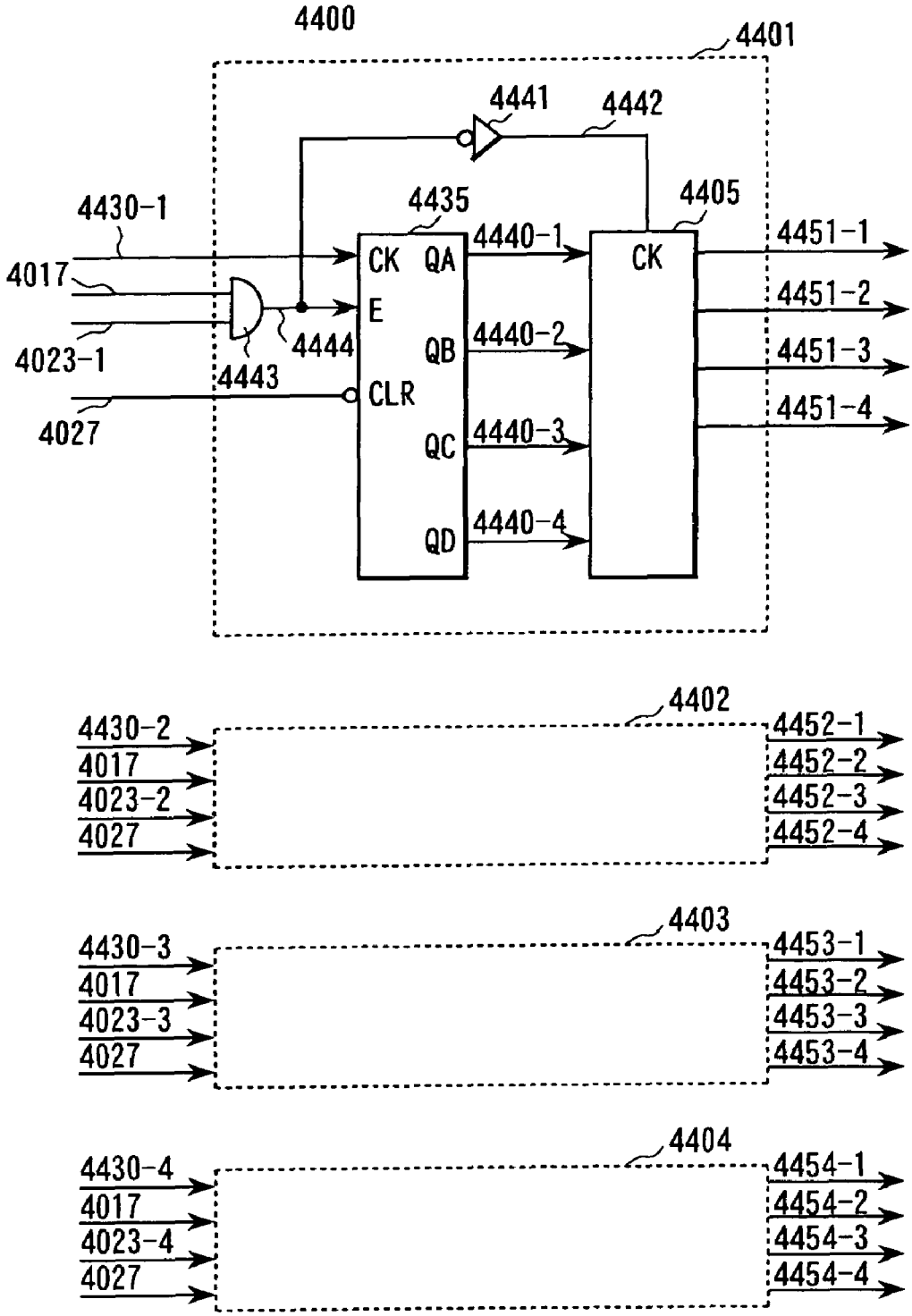
FIG. 56 is a block diagram of a unit for converting light-quantity correction data in the corrector unit of FIG. 55.

FIG. 56 is a functional block diagram of the light-quantity correction data converter 4400 of FIG. 55. The light-quantity correction data converter 4400 consists of four light-quantity correction data converting unit 4401 through 4404. All of these unit 4401 through 4404 are of the same configuration. Each light-quantity correction data converting unit consists of a counter 4435, a latch 4450, an AND gate, and an inverter 4441.

Figure 57:
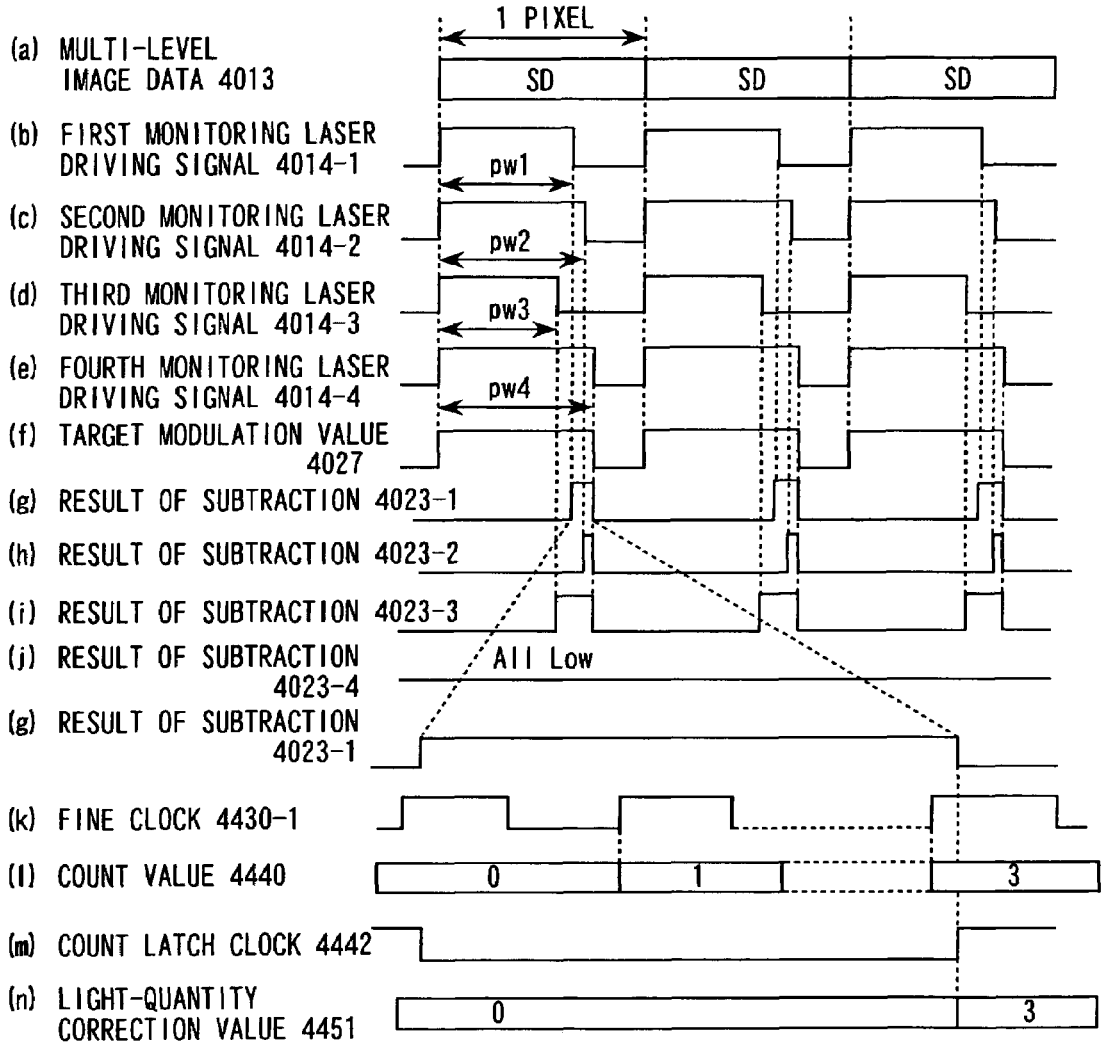
FIG. 57 is a timing diagram of the operations of the unit for converting light-quantity correction data of FIG. 56.

Referring to FIG. 57, the operation of the light-quantity correction data converter of FIG. 56 will be explained with reference to the light-quantity correction data converting unit 4401 as an example.

When receiving a Dispersion Correct command 4017 from the printer interface of FIG. 40, the AND gate 4443 in the light-quantity correction data converting unit 4401 creates a Count Enable signal 4444 from the results of subtraction 4023-1 of line (g) sent from the subtracting unit. The counter 4435 counts the fine clocks 4430-1 while the Count Enable signal 4444 is "1", using the target modulation value 4027 as a Clear signal and outputs the count value 4440. The light-quantity correction value 4451 is equivalent to light-quantity correction data 4302-1 of FIG. 54. In this way, the magnitude of the result of subtraction, that is, a difference between the target modulation value 4027 and the pulse width of a monitoring laser driving signal (4014-1 through 4014-4) is converted into the light-quantity correction data, that is, the magnitude of a light-quantity correction time (count of correction pulse widths).

The other light-quantity correction data converting units 4402 through 4404 perform the same function.

Figure 58:
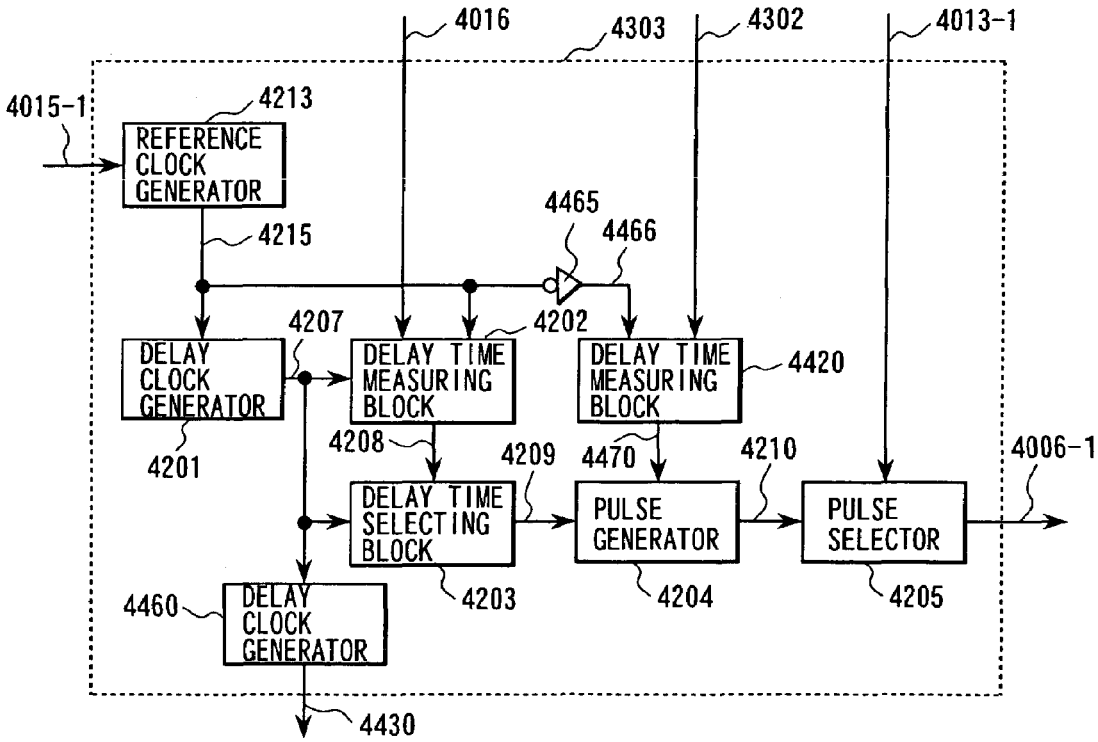
FIG. 58 is a block diagram of a pulse-width modulation (PWM) unit in the control of FIG. 54.

FIG. 58 is a functional block diagram of PWM4303 which is one of the components of the pulse-width modulator 4030 of FIG. 54. The PWM 4303 of FIG. 58 includes a delay time selecting unit 4420, a fine clock generating unit 4460, and an inverter 4465 in addition to the components of FIG. 41.

Figure 59:
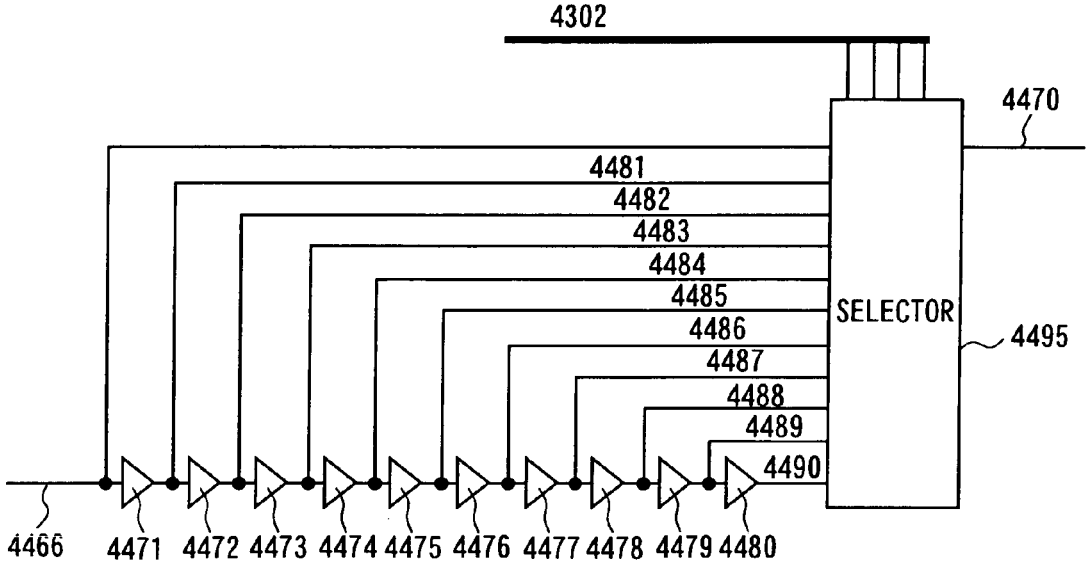
FIG. 59 is a schematic diagram of a delay time selecting unit in the PWM unit of FIG. 58.

FIG. 59 is a functional block diagram of the delay time selecting unit 4420. It consists of buffer gates 4471 through 4480 and a selector 4495.

Figure 60:
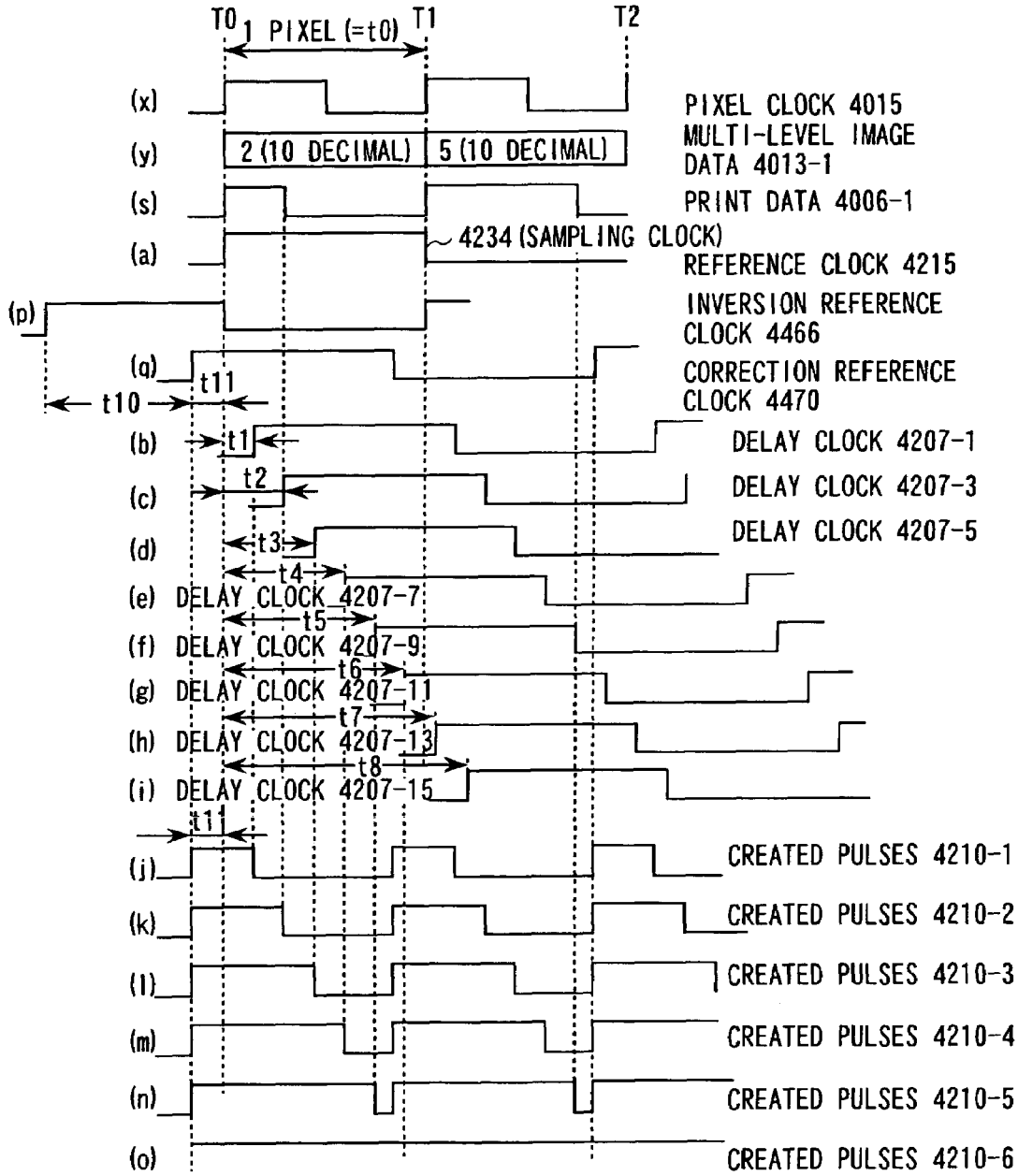
FIG. 60 is a timing diagram of a the operation of the pulse-width modulation (PWM) unit in the controller of FIG. 54.

Referring to FIG. 60, the operation of the PWM4303 of FIG. 58 will be explained. FIG. 60 shows the waveforms of operations of the PWM4303 of FIG. 58, and the difference between FIG. 60 and FIG. 52 is that the inversion reference clock 4466 of line (p) and the correction reference clock 4470 of line (q) are added and that the generation pulses 4210 of line (j) to (o) have different pulse widths.

The inverter 4465 inverts the reference clock 4215 of line (a) into an inverted reference clock 4466 of line (p). The delay time selecting unit 4420 delays the inversion reference clock 4466 of line (p) by a time period "t10" according to the light-quantity correction data 4302 and generates a correction reference clock 4470.

This function is executed by the selector 4495 of FIG. 59. The pulse generator 4204 creates the generation pulses 4210 of lines (j) to (o) from the correction reference clock 4470 and the selection delay clock 4209. As the time difference "t11" between the reference clock 4215 of line (a) and the correction reference clock 4470 of line (q) is equivalent to the result of subtraction 4023-1 of line (g) of FIG. 57, the generated pulse has a pulse width which has been increased by "t11", as seen in FIG. 60, by this correction.

This embodiment also gets a dispersion in the laser driving signals (pulse-width modulation values) according to multi-level image data in the multi-beam system and generates light-quantity correction data (pulse-width correction values) to correct this dispersion. With this, the power energies of beams for print dots are equalized and, consequently, the sizes of print dots are corrected and formed according to the image data. Thus, high-quality multi-level images can be obtained in the multi-beam image recording system.

Figure 61:
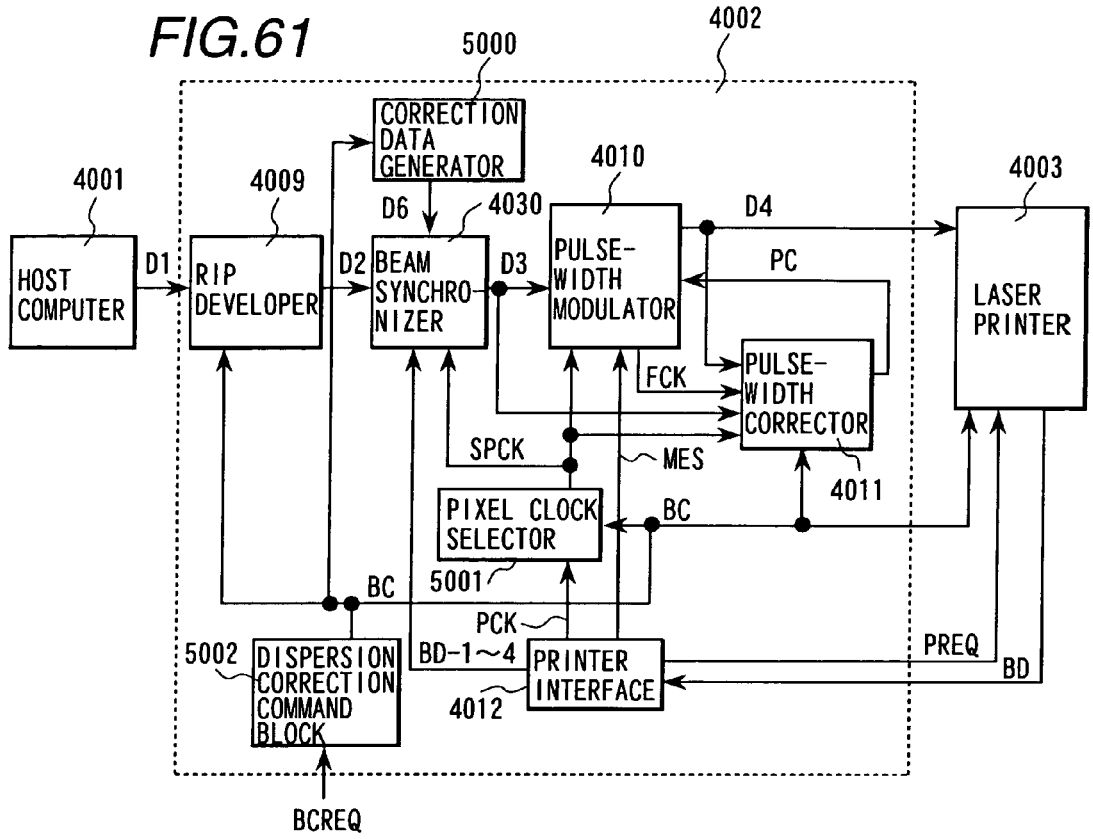
FIG. 61 is a block diagram of a controller according to the present invention.
Figure 62:
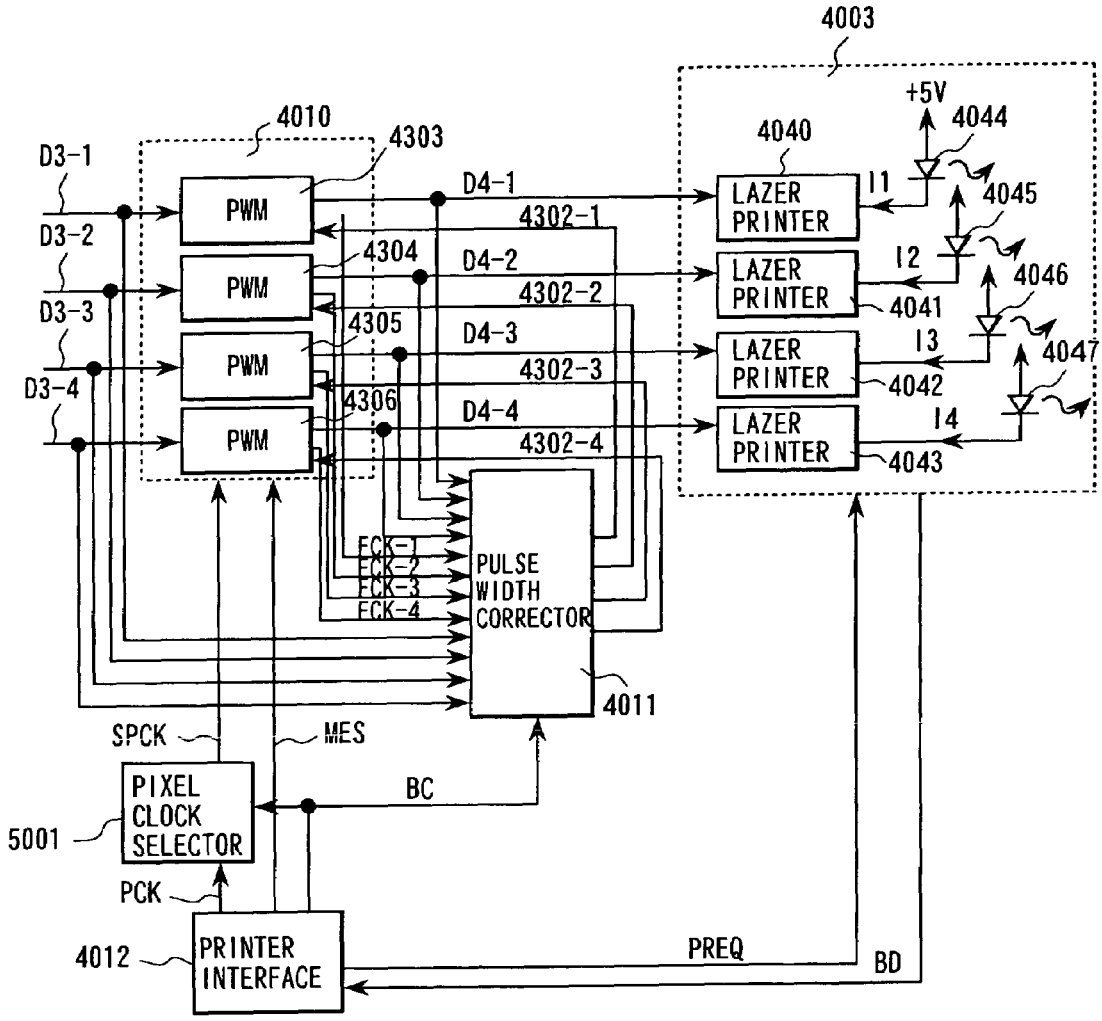
FIG. 62 shows a detailed block diagram of the controller of FIG. 61.

Another embodiment of the present invention is illustrated in FIG. 61 and FIG. 62. FIG. 62 shows the details of the pulse-width modulation device 4010 and the laser printer 4003 of FIG. 61. This example uses four laser beams to scan.

In FIG. 61, the printer controller 4002 consists of an RIP expansion unit 4009, a correction data generator 5000, a beam synchronizer 4030, a pulse-width modulator 4010, a signal corrector 4011, an image clock selector 5001, a Dispersion Correction command generator 5002 and a printer interface 4012.

The RIP expansion unit 4009 receives image data D1 which is page description data from the host computer 4001, expands it page by page into a raster image which is a 2-dimensional image data array and outputs it as multi-level image data D2 which can be expressed with half tones to the beam synchronizer 4030.

The beam synchronizer 4030 synchronizes the multi-level image data D2 with the beam detection signals BD (BD-1 through BD-4) of the four laser beams and outputs the resulting signals (multi-level image data D3-1 through D3-4) to the pulse-width modulator 4010. The pulse-width modulator 4010 modulates the pulse-widths of the image data D3-1 through D3-4 and outputs the resulting pulses as print data D4-1 through D4-4 to the laser printer 4003. The pulse-width modulator 4010 requires as many pulse generators (pulse-width modulating blocks 4048 through 4051) as the number of laser beams which the laser printer 4003 uses.

When receiving a Dispersion Correction command BC, the corrector 4011 gets light-quantity correction data (pulse width correction values) of PWM4048 through PWM4051 (as will be explained later) and outputs the resulting signals to the pulse-width modulator 4010. When receiving a Dispersion Correction command BC, the image clock selector 5001 selects one of the image clocks PCK1 through PCK4 sent from the printer interface 4012 and outputs the resulting signals as the selected image clocks SPCK to the beam synchronizer 4030 and to the pulse-width modulator 4010. The Dispersion Correction command generator 5002 outputs a Dispersion Correction command BC when the device is powered on or when a Dispersion Correction command requesting signal BCREQ is entered from the outside.

The printer interface 4012 sends a print request signal PREQ to the laser printer 4003. Simultaneously, when receiving a beam detection signal BD, the printer interface 4012 isolates beam synchronization signals BD-1 through BD-4 from the beam detection signal BD and generates image clocks PCK in synchronism with the beam synchronization signals BD-1 through BD-4. The laser printer 4003 receives the modulated print data D4-1 to D4-4 from the pulse-width modulator 4010 (as illustrated in FIG. 62) and supplies driving currents I1 through I4 to the laser diodes LD 4044 through 4047.

Figure 63:
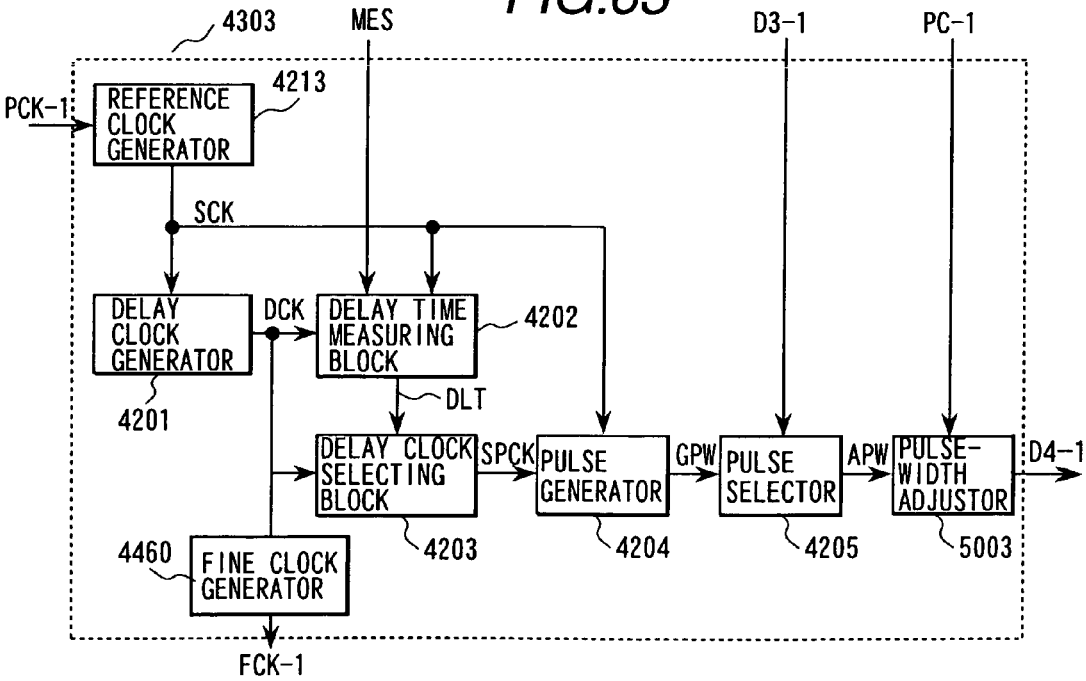
FIG. 63 is a block diagram of a pulse-width modulation (PWM) unit in the controller of FIG. 62.

FIG. 63 is a functional block diagram of the PWM4048. In FIG. 63, the PWM4048 consists of a reference clock generator 4213, a delay clock generator 4201, a delay time measuring unit 4202, a delay clock selector 4203, a pulse generator 4204, a pulse selector 4205 and a fine clock generator 4430. The reference clock generator 4213 receives image clock PCK-1 and generates a reference clock SCK.

The delay clock generator 4201 receives the reference clock SCK and generates a plurality of delay clocks DCK having different delay times.

When receiving a Measure Delay Time command signal MES, the delay time measuring unit 4202 measures the delay time of each delay clock DCK periodically or non-periodically when the device starts up or just before image formation. The delay clock selector 4203 generates a selected delay clock SDCK depending upon the result of measurement DLT from the delay clocks DCK. The pulse generator 4204 performs logical operations on the reference clock and a plurality of selected delay clocks SDCK and generates a plurality of pulses GPW.

The pulse selector 4205 receives multi-level image data D3-1, selects one of a plurality of generated pulses GPW, an all-white pulse signal (of all zeros) and an all-black pulse signal (of all ones) and outputs it as print data APW which is modulated (pulse-width modulated) along the time base.

Figure 64:
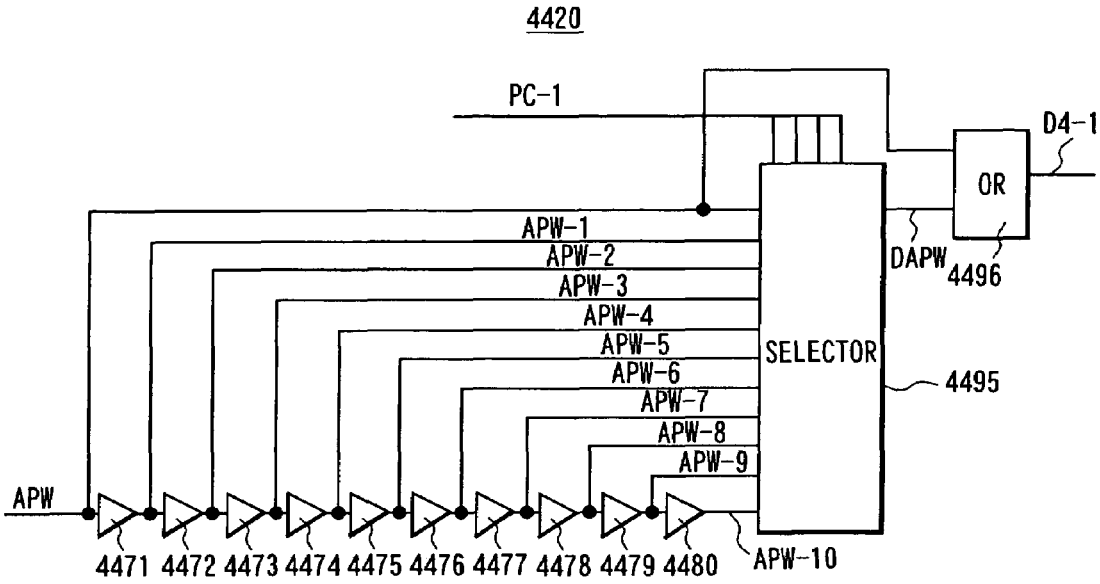
FIG. 64 is a schematic diagram of a pulse-width adjusting unit in the controller of FIG. 63.

The pulse-width adjuster 5003 consists of ten serially-connected buffer gates (delay elements) 4471 through 4480 as illustrated in FIG. 64. The pulse-width adjuster 5003 selects one of the outputs APW-1 through APW-10 from the delay elements 4471 through 4480 according to the light-quantity correction PC-1, changes the pulse width of the print data APW, and generates print data D4-1.

Figure 65:
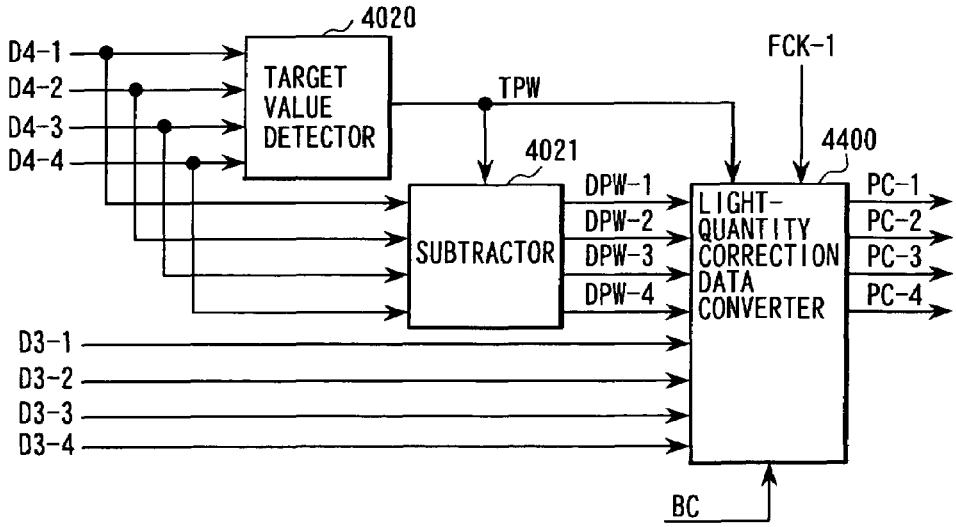
FIG. 65 is a block diagram of a pulse-width correcting device in the controller of FIG. 61.

FIG. 65 shows another embodiment of the corrector 4011. As seen in FIG. 65, the corrector 4011 consists of a target value setting unit 4020, a subtracting unit 4021, and a light-quantity data converting unit 4400.

The target value setting unit 4020 selects (sets), as a reference pulse width, one of the print data D4-1 through D4-4 sent from PWM4303 through PWM4306 in the pulse-width modulator 4010 and outputs it as a target modulation value TPW to the subtraction unit 4021 and to the light-quantity correction data converting unit 4400. Although this example sets print data having the greatest pulse width among print data D4-1 through D4-4 as a target value, the user can select print data having any pulse width. The subtraction unit 4021 takes a pulse-width difference between the target modulation value and print data D4-1 through D4-4 and outputs the result (DPW-L through DPW-4) to the light-quantity correction data converter.

Upon receipt of a Dispersion Correction command BC, the light-quantity correction data converter 4400 converts the results of subtraction DPW-1 through DPW4 into light-quantity correction data PC-1 through PC4. In this way, the corrector 4011 fetches print data D4-1 through D4-4 from PWM4303 through PWM4306 in the pulse-width modulator 4010 and gets a plurality of light-quantity correction data PC-1 through PC-4 (pulse-width correction data).

Figure 66:
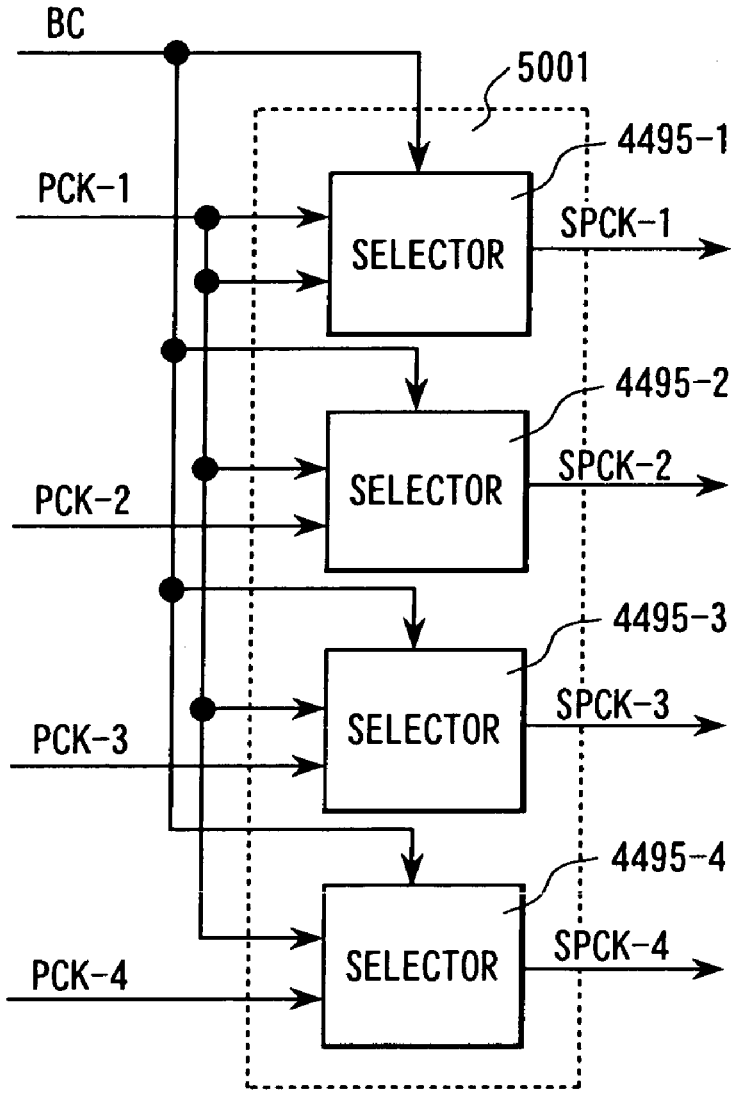
FIG. 66 is a block diagram of an image clock selecting unit in the controller of FIG. 61.

FIG. 66 is a block diagram of the pixel clock selector 5001. The pixel clock selector 5001 consists of four selectors 4495-1 through 4495-4. During normal printing, the pixel clock selector 5001 receives pixel clocks PCK-1 through PCK-4 sent from the printer interface 4012 and outputs the selected pixel clocks SPCK-1 through SPCK-4. Upon receipt of a Dispersion Correction command BC, the selectors 4495-1 through 4495-4 respectively select pixel clocks PCK-1 and output the selected pixel clocks SPCK-1 through SPCK-4 (=PCK-1).

First signal operations for normal printing will be explained with reference to FIG. 67.

The image data D1 created by the host computer 4001 is sent to the RIP expansion unit 4009 through a network or the like. The RIP expansion unit 4009 receives image data D1, which is page description data, expands it page by page into a raster image, which is an array of 2-dimensional image data, and stores it as multi-level image data D2 which can be expressed with half-tones. When the multi-level image data D2 is stored in the RIP expansion unit 4009, the printer interface 4012 sends a print-request signal PREQ to the laser printer. When receiving this signal PREQ, the laser printer 4003 outputs a beam detection signal BD (illustrated in FIG. 67 at line (a)).

Figure 67:
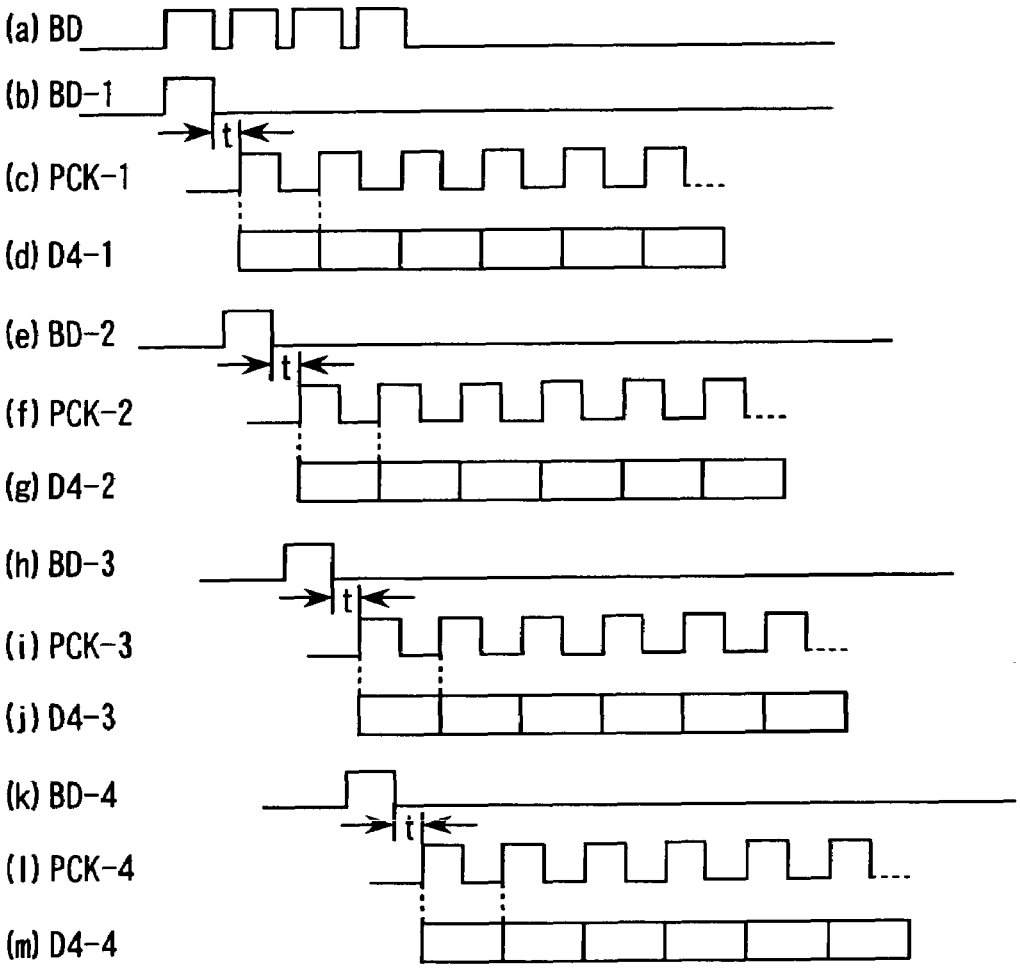
FIG. 67 is a timing diagram of the operation of an image recording device according to the present invention.

When receiving a beam detection signal BD, the printer interface 4012 separates beam detection signals BD-1 through BD-4 as illustrated in FIG. 67 at lines (b), (e), (h), and (k), outputs the signals and generates pixel clocks PCK-1 through PCK-4 (illustrated in FIG. 67 at lines (c), (f), (i), and (l)) in synchronism with the beam detection signals BD-1 through BD-4.

FIG. 67 shows the relationship of beam detection signals BD-1 through BD-4 of the laser printer 4003, image data D4-1 through D4-4 from the pulse-width modulator 4010, and pixel clocks PCK-1 through PCK-4.

The printer interface 4012 generates the first pixel clock PCK-1 with a delay "t" after the first beam detection signal BD-1 which is separated from the beam detection signal BD and generates the first image data D4-1 in synchronism with the first pixel clock PCK-1. Similarly, the printer interface 4012 generates the second image data D4-2 in synchronism with the second beam detection signal BD-2, the third image data D4-3 in synchronism with the third beam detection signal BD-3, and the fourth image data D4-4 in synchronism with the fourth beam detection signal BD-4. The synchronism of beam detection signals BD-1 through BD-4 with image data D4-1 through D4-4 assumes that the delay "t" can be ignored substantially.

Usually during normal printing, the Dispersion Correction command BC of the Dispersion Correction command unit 5002 is at level "0" and the pixel clock selector 5001 outputs pixel clocks PCK-1 through PCK-4 in synchronism with the beam detection signals BD-1 through BD-4 as the selected pixel clocks SPCK-1 through SPCK-4.

The beam synchronizer 4030 receives multi-level image data D2 from the RIP expansion unit 4009, causes the image data to be in synchronism with beam detection signals BD-1 through BD-4 by the selected pixel clocks SPCK-1 through SPCK-4, and outputs the resulting signals (multi-level image signals D3-1 through D3-4) to the pulse-width modulator 4010.

As the pulse-width dispersion is corrected by the corrector 4011, the pulse-width modulator 4010 converts the multi-level image data D3-1 through D3-4 into the pulse-width-modulated print data D4-1 through D4-4 and outputs the resulting signals to the laser printer 4003. With the print data D4-1 through D4-4 having no dispersion in pulse-width, the laser printer 4003 can print with uniform print dot sizes.

Figure 68:
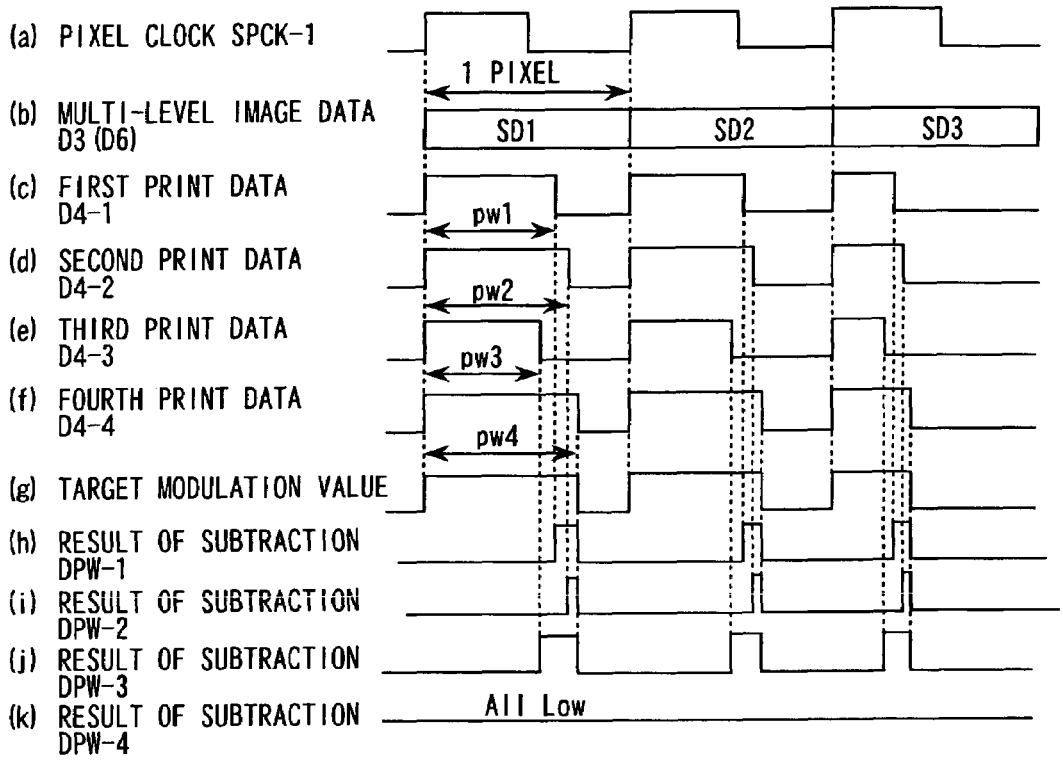
FIG. 68 is a timing diagram of the operation of an image recording device according to the present invention.
Figure 69:
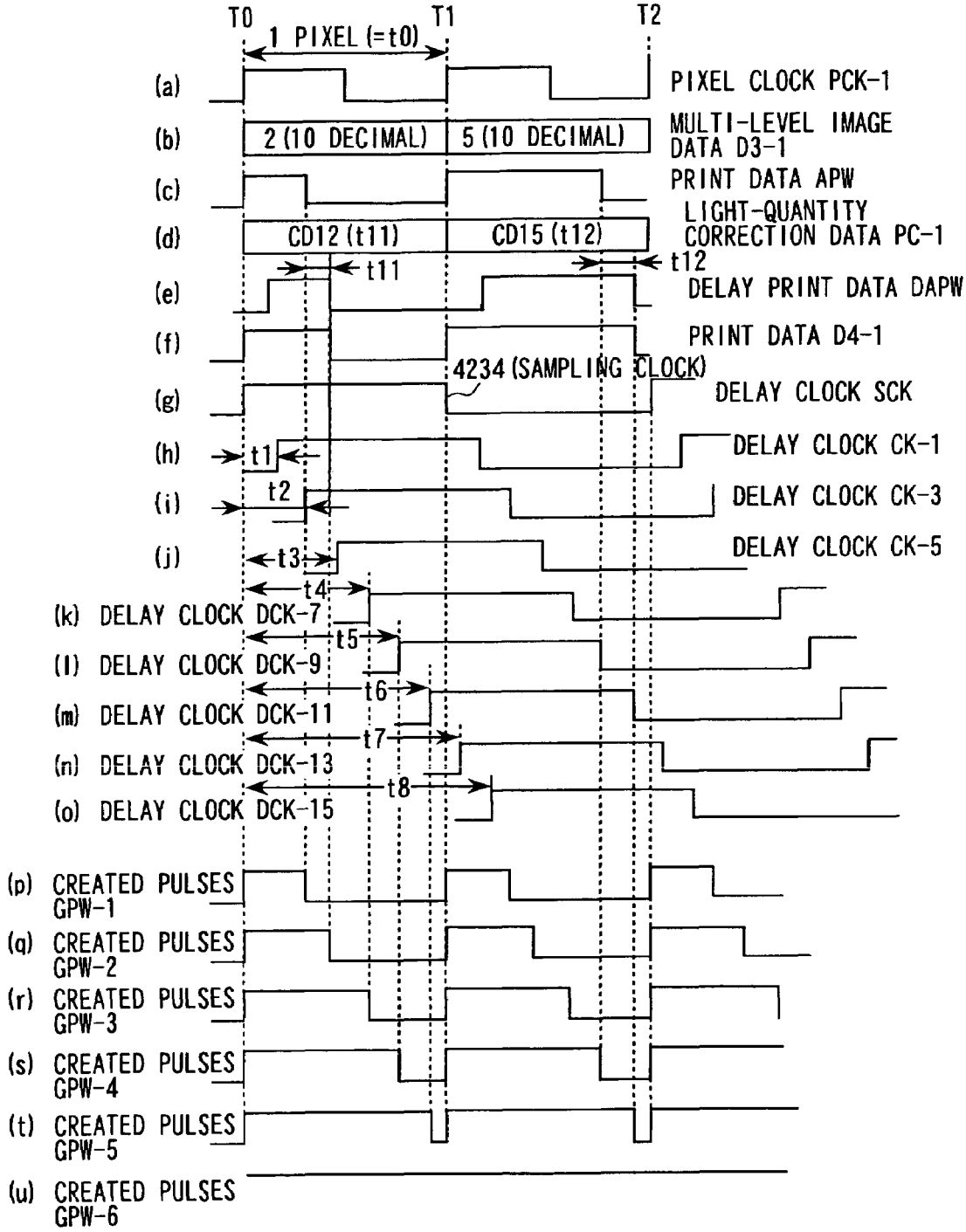
FIG. 69 is a timing diagram of the operation of the pulse-width modulation (PWM) unit in the controller of FIG. 62.

Referring to FIG. 68 and FIG. 69, there will be explained a method of correcting the pulse-width dispersion of the pulse-width modulator 4010.

For correction of a pulse-width dispersion, the Dispersion Correction command unit 5002 submits a Dispersion Correction command BC of "1. "The Dispersion Correction command generator 5002 outputs a Dispersion Correction command BC when the device is powered on or when a Dispersion Correction command requesting signal BCREQ is received from the outside.

When the Dispersion Correction command BC is fed to the laser printer, the laser printer 4003 sends a beam detection signal BD to the printer interface 4012. The printer interface generates pixel clocks PCK-1 through PCK-4 as well as in the normal printing operation.

When the pulse-width dispersion is corrected, the Dispersion Correction command BC is at level "1" and consequently all selected pixel clocks SPCK-1 through SPCK-4 from the pixel clock selector 5001 are equal to the first pixel clock PCK-1 as illustrated in FIG. 68 at line (a).

The correction data D6 generated by the correction data generating block 5000 in response to the Dispersion Correction command BC is output to the beam synchronizer 4030 to stop the multi-level image data D2 from the RIP expansion unit 4009.

The beam synchronizer 4030 outputs multi-level image data D3 (correction data D6) in synchronism with the first pixel clock PCK-1, as illustrated in FIG. 68 at line (b). Similarly, PWM4303 through PWM4306 output print data D4-1 through D4-4 in synchronism with the first pixel clock PCK-1, as illustrated in FIG. 68 in lines (c) through (f).

As explained above, the pulse-width dispersion can be corrected by print data D4-1 through D4-4 output from PWM4303 through PWM4306 in synchronism with any of the pixel clocks PCK-1 through PCK-4.

Although print data D4 is output also when the pulse-width dispersion is corrected, printing is not performed as the Print Request signal PREQ is not fed to the laser printer 4003.

As illustrated in FIG. 58 in lines (c) through (f), print data D4-1 through D4-4 have different pulse widths pw1 through pw4. This operation and correction according to the present invention will be explained with reference to FIG. 70.

Figure 70:
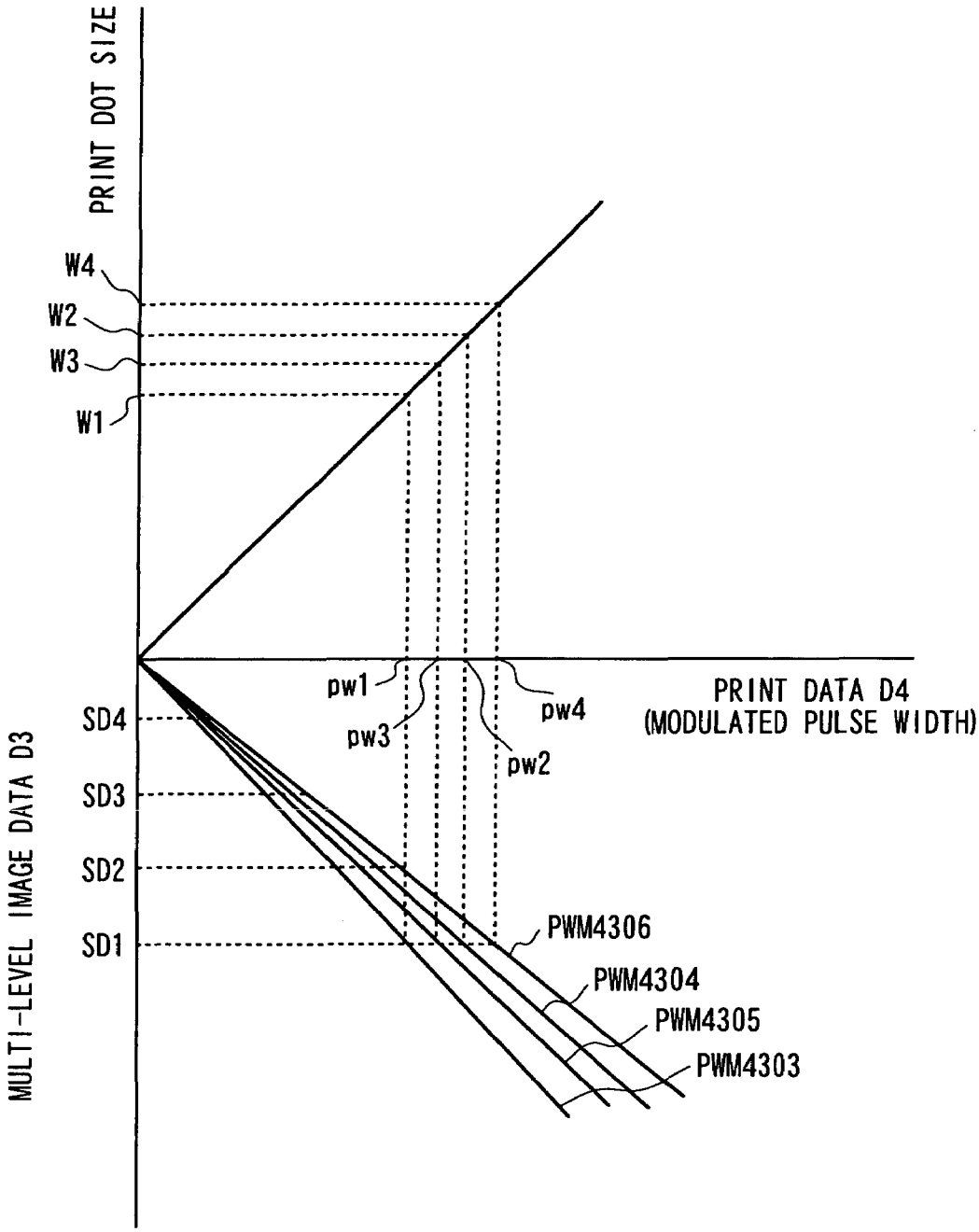
FIG. 70 is a diagram showing the relationship between image data and print dot sizes according to the present invention.

FIG. 70 is a characteristic graph representing the relationship of multi-level image data D3 fed to PWM4303 through PWM4306, print data output from PWM4303 through PWM4306 and sizes of dots in the main scanning direction which are printed on the recording sheet by LD light sources 4044 through 4047.

As the number of PWMs in the pulse-width modulator increases, the relationship between the multi-level image data D3 and the print data D4 changes as illustrated in FIG. 70.

For example, when monitor image data SDI is entered as multi-level image data D3, the pulse-width modulation values (print data) D4-1 through D4-4 output from PWM4303 through PWM4306 have pulse-widths pw1 through pw4. As a result, the print sizes are W1 through W4.

According to the present invention, the pulse-width pw4 of the pulse-width modulation value D4-1 output from PWM4306 is set to a target modulation value (reference pulse-width) TPW and light-quantity correction data PC-1 through PC-4 are generated according to the differences "pw4−pw1," "pw4−pw2," and "pw4−pw3." In other words, the print dot size W4 can be set for any laser beam by generating the light-quantity correction data PC so that the differences "pw4−pw1," "pw4−pw2," and "pw4−pw3" may be 0 (by equalizing the pulse widths pw1, pw2, pw3, and pw4).

Although FIG. 70 assumes that multi-level image data D3 is linearly proportional to print data D4, this correction method is also applicable when the relationship between multi-level image data D3 and print data D4 is non-linear.

The above-mentioned pulse-width dispersion correction will be explained in detail with reference to FIG. 68.

When a Dispersion Correction command BC is generated, the pulse-width modulator receives multi-level image data D3 (illustrated in FIG. 68 at line (b)) in synchronism with the pixel clock SPCK-1 (illustrated in FIG. 68 at line (a)) and outputs print data D4-1 through D4-4 (illustrated in FIG. 68 at lines (c) through (f)) in synchronism with the pixel clock SPCK-1.

The target value setting unit 4020 selects one of the print data (pulse data) D4-1 through D4-4 output from PWM4048 through PWM4051 in the pulse-width modulator 4010 as a reference value used for calculation of dispersions in the pulse-width modulation and outputs this as a target modulation value TPW (reference pulse-width modulation value) to the subtraction unit 4021 and to the light-quantity correction data converting unit 4400.

FIG. 68 uses the print data D4-4 (illustrated in FIG. 68 at line (g)) having the greatest pulse width among print data D4-1 through D4-4 as a target value TPW. The user can select print data having any pulse width as a target value TPW.

The subtracting block 4021 takes a pulse-width difference between the target value TPW and each value of print data D4-1 through D4-4 and outputs the result (DPW-1 to DPW-4 (illustrated in FIG. 68 at lines (h) to (k)) to the light-quantity correction data converter. In this way, the magnitude of the results of subtraction, that is, the size of the pulse-width difference between the target value TPW and each value of print data D4-1 through D4-4 is converted into the magnitude of the light-quantity correction data, that is, the magnitude of the light-quantity correction time period.

The operation of PWM4303 for correcting print data D4-1 using this light-quantity correction data PC-1 will be explained with reference to FIG. 69. The reference clock SCK (line (g) in FIG. 69) is obtained by dividing the pixel clock PCK-1 by 2. FIG. 69 shows eight odd-numbered delay clocks (DCK-1, DCK-3, DCK-5, . . . ) among 16 delay clocks which the delay clock generator 4201 generates (lines (h) to (o) of FIG. 69).

The delay time measuring block 4202 measures delay time periods of delay clocks DCK by the input of a delay time measuring command signal MES periodically or non-periodically, such as at the startup of the device or just before image formation. Namely, the delay time measuring unit 4202 selects a delay clock DCK to obtain a delay time equivalent to time "t0" of one pixel at the rise (time T1) of reference clock 4215 as a sampling clock 4234.

In the example, the delay time measuring unit 4202 detects a delay clock DCK-11 (t6) and a delay clock DCK-13 (t7) which change their signal states (from "1" to "0") just before or after time T1. With this, the delay time measuring unit 4202 judges that the delay clock DCK-11 (t6) is a delay clock which will provide a delay time equivalent to "t0" and outputs "11" (in decimal) as a delay time measuring value 4208.

The delay clock selector 4203 selects a desired number of delay clocks (among 16 delay clocks DCK generated) which are within the delay time measurement value DLT. This number of delay clocks is determined according to the maximum tones (resolution) of the input image information or half-tones required by output images.

The example illustrated in the drawing selects and outputs six delay clocks SDCK from the odd-numbered buffer gates among delay clocks DCK-1 through DCK-11 which are in the delay time measurement value DLT so that the differences of pulse widths of the generated pulses GPW may be approximately equal to each other (as illustrated in FIG. 69 at lines (p) through (u)).

To select delay clocks SDCK, the user can make a selection so that the ratio of pulse widths of the generated pulses GPW may be constant in addition to the above method of selection.

The pulse generator 4204 performs logical operations on the reference clock SCK and the six selected delay clocks SDCK and generates six pulse signals GPW-1 through GPW-6 (lines (p) to (u) in FIG. 69)).

The pulse selector 4205 receives multi-level (8-level) image data D3-1, selects one of the six generated pulse signals 4210, an all-white pulse signal (of all zeros) and an all-black pulse signal (of all ones) and outputs it as print data APW which is modulated (pulse-width modulated) along the time base.

In FIG. 69, as the multi-level image data D3-1 (line (b) in FIG. 69) is "2" (in decimal) during a time period (T0 to T1), the pulse selector 4205 outputs a generated pulse GPW-2 (line (q) in FIG. 69). The signal becomes print data APW (line (c) in FIG. 69). Similarly as the multi-level image data D3-1 (line (b) in FIG. 69) "5" (in decimal) during a time period (T1 to T2), the pulse selector 4205 outputs a generated pulse GPW-5 (line (t) in FIG. 69). The signal becomes print data APW.

The pulse width adjusting block 5003 delays print data APW-1 (line (c) in FIG. 69) by a time period set by the light-quantity correction data PC-1 and generates delayed print data DAPW (line (e) in FIG. 69). The selector 4495 of FIG. 64 executes this function.

Accordingly, as the time differences "t11" and "t12" between the print data APW (line (c) in FIG. 69) and the reference clock SCK are equivalent to the result of subtraction DPW-1 (line (h) in FIG. 69), the generated print data D4-1 has its pulse width increased by "t11" and "t12" (line (e) in FIG. 69) by this correction.

In this way, the pulse-width correction is performed in a multi-beam image recording device by modulating pulse widths in synchronism with outputs of the PWM pulse generating block, obtaining their dispersion, and correcting the pulse-widths according to this dispersion. This equalizes the energies of the laser beams forming print dots and consequently enables high-quality image printing. Further, as this method uses the pulse-width of one of the pulse signals (print data) output from the PWMs as the reference pulse width, the user need not provide an extra unit to set a reference pulse-width. Further, the user can cause a plurality of PWMs to perform pulse-width modulation in synchronism, that is, to restrict pulse-width modulation just by selecting a pixel clock.

Figure 71:
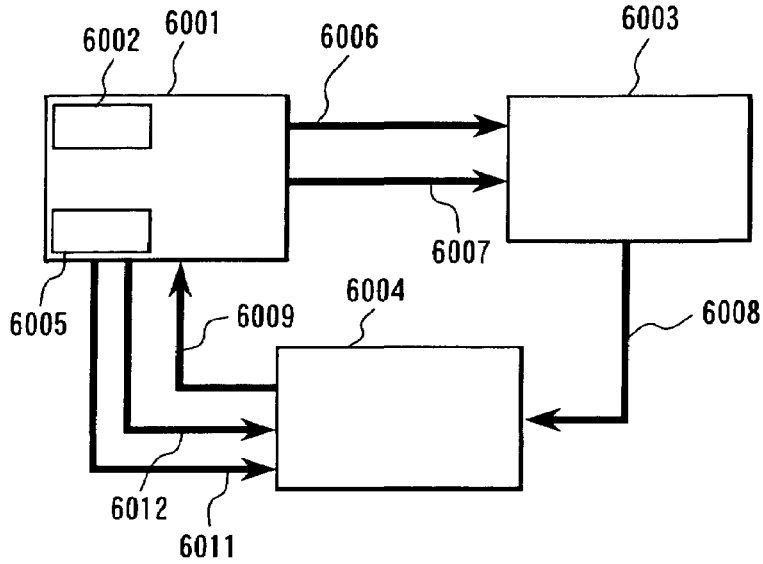
FIG. 71 is a block diagram of an image clock selecting unit according to the present invention.

Another embodiment of the present invention will be explained below with reference to the drawings. FIG. 71 is a functional block diagram of the printer system according to the present invention. The printer system consists of a printer controller 6001 for controlling the whole system, an operation unit 6005 through which the user enters instructions, main storage unit 6002 for storing information which the printer controller 6001 requires, a printer engine 6003 having n laser beams for printing data, beam-detection signals 6008 which the printer engine 6003 outputs when detecting laser beams (n beams), a signal position controller 6004 for controlling the positions of the beam detection signals 6008, binary or multi-level image data 6006 (n data lines), an engine control signal 6007 which the controller 6001 uses to control the printer engine, beam detection signals 6009 controlled by the signal position controller 6004, control signals 6011 which the controller 6001 uses to control the laser beam detection position controller 6004, and a user-set position control signal 6012 which is stored in the main storage 6002.

The main storage 6002 stores data of a test chart having basic areas in which a basic pattern 6101 is repeated an arbitrary number of times in the main and subsidiary scanning directions. The basic pattern is characterized in that a pattern having "n×m" dots (where "n" and "m" are integers) in the subsidiary scanning direction and any number of dots in the main scanning line is repeated twice or more in succession, in that their boundary is moved one dot leftward, rigtward, and both leftward and rightward in the main scanning direction, and in that the upper and lower beams on the boundary are made up by all possible combinations of beams.

Figure 79:
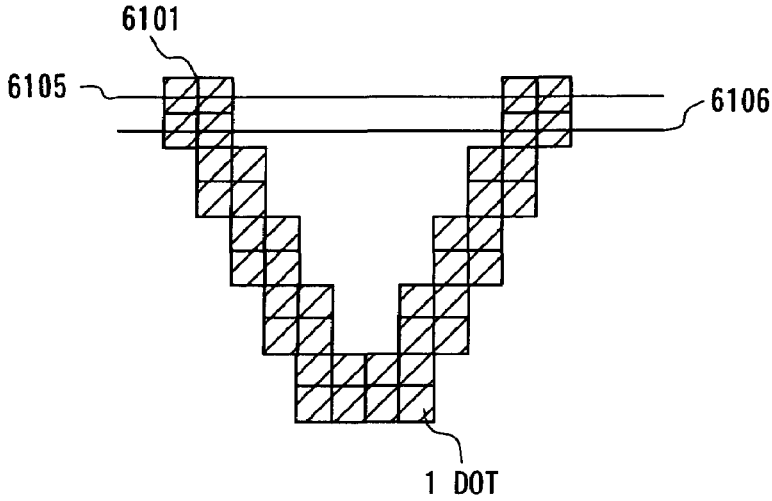
FIG. 79 is a diagram of a basic pattern according to the present invention.

FIG. 79 shows one example of such basic pattern 6101 used in a 2-laser image recording device. The basic pattern 6101 repeats a 2×2 unit pattern (2 dots in the subsidiary scanning direction and 2 dots in the main scanning direction) five times in the subsidiary scanning direction with the unit pattern moved leftward or rightward (in the main scanning direction) by one dot for each subsidiary scanning.

Figure 81A:
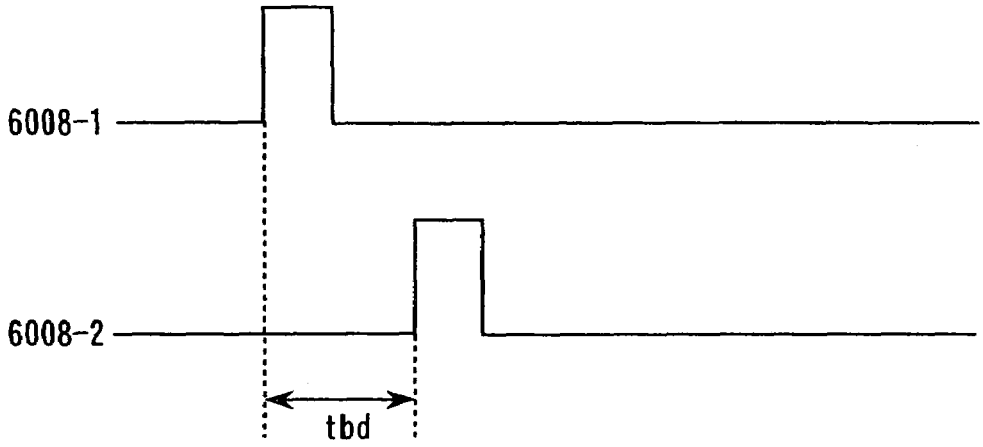
FIG. 81(*a*) is a signal timing diagram and FIG. 81(*b*) is a diagram of a printed pattern in the absence of a beam scanning error according to the present invention.
Figure 81B:
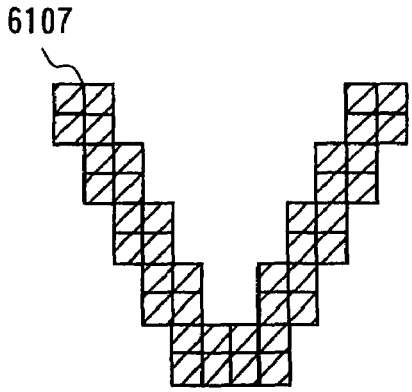

A line 6105 in FIG. 79 represents a beam detection signal A line drawn by image data A 6006-1 corresponding to a beam detection signal A 6008-1. Similarly, a line 6106 in FIG. 79 represents a beam detection signal B line drawn by image data B 6006-2 corresponding to a beam detection signal B 6008-2. FIG. 81(*a*) shows a printout example of the basic pattern 6101 made by repeating the beam detection signal A 6008-1 and the beam detection signal B 6008-2 at preset intervals of tbd, as illustrated in FIG. 81(*a*).

Figure 82A:
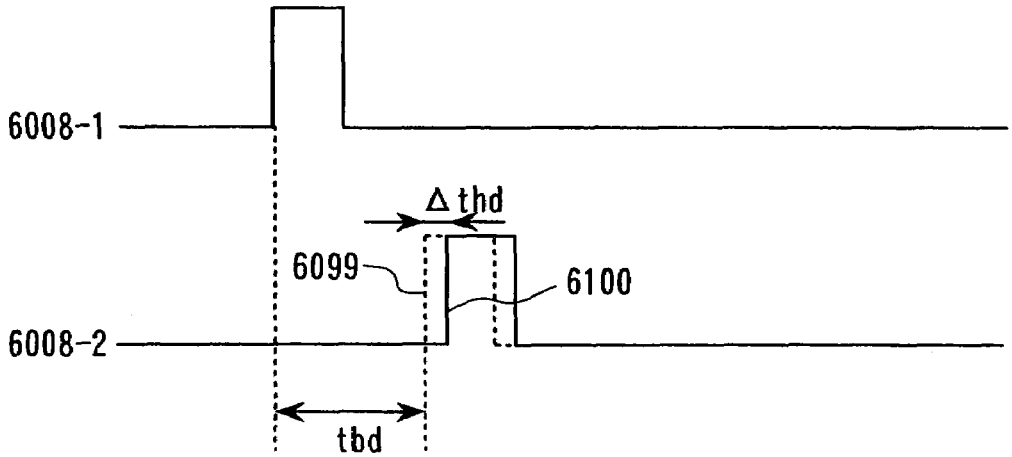
FIG. 82(*a*) is a signal timing diagram and FIG. 82(*b*) is a diagram of a printed pattern in the presence of a beam scanning error according to the present invention.
Figure 82B:
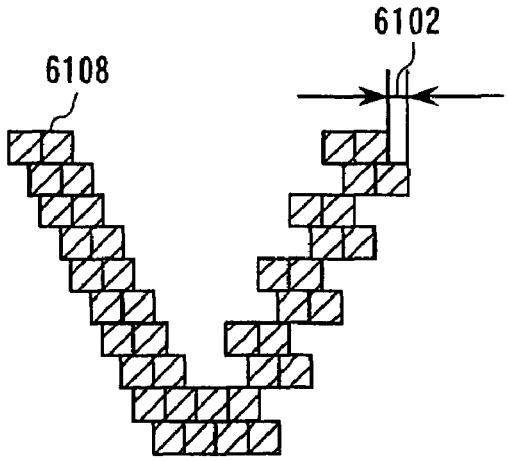

FIG. 82(*b*) shows a printout example of the basic pattern 6101 made by repeating beam detection signals A and B while the beam detection signal B 6008-2 is delayed by A tbd (relative to the preset timing "tbd"). As illustrated in FIG. 82(*a*), the image deviation 6102 is created by a delay (Δ tbd/T) of a line drawn by the image data B 6006-2 due to a delay (Δ tbd) by which the rise position of the actual signal 6008-2 is behind the original rise position 6099 of the signal 6008-2.

This printout image 6108 is not symmetrical, although the basic pattern is symmetrical about the vertical line. Although it is hard to estimate the deviation, the user can recognize it easily because the left side of the pattern looks smooth, but the other side of the pattern looks jagged.

Figure 83A:
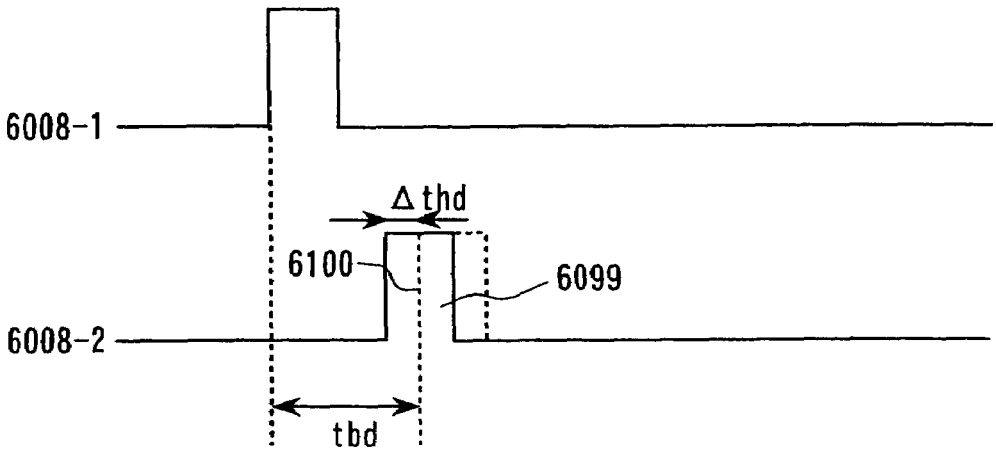
FIG. 83(*a*) is a signal timing diagram and FIG. 83(*b*) is a diagram of a printed pattern in the presence of a beam scanning error according to the present invention.
Figure 83B:
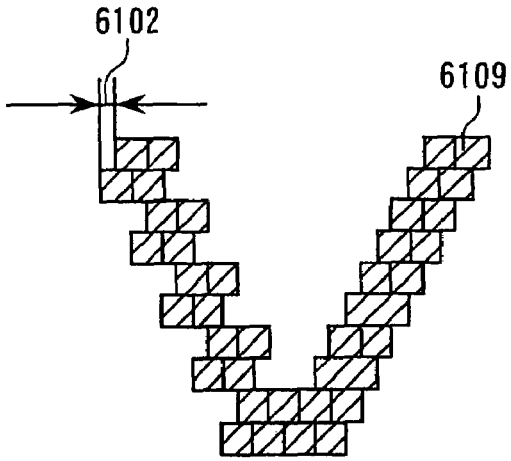

FIG. 83(*a*) shows the waveforms of beam detection signals A 6008-1 and B 6008-2 in which the beam detection signal B 6008-2 rises earlier by A tbd than the preset rise timing tbd. As illustrated in FIG. 83(*a*), the image deviation 6102 is created by a time difference (A tbd/T) of a line drawn by the image data B 6006-2 due to a time (A tbd) by which the rise position 6100 of the actual signal 6008-2 is before the original rise position 6099 of the signal 6008-2.

This printout image 6109 is not symmetrical although the basic pattern is symmetrical about the vertical line. Although it is hard to estimate the deviation, the user can recognize it easily because the right side of the pattern looks smooth, but the other side of the pattern looks jagged.

Judging from which side of the pattern is jagged, the user can easily tell a direction to which the pattern is moved. For example, when the left side of the pattern is more jagged, it is assumed that the beam detection signal B 6008-2 rises earlier. To correct this, the beam detection signal B 6008-2 should be delayed. On the other hand, when the right side of the pattern is more jagged, it is assumed that the beam detection signal A 6008-1 rises earlier. To correct this, the beam detection signal A 6008-1 should be delayed.

As explained above, the deviation and the direction of deviation of beam detection signals 6008 can be known simply from printouts of basic patterns 6101.

Figure 80:
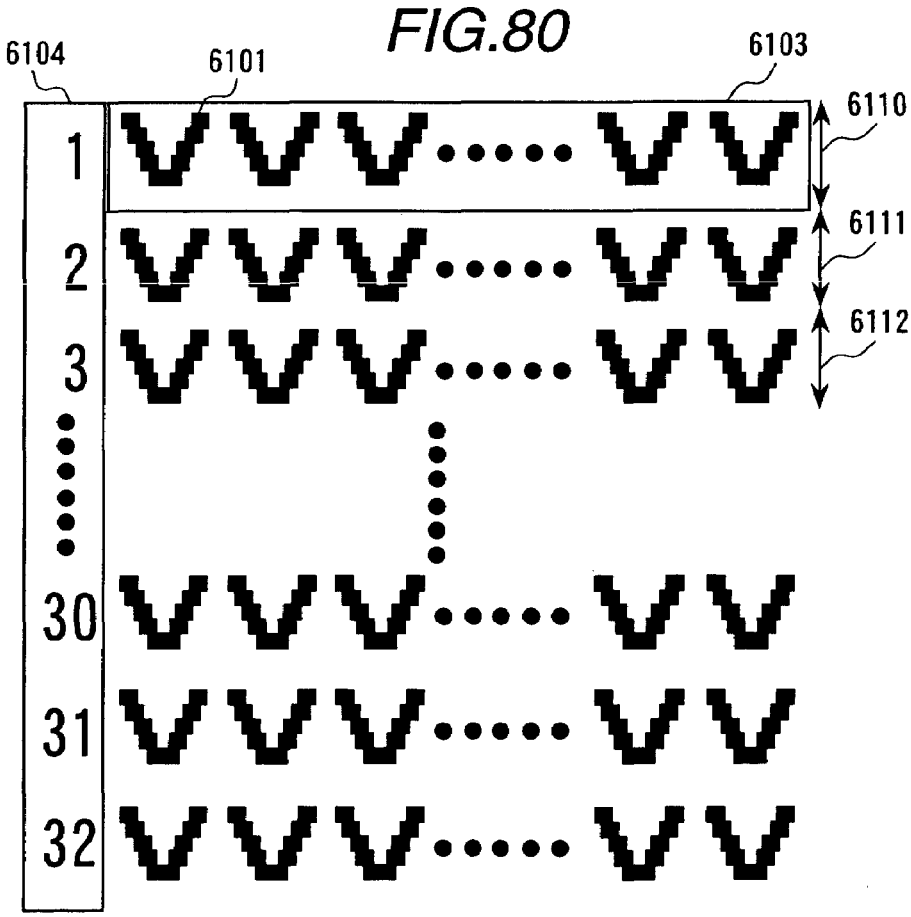
FIG. 80 is a diagram of test chart data according to the present invention.

FIG. 80 shows data of a test chart used by the present invention.

The test chart used by the present invention consists of a plurality of basic areas each of which contains 20 basic patterns 6101 in the main scanning direction. The number of basic patterns 6101 in the basic area need not be 20. The basic area can contain as many basic patterns as the basic area can contain. Since said basic pattern 6101 occupies ten dots in the subsidiary scanning direction, the basic area is made up by sixteen lines including upper and lower margins and the basic pattern 6101. Basic areas 6103 of the test chart are respectively given serial numbers called identifiers 6104 for identification. An identifier 6104 is placed before each basic area 6103.

Since the basic area of this example is made up by a total of sixteen lines, either the beam detection signal A 6008-1 or beam detection signal B 6008-2 should be delayed in sequence for every sixteen lines to test line deviations. Let's assume that the minimum delay is "d. "This example delays the beam detection signals as will be explained below.

For the first basic area (sixteen lines) 6110, neither beam detection signal A 6008-1 nor beam detection signal B 6008-2 is delayed. For the second basic area (sixteen lines) 6111, the beam detection signal A 6008-1 is delayed by "d", but the beam detection signal B 6008-2 is not delayed. For the third basic area 6112, the beam detection signal A 6008-1 is delayed by "2d", but the beam detection signal B 6008-2 is not delayed.

In this way, for each of the succeeding basic areas (6113, 6114, . . . ), the beam detection signal A 6008-1 is delayed by "n×d" (wherein "n" is 3, 4, 5, . . . ), but the beam detection signal B 6008-2 is not delayed. This is repeated until the beam detection signal A 6008-1 is delayed fully. Then, the above steps are repeated while reversing the beam detection signals. Namely, the beam detection signal B 6008-2 is delayed by "n×d", but the beam detection signal A 6008-1 is not delayed.

This example assumes that the cycle of the pixel clock is 32 ns and that the permissible scanning start position error is 1/6 dot. In this case, 1/6 dot is equivalent to about 5.3 ns. Therefore, the minimum delay "d" must be smaller than 5.3 ns. This example uses "d=2 ns" and deviates the lines by the cycle (T) of one pixel clock under this condition. As T/d is 16, this example provides sixteen different positions for one beam detection signal.

Therefore, this example has sixteen cases in which the beam detection signal A 6008-1 is in advance of the beam detection signal B 6008-2 and another sixteen cases in which the beam detection signal B 6008-2 is in advance of the beam detection signal A 6008-1. This is the reason why the test chart has thirty-two basic areas.

In other words, basic areas of identifiers (6104) 1 to 16 are for cases in which the beam detection signal A 6008-1 is in advance of the beam detection signal B 6008-2. For each of these cases, the beam detection signal A 6008-1 is delayed by a multiple of 2 ns with the beam detection signal B 6008-2 left unchanged (until the beam detection signal A 6008-1 is delayed by the cycle of one pixel clock).

Similarly, basic areas of identifiers (6104) 17 to 32 are for cases in which the beam detection signal B 6008-2 is in advance of the beam detection signal A 6008-1. For each of these cases, the beam detection signal B 6008-2 is delayed by a multiple of 2 ns with the beam detection signal A 6008-1 left unchanged (until the beam detection signal B 6008-2 is delayed by the cycle of one pixel clock).

The user can always find an optimum case in which the amount of positional deviation is 2 ns or less in the above thirty-two cases.

The circuit configuration and the operation of the laser beam detection position controller 6004 will be explained below with reference to FIG. 72.

The delay time controller A 6034 sends a position determining signal A 6017 to the beam detection signal delay circuit A 6030 according to the position controller control signal 6011 and the user-set position control signal 6012. The beam detection signal delay circuit A 6030 delays one of the beam detection signals (A 6008-1 in this example) by a preset time period according to the entered position determining signal A 6017 and outputs a controlled laser beam detection signal A 6009-1.

Similarly, the delay time controller B 6068 sends a position determining signal B 6026 to the beam detection signal delay circuit B 6031 according to the position controller control signal 6011 and the user set position control signal 6012.

The beam detection signal delay circuit B 6031 delays the other beam detection signal (B 6008-2 in this example) by a preset time period according to the entered position determining signal B 6026 and outputs a controlled laser beam detection signal B 6009-2.

Basically, the circuits A and B in the laser beam detection position controller 6004 are functionally the same. Accordingly, only circuits A in the controller 6004 will be explained as a representative example.

Figure 73:
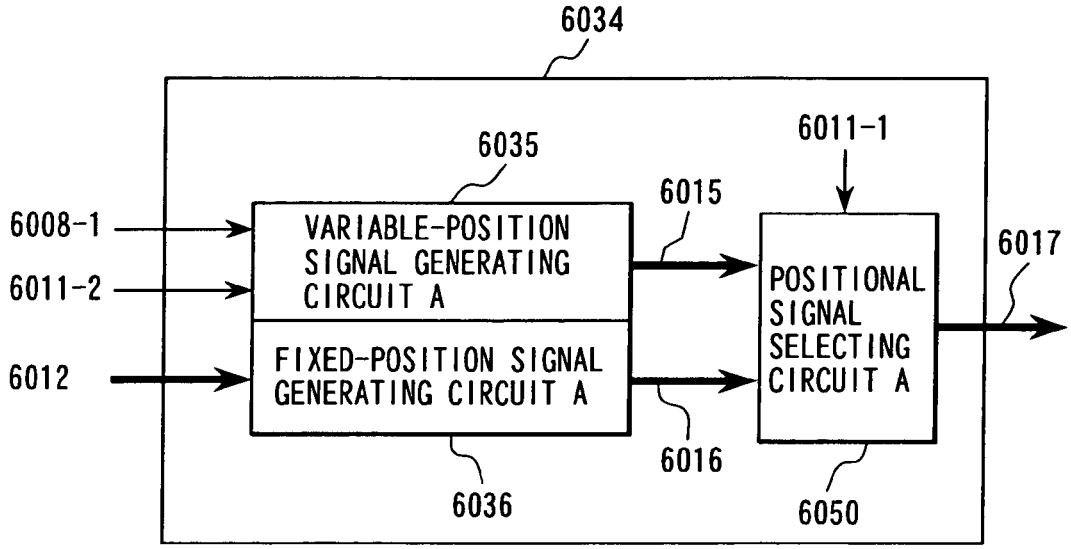
FIG. 73 is a block diagram of a delay time control circuit according to the present invention.

Referring to FIG. 73, the delay time controller A 6034 will be described. As seen in FIG. 73, the delay time controller A 6034 consists of a Variable Position signal generator A 6035, a Fixed Position signal generator A 6036, and a position signal selector A 6050.

The operation of these circuits will be explained.

A signal 6011-1 is one of the Position Controller Control signal 6011 and a binary Position Test On signal which is "1", in the Position Test mode. A signal 6011-2 is a binary signal indicating a print area in the subsidiary scanning direction.

The Variable Position signal generator A 6035 generates a Variable Position signal A 6015 whose rise position is changed at a preset timing and outputs this signal to the position signal selector A 6050. The Fixed Position signal generator A 6036 generates a Fixed Position signal A 6016 in response to a user-set position control signal 6012.

The position signal selector A 6050 outputs the Fixed Position signal A 6016 as a position determining signal A 6017 when the Position Test On signal 6011-1 is "O" (Normal Printing) or the Variable Position signal A 6015 as a position determining signal A 6017 when the Position Test On signal 6011-1 is "1" (Positional Test Printing).

Figure 74:
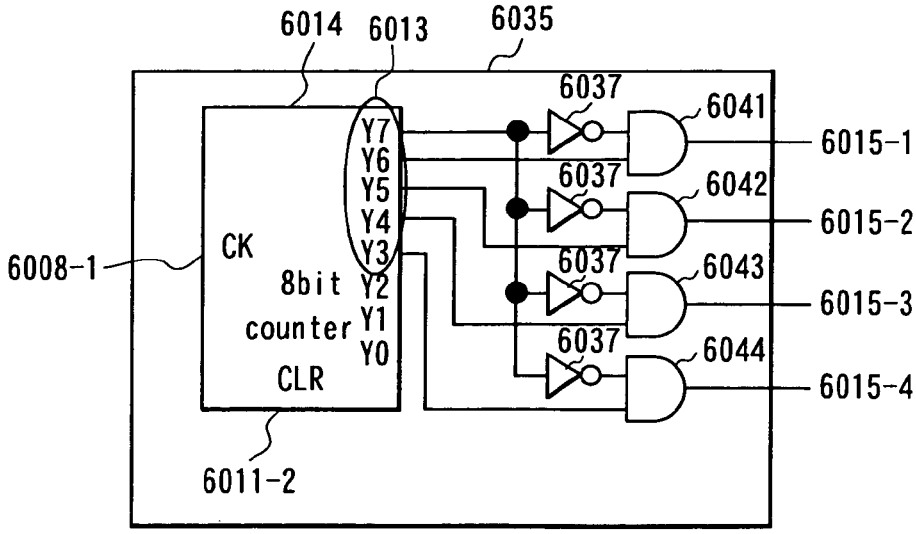
FIG. 74 is a schematic diagram of a circuit for generating a variable-position signal according to the present invention.

FIG. 74 is a circuit diagram of said Variable Position signal generator A 6035.

The Variable Position signal generator A 6035 consists of a basic area counter A 6014 which is an 8-bit binary counter, the higher 5-bit output 6013 of the basic area counter, inverters 6037 through 6040, and AND gates 6041 through 6044.

As this embodiment uses two laser beams and a test pattern whose basic area consists of sixteen lines, the delay time is changed when one beam scans eight lines (assuming that one basic area is scanned). Using the higher five bits of the eight output bits of the basic area counter A 6014, the output 6013 of the basic area counter A is incremented by one each time eight beam detection signals A 6008-1 are counted.

The Variable Position signals A 6015-1 through 6015-4 are incremented in sequence while the output 6013 of the basic area counter A 6014 is 0 to 15 (for basic areas of identifiers 1 through 16) but they remain 0 while the output 6013 of the basic area counter A 6014 is 16 to 31 (for basic areas of identifiers 17 through 32).

The Variable Position signal generator B in the delay time controller B 6068 is the same as the Variable Position signal generator A, but the Variable Position signal generator B does not have any inverter 6037 through 6040.

Figure 75:
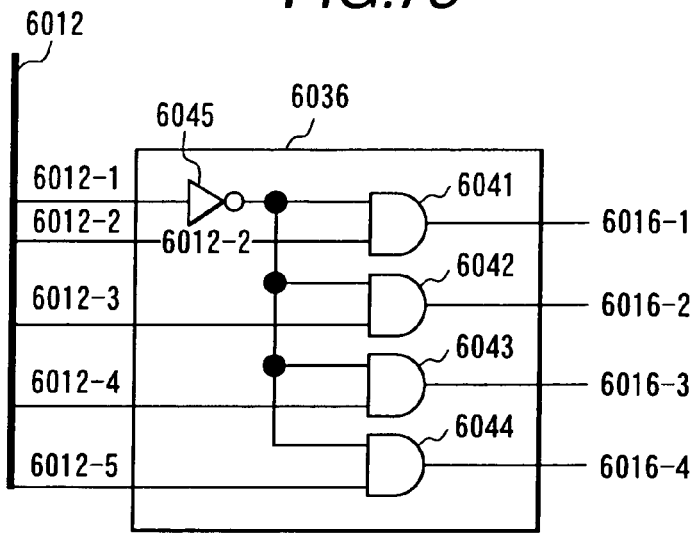
FIG. 75 is a schematic diagram of a circuit for generating a fixed-position signal according to the present invention.

FIG. 75 shows a circuit example of the Fixed Position signal generator A 6036. In FIG. 75, the User-Set Position Control signal 6012 is a 5-bit binary signal having 6012-1 as the most-significant bit and 6012-5 as the least significant bit which can represent a decimal value ranging 0 to 31. The Fixed Position signal generator A 6036 consists of an inverter 6045 and AND gates 6046 through 6049.

The Fixed Position signal generator A 6036 outputs a Fixed Position signal A 6016 in response to a User-Set Position Control signal 6012. The Fixed Position signal A 6016-1 through 6016-4 has the same value as the User-Set Position Control signal 6012 when the User-Set Position Control signal 6012 has a decimal value in the range of 0 to 15, or 0 when the User-Set Position Control signal 6012 has a decimal value in the range of 16 to 31.

Figure 76:
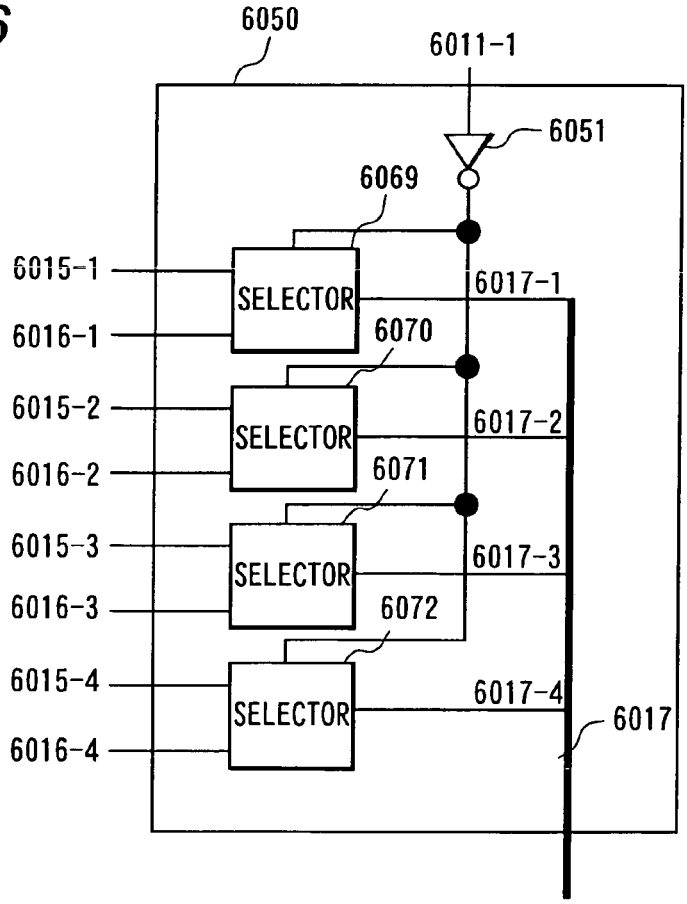
FIG. 76 is a block diagram of a positional signal selecting circuit according to the present invention.

FIG. 76 shows an example of the position signal selector A 6050 of FIG. 73. The position signal selector A 6050 consists of an inverter 6051 and selectors 6069 through 6072 for selecting one of two signals. The operation of the position signal selector A 6050 will be explained below.

The position signal selector A 6050 outputs the Variable Position signal A 6015-1 through 6015-4 as a position determining signal A 6017-1 through 6017-4 when the Position Test on signal 6011-1 is "1", (Positional Test Printing), or outputs the Fixed Position signal A 6016-1 through 6016-4 as a position determining signal A 6017-1 through 6017-4 when the Position Test on signal 6011-1 is "0" (Normal Printing).

Figure 72:
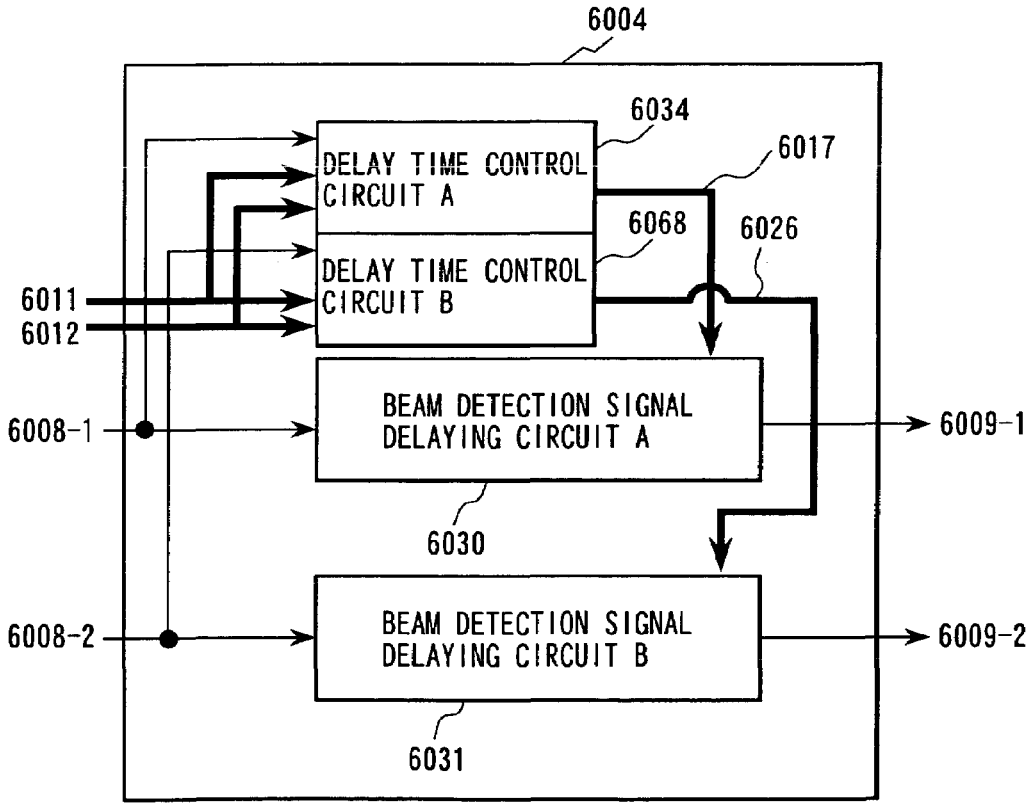
FIG. 72 is a block diagram of a unit for controlling the position of a laser beam detection signal according to the present invention.
Figure 77:
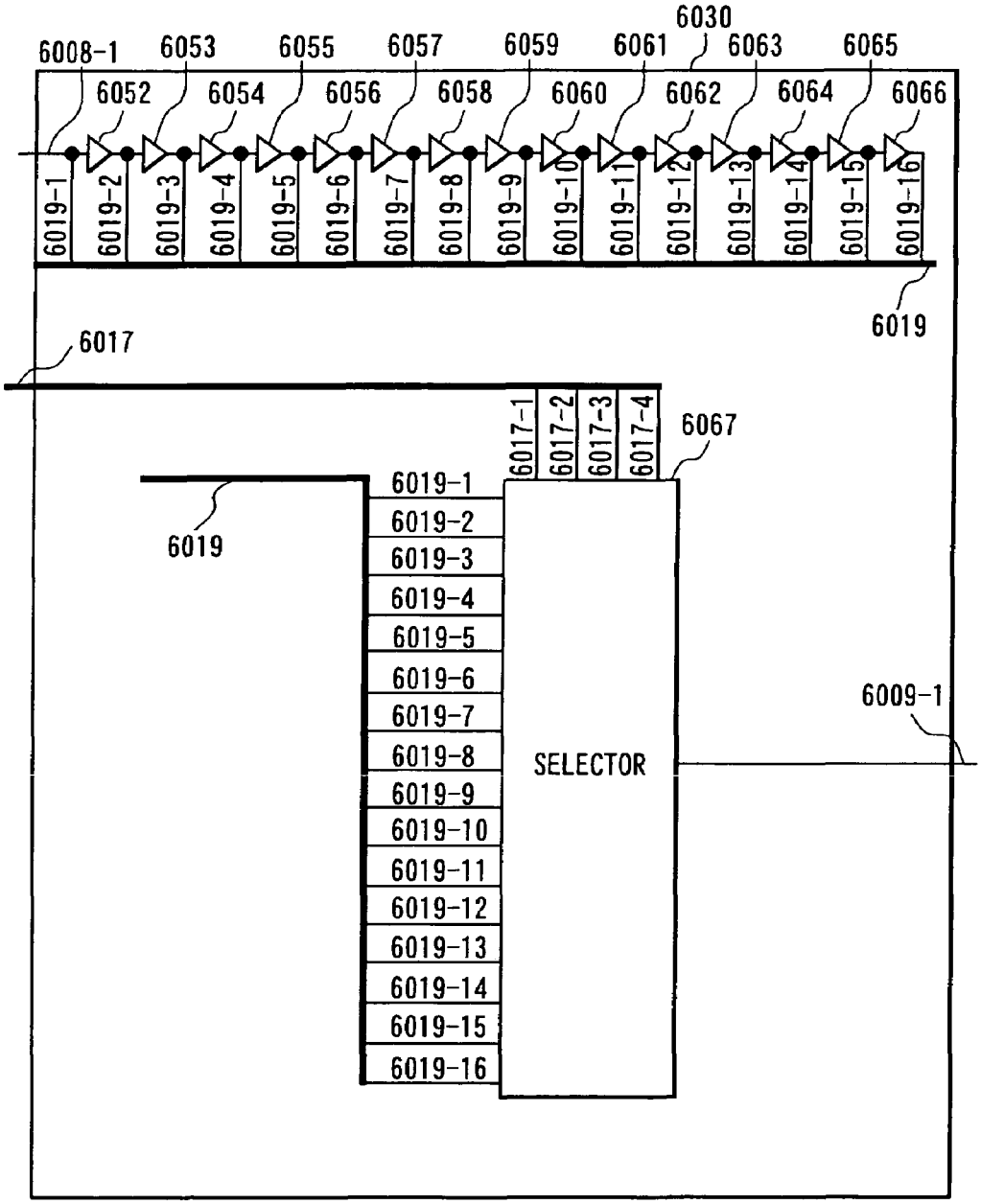
FIG. 77 is a schematic diagram of a beam detection signal delaying circuit according to the present invention.

FIG. 77 shows an example of the beam detection signal delay circuit A 6030 of FIG. 72. The beam detection signal delay circuit A 6030 consists of delay elements 6052 through 6066 which delay an entered signal by a preset time period and a selector 6067 which selects one of sixteen signals. This example has sixteen 2-ns delay elements because the pixel clock cycle T is divided by "d=2 ns."

The beam detection signal delay circuit A 6030 delays the beam detection signals A 6008-1 in sequence using the delay elements 6052 through 6066 and generates delayed beam detection signals A 6019 (6019-1 through 6019-16) having different positions.

The beam detection signal delay circuit A 6030 selects one of the delayed beam detection signals A 6019-1 through 6019-16 according to the position determining signal A 6017 (6017-1 through 6017-4) and outputs it as a controlled beam detection signal A 6009-1.

Figure 78:
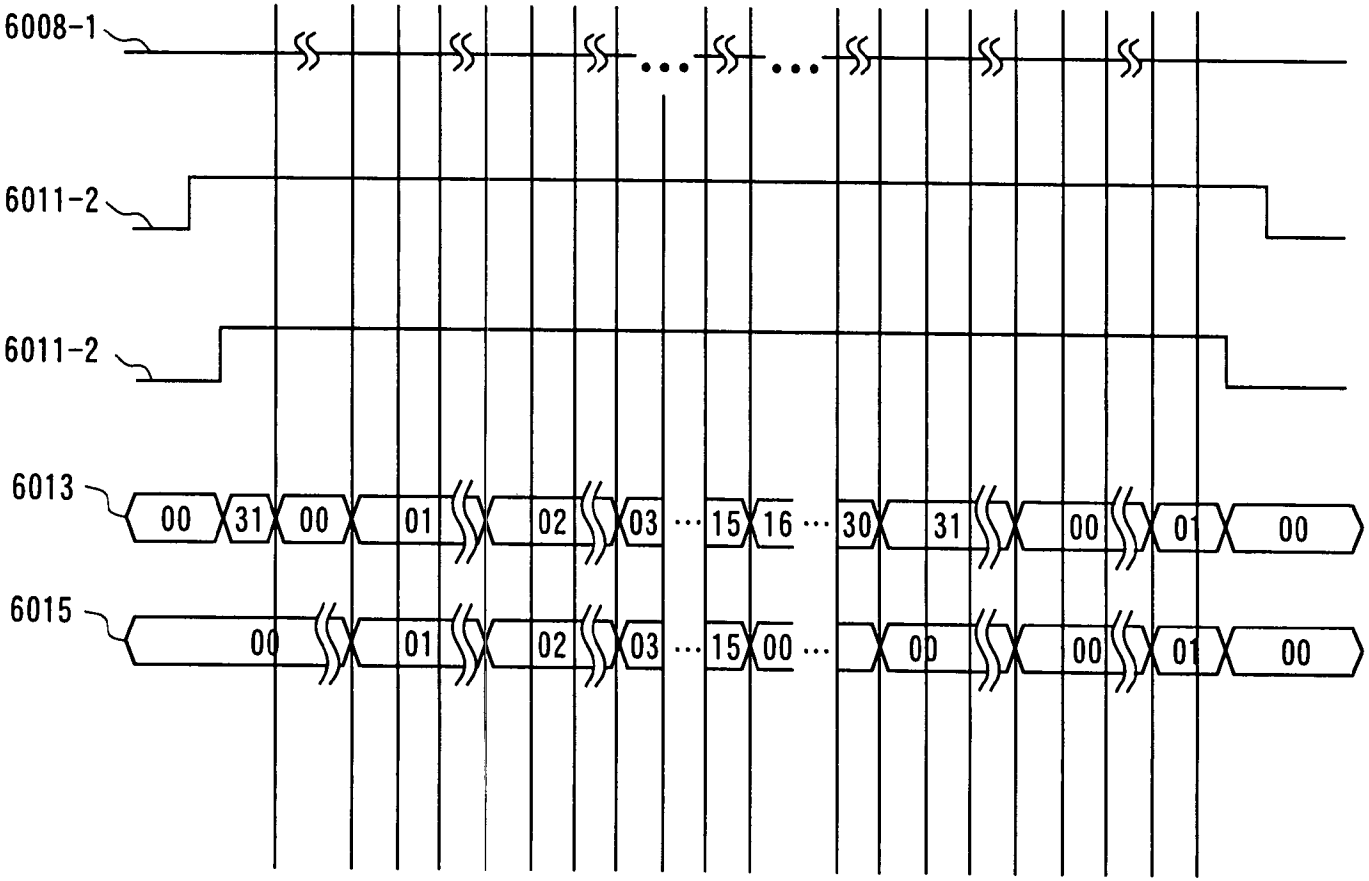
FIG. 78 is a timing diagram of the operations of a delay circuit for a positional test according to the present invention.

The waveforms relating to the operation of the delay time controller A 6034 in the Position Test mode are illustrated in FIG. 78. Upon receiving a command from the operation unit 6005, the controller 6001 sets the Position Test mode (to perform a position test on the whole printer system) and sends an instruction to the printer engine 6003 to print out test chart data. Simultaneously, the Position Test On signal 6011-1 goes high (" 1"). A preset time later, the Subsidiary Scanning Direction Print Area signal 6011-2 goes high (" 1").

At the rise of the Subsidiary Scanning Direction Print Area signal 6011-2, the basic area counter A 6014 has a count of 31 (in decimal) and starts to 10, count the beam detection signal A 6008-1 from 00. In this example, as each basic area 6103 is made up of sixteen lines and two laser beams are used, the output 6013 of the basic area counter A 6014 is incremented by one for every eight beam detection signals A 6008-1. The basic area counter A 6014 will keep on counting until the counter is cleared by the Subsidiary Scanning Direction Print Area signal 6011-2 of "O."

The Variable Position signal A 6015 is counted up in sequence while the output 6013 of the basic area counter A 6014 is 0 to 15 and the controlled beam detection signal A 6009-1 is delayed (in relation to the beam detection signal A 6008-1) for each basic area 6103.

When the output 6013 of the basic area counter A 6014 is 16 to 31 (for basic areas of identifiers (6104) 17 to 32), the Variable Position signal A 6015 remains "0" and the beam detection signal A 6008-1 is output as the controlled beam detection signal A 60091.

Figure 84:
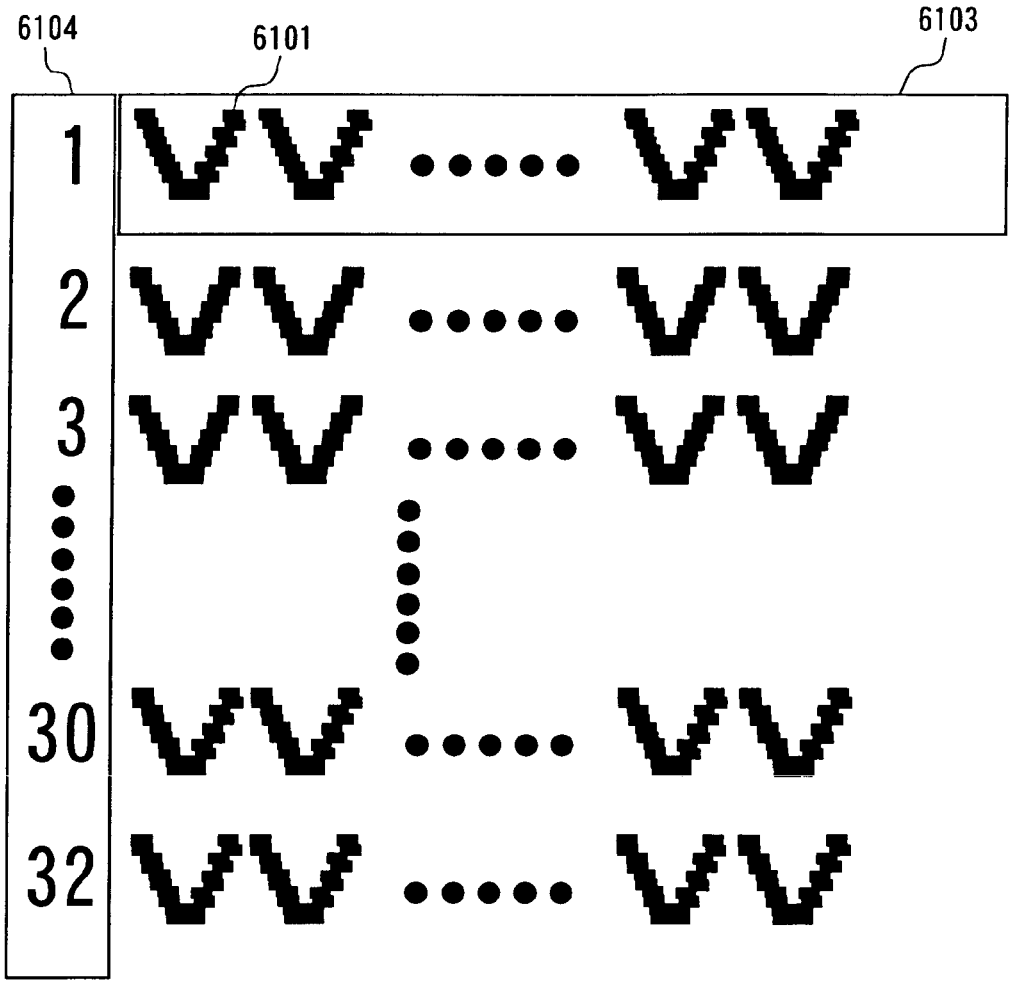
FIG. 84 is a diagram of a test chart according to the present invention.

FIG. 84 shows an example of a test chart which is actually printed by the present invention. As explained above, the test chart data is output for each basic area 6103, changing the positions of the beam detection signals 6008. The user should select an optimum basic area in the printed test chart and enter its identifier 6104 as a user-set position control signal 6012 from the operation block 6005. This is stored in the main storage block.

The part which stores the positional information in the main storage block is a storage unit, such as a floppy disk, hard disk, and the like, which can keep on holding the information after the system is powered off. The positional information is kept in the storage unit until a new User-Set Position Control signal 6012 is set by another positional test.

When a means which can retain a setting status such as a DIP switch is used as the input of the User-Set Position Control signal 6012 on the operation unit 6005, the status of the User-Set Position Control signal 6012 is held until the user changes it and the positional information need not be stored in the main storage unit 6002.

It is possible to always keep and use the beam detection signals 6008 in good alignment by storing positional information of the well-aligned laser beams after the positional test in a storing means of the main storage unit 6002 of the controller 6001, which can retain the information even after the system is powered off and by building up so that the positional information may be automatically loaded when the system is powered on again.

Even when the beam detection signals 6008 greatly deviate by an external factor (such as a great impact) or a secular change, the user can quickly correct the deviation by performing a positional test and setting an optimum position of the beam detection signals 6008.

It is also possible to prevent deterioration of images due to increasing deviation of beam detection signals 6008 by building the system so that the positional test may be automatically performed each time the system is powered on.

This embodiment is basically applicable to image recording devices of three or more laser beams. However, the beam position correcting steps for image recording devices of three or more laser beams are quite complicated. For example, consider the following steps to correct beam positions in the 3-beam image recording device.

Figure 85:
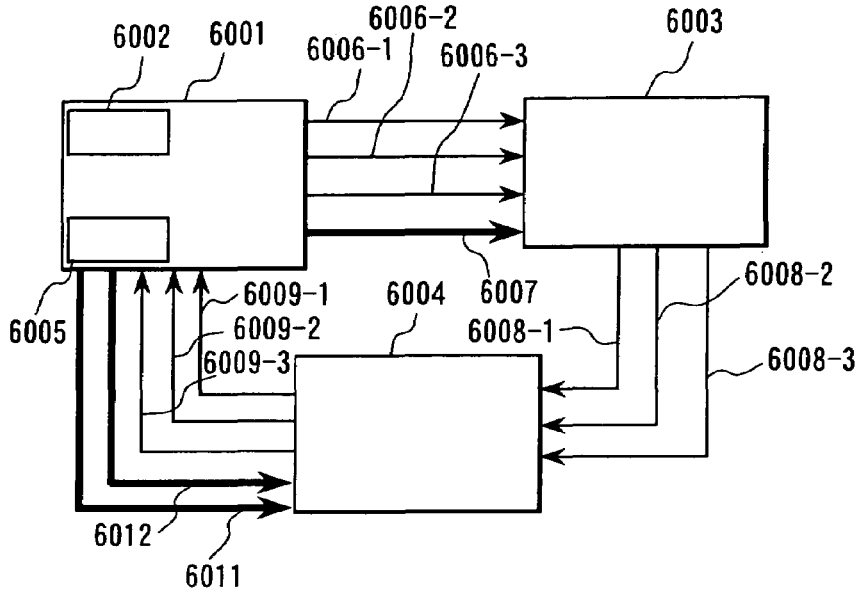
FIG. 85 is a block diagram of an image recording device according to the present invention.

FIG. 85 shows the system configuration of a 3-beam printer system according to the present invention. In addition to the system configuration of the aforesaid 2-beam image recording device, the printer system in FIG. 85 has a beam detection signal C (6008-3), binary or multi-level image data C (6006-3) corresponding to the beam detection signal C (6008-3), and a controlled beam detection signal C (6009-3) into which the positional controller 6004 controls the beam detection signal C (6008-3).

The main storage 6002 stores data in the form of a test chart having basic areas in which a basic pattern (3 dots in the subsidiary scanning direction and 2 dots in the main scanning direction) is repeated four times in an adjoining manner in the subsidiary scanning direction with the basic pattern being deviated by one dot left, right, and both left and right in the main scanning direction each time the basic pattern is formed. The upper and lower beams on the boundary are made up by all possible combinations of beams.

The basic pattern is repeated ten times in the main scanning direction. The number of basic patterns in the basic area need not be ten. The basic area can include as many basic patterns as the basic area can contain. Further, the basic pattern is repeated once in the subsidiary scanning direction. The test chart contains thirty-two basic areas.

Figure 86:
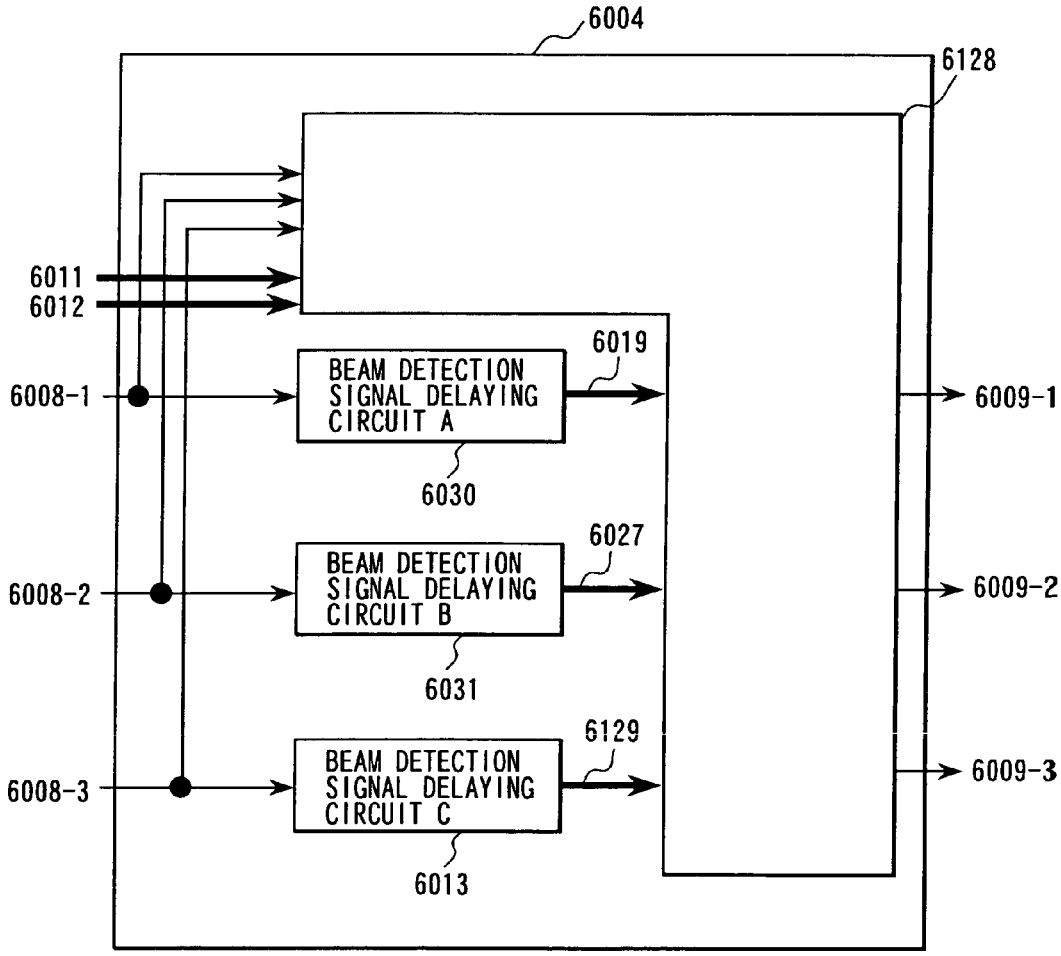
FIG. 86 is a block diagram of a unit for controlling the position of a laser beam detection signal according to the present invention.

FIG. 86 is a block diagram of the laser beam detection position controller 6004 in a 3-beam image recording system. The laser beam detection position controller 6004 consists of a beam detection signal delay circuit A (6030) which delays a beam detection signal A (6008-1) for a preset time period, a beam detection signal delay circuit B (6031) which delays a beam detection signal B (6008-2) for a preset time period, a beam detection signal delay circuit C (6130) which delays a beam detection signal C (6008-3) for a preset time period, and a micro computer 6128 which controls the delay time of each of said beam detection signal delay circuits.

The micro computer 6128 outputs the controlled beam detection signals A (6009-1), B (6009-2), and C (6009-3) according to the Position Control Block Control signal (6011) and the User-Set Position Control signal (6012).

Figure 87:
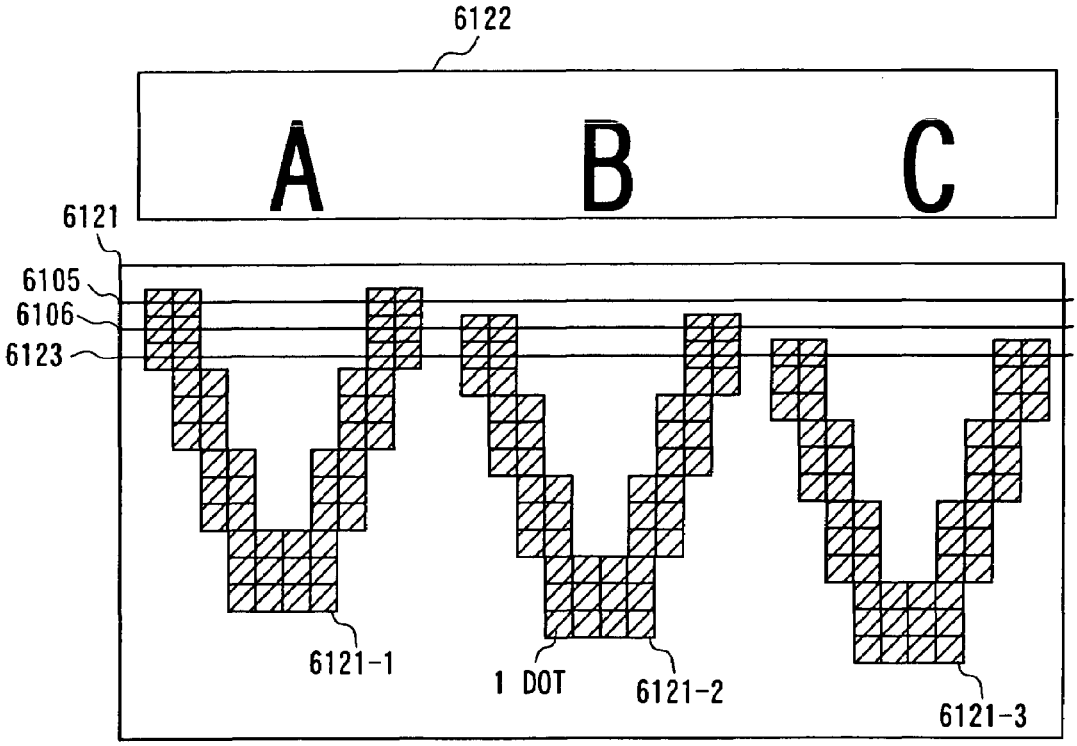
FIG. 87 is a diagram of a basic pattern according to the present invention.

FIG. 87 shows a basic pattern used by this embodiment for the positional test. The basic pattern 6121 is made up by repeating a pattern unit (3 dots in the subsidiary scanning direction and 2 dots in the main scanning direction) four times in an adjoining manner in the subsidiary scanning direction with the basic pattern being deviated by one dot left, right, and both left and right in the main scanning direction each time the basic pattern is formed.

The patterns made by upper and lower adjoining beams (beams 1 and 2, 2 and 3, and 3 and 1) represents all possible combination of patterns. These basic patterns are separated into three patterns 6121-1 through 6121-3 according to the combinations of adjoining upper and lower beams. Identifiers (6122) are given to the separated basic patterns for identification.

In FIG. 87, the line 6105 represents a line drawn by image data A (6006-1) corresponding to the beam detection signal A (6008-1). The line 6106 represents a line drawn by image data B (6006-2) corresponding to the beam detection signal B (6008-2). Similarly, the line 6123 represents a line drawn by image data C (6006-3) corresponding to the beam detection signal C (6008-3).

Figure 88A:
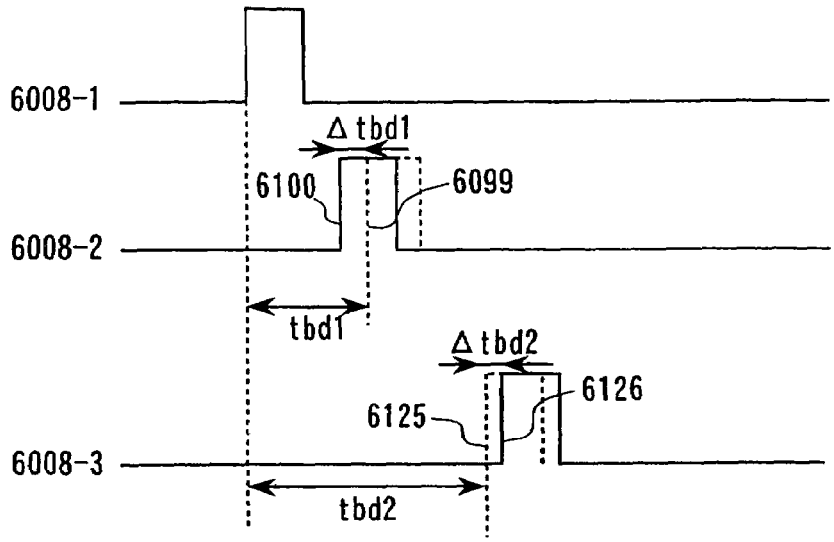
FIG. 88(*a*) is a signal timing diagram and FIG. 88(*b*) is a diagram of a printed pattern in the presence of a beam scanning error according to the present invention.
Figure 88B:
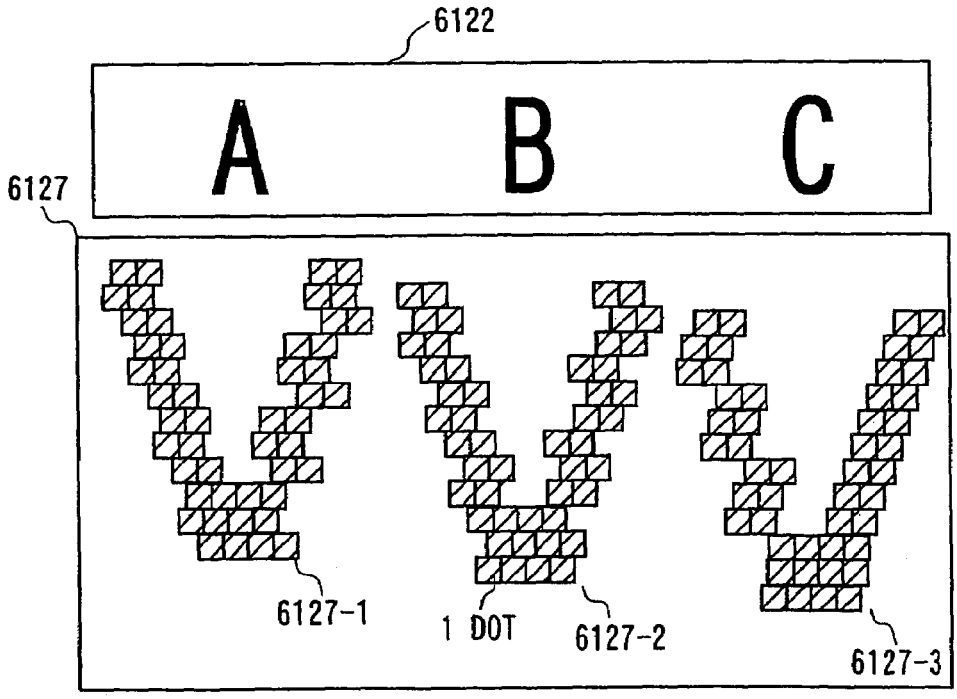

Let's assume that the waveforms of the beam detection signals A, B, and C are as illustrated in FIG. 88(*a*), in which the beam detection signal B (6008-2) rises (at 6100) earlier by A tbd1 than the preset rise position 6099, the beam detection signal C (6008-3) rises (at 6126) later by Δ tbd2 than the preset rise position 6125, and Δ tbd1 is greater than Δ tbd2.

Taking the beam detection signal A (6008-1) as a reference signal, the positional difference between beam detection signals A (6008-1) and B (6008-2) is Δ tbd1 and the positional difference between beam detection signals A (6008-1) and C (6008-3) is Δ tbd2. The positional difference between beam detection signals B (6008-2) and C (6008-3) is Δ tbd2 minus Δtbd1.

Reference numeral 6127 in FIG. 88(*b*) shows the result of printout of basic pattern 6121 under the aforesaid conditions. When a basic pattern which is furthest from bilateral symmetry among the printed basic patterns 6127-1 through 6127-3 is selected and its identifier 6122 is entered from the operation block 6005, the printer controller 6001 sends its information in the form of a position controller control signal 6011 to the micro computer 6128 in the position control block 6004.

Further, if there is no laser beam detection signal position control block 6004, the sub-basic pattern 6127-3 corresponding to the sub-identifier 6122 is apparently furthest from bilateral symmetry. Its right side is smooth, but its left side is extremely jagged. The user enters "C" from the operation block 6005. With this, the micro computer 6128 judges that the difference between the beam detection signals B (6008-2) and C (6008-3) is the greatest.

To eliminate this difference between the beam detection signals B (6008-2) and C (6008-3), the micro computer 6128 changes the positions of the beam detection signals B (6008-2) and C (6008-3) in sequence while the beam detection signal A (6008-1) is left unchanged.

Then, the test chart data (in the same manner as in the 2-beam image recording device) is printed with the positions of the beam detection signals B (6008-2) and C (6008-3) changed in sequence.

The identifier 6129 of the optimum basic pattern is entered from the operation unit 6005. With this, the micro computer 6128 corrects the difference between the beam detection signals B (6008-2) and C (6008-3).

If the sub-identifier (6122) A is entered from the operation unit 6005, the micro computer 6128 judges that the difference between the beam detection signals A (6008-1) and C (6008-3) is the greatest and fixes the position of the beam detection signal B (6008-2).

If the sub-identifier (6122) B is entered from the operation unit 6005, the micro computer 6128 judges that the difference between the beam detection signals A (6008-1) and B (6008-2) is the greatest and fixes the position of the beam detection signal C (6008-3).

With these operations, the difference between the beam detection signals B (6008-2) and C (6008-3) is eliminated. Next, the Position Test mode is set to eliminate the difference between the beam detection signals A (6008-1) and B (6008-2) with the positional relationship between beam detection signals B (6008-2) and C (6008-3) fixed. (When the position of the beam detection signal B (6008-2) is changed, the position of the beam detection signal C (6008-3) must be changed by the same amount.)

The user selects a basic pattern having the best bilateral symmetry in the printed test chart and enters its identifier (6132) from the operation block 6005. The micro computer 6128 corrects the positional relationship between the beam detection signals A (6008-1) and B (6008-2). With this, the correction of the positional relationship of the beam detection signals A (6008-1), B (6008-2) and C (6008-3) is completed.

Figure 89:
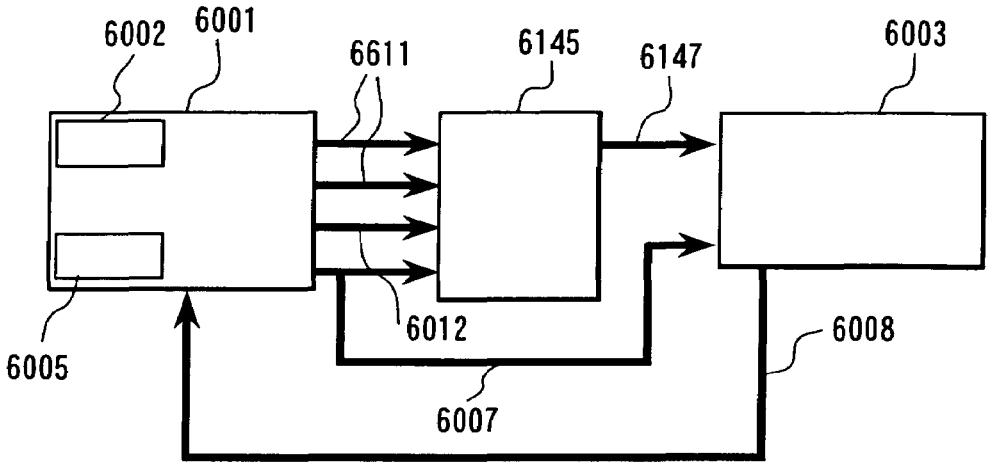
FIG. 89 is a block diagram of an image recording device according to the present invention.
Figure 90:
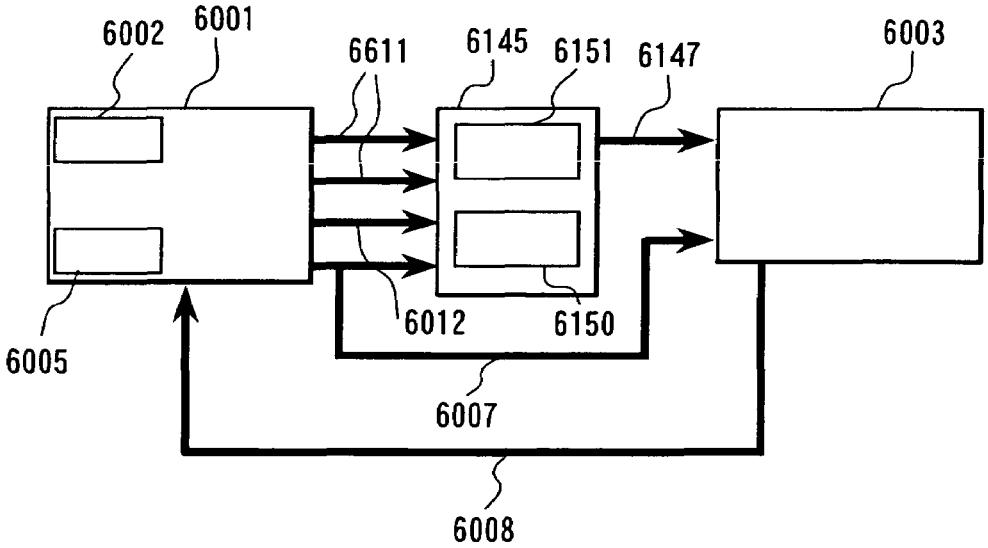
FIG. 90 is a block diagram of an image recording device according to the present invention.

The above-explained procedure is easily applicable to image recording devices having n laser beams even when the device uses more laser beams and their positional relationship is more complicated. FIG. 89 shows a system configuration of an image recording device having n laser beams. The image signal position control unit 6145 receives image signals 6006 from the controller 6001, controls their positional relationship, and outputs the controlled image signal 6147. The operation and the effect of this example are the same as those of the above-explained examples but the beam detection signals 6008 and image signals 6004 are changed.

The user can perform the positional test completely independently from the controller 6002 by providing a storage unit 6151 and an image processing/scanning unit in the image signal position control unit 6145 and by moving the storage unit (which stores test chart data and positional information) from controller 6001 into the storage unit 6151. This means that application of the present invention to the conventional printer system does not require any modification of the controller 6001.

Figure 91:
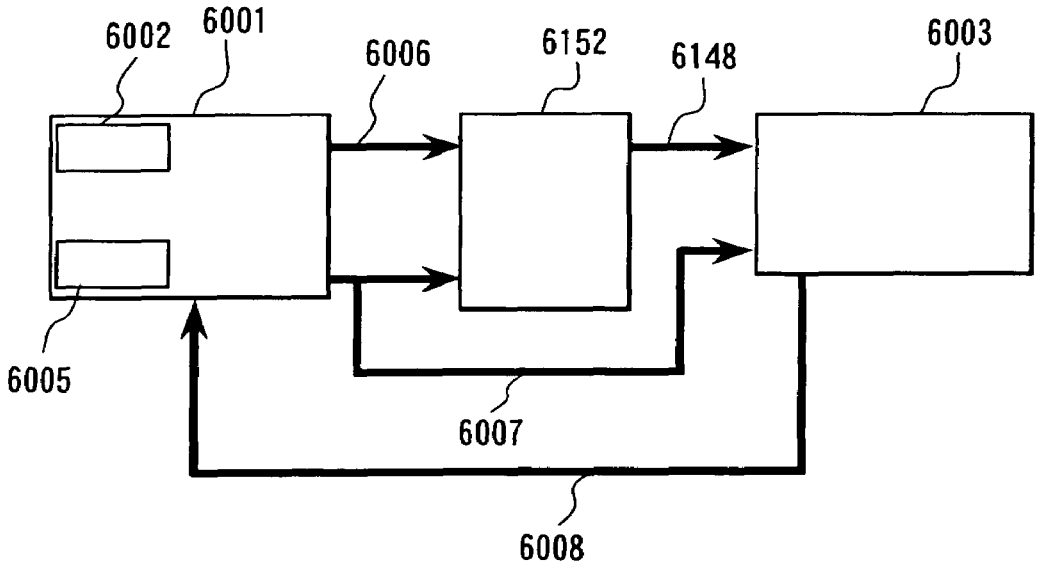
FIG. 91 is a block diagram of an image recording device according to the present invention.

Further, the conventional printer systems typically have an image processor. FIG. 91 shows the configuration of a conventional printer system having an image processor. The image processor 6152 usually receives image signals 6006 from the controller 6001, performs standard processing, such as resolution enhancement, gray-scale enhancement or the like, on the signals, and outputs the processed image signals 6148.

As such an image processor 6152 already possesses image signals 6006 and engine control signals 6007, it is very easy to add a function of the image signal position controller 6145 to the image processor 6152. Therefore, the user can get images without positional deviations. Also, in this case, it is apparent that the controller 6001 of a conventional printer system for which the present invention does not require any modification only if the image processor having the function of the image signal position controller 6145 contains a storage unit 6151 and an image processor operation unit 6150.

As explained above, the image recording device according to the present invention can record high-quality high-resolution images and is available as a multi-beam image recording device having a plurality of light sources (laser beams).

What we claim is:

1. An image recording device equipped with a plurality of light sources and a photosensitive unit which is scanned by said light sources, said device comprising:

an interference light quantity setting unit which sets the quantity of interference lights of a plurality of image signals corresponding to said light sources;

an interference unit for causing interference by said image signals with said preset light-quantity component only;

a delay time setting unit which sets delay times of a plurality of pixel clocks corresponding to said light sources;

a delay unit which delays said pixel clocks by said preset time periods only;

a memory unit which stores interference data output from said interference unit in synchronism with said pixel clocks and outputs said interference data in the order that they were written by delay data output from said delay unit; and a pulse-width modulating unit which modulates the pulse widths of interference data which is output from said memory unit.

2. An image recording device as claimed in claim 1 further comprising:

an exposure unit which exposes a preset test pattern onto the surface of said photosensitive unit by means of said plurality of light sources; and a surface potential measuring unit which measures the surface potential of said exposed photosensitive unit.

3. An image recording device as claimed in claim 1 further comprising:

an exposure unit which exposes a preset test pattern onto the surface of said photosensitive unit by means of said plurality of light sources; and at least one developer for attaching developing agent to the surface of said photosensitive unit which is exposed by said exposure unit; and a density measuring unit which measures the density of a toner image formed on said photosensitive unit by said developer.

4. An image recording device as claimed in claim 2 or 3 wherein said test pattern has at least two kinds of patterns for measuring scanning line pitches in the main scanning direction and in the subsidiary scanning direction.

5. An image recording device as claimed in claim 1 wherein said delay is executed after said interference is executed.

6. An image recording device as claimed in claim 1 wherein said interference unit can set an arbitrary main scanning line pitch.

7. An image recording device as claimed in claim 1 or 6 wherein said plurality of light sources are a cleavage-type or area-illumination type semiconductor laser array.

8. An image recording device equipped with an engine unit consisting of a plurality of light sources and a photosensitive unit which is scanned by said light sources, comprising:

a controller which generates a plurality of image signals and pixel clocks corresponding to said light sources, and a correction unit which corrects the quantity of exposure in said optical system of said engine unit according to said image signals and said pixel clocks generated by said controller and sends said correction information to said engine unit, wherein said correction unit comprises:

an interference light quantity setting unit which sets a quantity of interference lights of a plurality of image signals corresponding to said light sources;

an interference unit which causes interference by said image signals with said preset light-quantity component only;

a delay time setting unit which sets delay times of a plurality of pixel clocks corresponding to said light sources;

a delay unit which delays said pixel clocks by said preset time periods only;

a memory unit which stores interference data output from said interference unit in synchronism with said pixel clocks and outputs said interference data in the order that they were written by delay data output from said delay unit; and a pulse-width modulating unit which modulates the pulse widths of interference data which is output from said memory unit.

9. An image recording device as claimed in claim 1, wherein said pulse-width modulating unit includes a plurality of pulse-width modulators for modulating pulse widths of a plurality of laser driving signals according to image data and a plurality of laser light sources for emitting a plurality of laser beams whose light quantities are controlled by said laser driving signals and which forms images by scanning said plurality of laser beams, said device further comprising:

means for obtaining a dispersion in pulse-width modulation of said plurality of laser driving signals and correcting said plurality of laser driving signals according to this dispersion.

10. An image recording device as claimed in claim 9 wherein said means for correcting said plurality of laser driving signals corrects said plurality of laser driving signals by outputting a plurality of monitoring laser driving signals according to identical image data through said plurality of pulse-width modulators when the mode for correcting said laser driving signals is set and by obtaining the dispersion in the pulse-width modulation of said laser driving signals.

11. An image recording device as claimed in claim 10 wherein said means for correcting said plurality of laser driving signals obtains the dispersion in the pulse-width modulation of these laser driving signals by selecting one of said plurality of monitoring laser driving signals as one target value and subtracting the pulse width of this target value from the pulse width of each monitoring laser driving signal.

12. An image recording device as claimed in claim 9 wherein said means for correcting said plurality of laser driving signals corrects peak values of laser driving signals according to the dispersion of the pulse-widths of said laser driving signals.

13. An image recording device as claimed in claim 9 wherein said means for correcting said plurality of laser driving signals corrects pulse-widths of laser driving signals according to the dispersion in the pulse-width modulation of said laser driving signals.

14. An image recording device as claimed in claim 1, further comprising:

a printer engine for scanning with a plurality of laser beams having different phases for printing image data;

wherein said pulse-width modulator unit is equipped with a plurality of pulse generating means for modulating the pulse-width of said image data with a pulse-width determined by a combination of a plurality of delay elements for each beam and outputting the pulses as print data from said pulse generating means, to said printer engine; and a pulse-width corrector which compares the pulse-widths output from said plurality of pulse generating means by the reference pulse-width and corrects pulse-widths by a combination of said delay elements in said plurality of pulse generating means according to pulse-width differences.

15. An image recording device as claimed in claim 1, further comprising:

a printer engine for scanning a photosensitive unit by a plurality of laser beams having different phases for printing image data;

wherein said pulse-width modulator unit is equipped with a plurality of pulse generating means for setting a pulse-width by a combination of a plurality of delay elements, modulating the pulse-width of said image data with said preset pulse-width, and outputting the result print data to said printer engine;

synchronization limiting means for synchronizing the pulse width modulation with said plurality of pulse generating means; and a pulse-width corrector which corrects the pulse-width which is set by said delay elements for each pulse generating means so that each pulse-width output by said plurality of pulse generating means may be equal to the reference pulse-width in synchronization.

16. An image recording device as claimed in claim 1, further comprising:

a printer engine for scanning a photosensitive unit by a plurality of laser beams having different phases for printing image data;

wherein said pulse-width modulator unit is equipped with a plurality of pulse generating means for setting a pulse-width by a combination of a plurality of delay elements, modulating the pulse-width of said image data with said preset pulse-width, and outputting the result as print data to said printer engine, synchronization limiting means for synchronizing 20 the pulse width modulation with said plurality of pulse generating means, and a pulse-width corrector which corrects the pulse-width which is set by said delay elements for each pulse generating means with a pulse width selected (as a reference pulse-width) from pulses output from said plurality of pulse generating means in synchronization so that each pulse-width output by said plurality of pulse generating means may be equal to the reference pulse-width.

17. An image recording device as claimed in claim 1, further comprising:

a printer engine for scanning a photosensitive unit by a plurality of laser beams having different phases for printing image data;

wherein said pulse-width modulator unit is equipped with a plurality of pulse generating means for setting a pulse-width by a combination of a plurality of delay elements, modulating the pulse-width of said image data with said preset pulse-width, and outputting the result as print data to said printer engine;

synchronization limiting means for synchronizing the pulse width modulation with said plurality of pulse generating means;

correction image data generating means for giving image data for correction to said plurality of pulse generating means in synchronization of said plurality of pulse generating means; and a pulse-width corrector which corrects the pulse-width which is set by said delay elements for each pulse generating means with a pulse width selected as a reference pulse-width from pulses output from said plurality of pulse generating means in synchronization so that each pulse-width output by said plurality of pulse generating means may be equal to the reference pulse-width.

18. An image recording device as claimed in claim 1, further comprising:

a printer engine having a beam detector for detecting a plurality of laser beams which are emitted at preset time intervals from laser sources, scanning a photosensitive unit with said plurality of laser beams, and thus printing image data;

wherein said pulse-width modulator unit is equipped with a plurality of pulse generating means for modulating the pulse-width of said image data with a pulse-width set by a plurality of serially-connected delay elements and outputting the modulated pulses to said printer engine;

printer interface means for generating image clocks in synchronism of beam detection signals output from said beam detector;

pixel clock selecting means for selecting said pixel clock in pulse-width correction and outputting the selected clock to said plurality of pulse generating manes to synchronize pulse-width modulation with said plurality of pulse generating means; and a pulse-width corrector which corrects the pulse-width which is set by said delay elements for each pulse generating means so that each pulse-width output by said plurality of pulse generating means may be equal to the reference pulse-width.

19. An image recording device, comprising:

an image recording unit equipped with a plurality of laser beams and a plurality of detectors which detect said laser beams;

a beam detection signal controller which outputs beam detection position control signals to control scanning line pitches of laser beams according to a plurality of beam detection signals output from said image recording unit; and a controller which controls said image recording unit at least according to said beam detection position control signals.

20. An image recording device as claimed in claim 19, wherein said controller further comprises:

an operation unit on which instructions are given externally; and a storage unit which stores said instruction data and test chart data to detect positional differences of said beams.

21. An image recording device as claimed in claim 19, wherein said beam detection signal controller further comprises:

a time delay unit for delaying said beam detection signals corresponding to said beams independently according to the signals from said controller.

22. An image recording device as claimed in claim 21, wherein said time delay block further comprises:

a variable-position signal generator for generating and outputting variable position signals which vary the positions of said beams in sequence for each preset input image area;

a fixed-position signal generator for generating and outputting fixed position signals which place said beams at preset positions; and a selector which selects either said Variable Position signal or said fixed position signal according to the position control signal output from said controller.

* * * * *